US007651189B2

(12) United States Patent
Komatsu et al.

(10) Patent No.: US 7,651,189 B2
(45) Date of Patent: Jan. 26, 2010

(54) LIQUID-EJECTION TESTING METHOD, LIQUID-EJECTION TESTING DEVICE, AND COMPUTER-READABLE MEDIUM

(75) Inventors: Shinya Komatsu, Nagano-ken (JP); Yuichi Nishihara, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 146 days.

(21) Appl. No.: 11/272,779

(22) Filed: Nov. 15, 2005

(65) Prior Publication Data

US 2006/0152543 A1 Jul. 13, 2006

(30) Foreign Application Priority Data

Nov. 17, 2004 (JP) ..... 2004-332888

(51) Int. Cl.
*B41J 29/393* (2006.01)

(52) U.S. Cl. ..... 347/19; 347/81; 347/14

(58) Field of Classification Search ..... 347/5, 347/9, 19, 81, 14
See application file for complete search history.

(56) References Cited

U.S. PATENT DOCUMENTS 3,977,010 A * 8/1976 Erickson et al. ..... 347/81
2004/0027405 A1* 2/2004 Stoessel et al. ..... 347/19

FOREIGN PATENT DOCUMENTS

JP 11-170569 A 6/1999
JP 2000-233520 A 8/2000

* cited by examiner

*Primary Examiner*—Lam S Nguyen
(74) *Attorney, Agent, or Firm*—Sughrue Mion, PLLC

(57) ABSTRACT

A liquid-ejection testing method includes the following steps (A) to (D): (A) a step of making a conductive first detection member and a conductive second detection member opposed, in a non-contact state, to a liquid ejecting nozzle that is to be tested; (B) a step of ejecting a charged liquid from the liquid ejecting nozzle; (C) a step of detecting an induced current generated at each of the first detection member and the second detection member by the liquid that has been ejected from the liquid ejecting nozzle; and (D) a step of judging, on the liquid ejecting nozzle, whether or not ejection of the liquid is being properly performed based on a magnitude of the detected induced current generated at each of the first detection member and the second detection member.

16 Claims, 39 Drawing Sheets

| | first detection member | second detection member |
|---|---|---|
| | V1max | V2max |
| #1 | V1max1 | V2max1 |
| #2 | V1max2 | V2max2 |
| #3 | V1max3 | V2max3 |
| #4 | V1max4 | V2max4 |
| #5 | V1max5 | V2max5 |
| ⋮ | ⋮ | |
| #180 | V1max180 | V2max180 |

Fig. 30A

| | test 1 (presence/ absence of ejection) | test 2 (ejection direction) | |
|---|---|---|---|
| | reference value | predetermined tolerance range | |
| | | lower limit value | upper limit value |
| #1 | α1 | β1 | γ1 |
| #2 | α2 | β2 | γ2 |
| #3 | α3 | β3 | γ3 |
| #4 | α4 | β4 | γ4 |
| #5 | α5 | β5 | γ5 |
| ⋮ | ⋮ | ⋮ | ⋮ |
| #180 | α180 | β180 | γ180 |

Fig. 30B

LIQUID-EJECTION TESTING METHOD, LIQUID-EJECTION TESTING DEVICE, AND COMPUTER-READABLE MEDIUM

CROSS-REFERENCE TO RELATED APPLICATIONS

The present application claims priority upon Japanese Patent Application No. 2004-332888 filed on Nov. 17, 2004, which is herein incorporated by reference.

BACKGROUND OF THE INVENTION

1. Field of the Invention

The present invention relates to liquid-ejection testing methods, liquid-ejection testing devices, and computer-readable media.

2. Description of the Related Art

Inkjet printers are known as printing apparatuses for carrying out printing by ejecting ink onto various media such as paper, cloth, and film. Inkjet printers perform color printing by ejecting ink of various colors such as cyan (C), magenta (M), yellow (Y), and black (K) to form dots on the medium. Ink is ejected using nozzles.

However, in these inkjet printers, clogging can occur in the nozzles due to adherence of the ink for example, and the ink may not be ejected properly. When ink cannot be ejected properly from the nozzles, dots cannot be formed appropriately on the medium, and this results in the trouble that an image will not be printed clearly.

Thus, various methods for testing whether or not ink is properly ejected have been conventionally proposed. As one method, a testing method for optically detecting ink ejected from the nozzles has been proposed (see JP-A-2000-233520). In this testing method, a photodiode detects whether or not a beam emitted from an LED is blocked by ink ejected from a nozzle, so that whether or not ink is ejected from the nozzle is checked.

However, this testing method has the problems as follows. It is very difficult to positionally align a beam emitted from an LED and ink ejected from a nozzle. When ink is ejected from the nozzle in a curve, it is impossible to detect ink ejection, and thus it may be impossible to accurately detect whether ink is being ejected or not.

SUMMARY OF THE INVENTION

The present invention was arrived at in light of these circumstances, and it is an object thereof to easily and efficiently check whether or not ejection of a liquid is being properly performed regarding nozzles from which a liquid such as ink is ejected.

A primary aspect of the present invention is a liquid-ejection testing method such as the following:

a step of making a conductive first detection member and a conductive second-detection member opposed, in a non-contact state, to a liquid ejecting nozzle that is to be tested;

a step of ejecting a charged liquid from the liquid ejecting nozzle;

a step of detecting an induced current generated at each of the first detection member and the second detection member by the liquid that has been ejected from the liquid ejecting nozzle; and a step of judging, on the liquid ejecting nozzle, whether or not ejection of the liquid is being properly performed based on a magnitude of the detected induced current generated at each of the first detection member and the second detection member.

Furthermore, another primary aspect of the present invention is a liquid-ejection testing device such as the following:

a conductive first detection member arranged in a state of non-contact with respect to a liquid ejecting nozzle that is to be tested;

a conductive second detection member arranged in a state of non-contact with respect to the liquid ejecting nozzle that is to be tested;

a first detecting section for detecting an induced current generated at the first detection member by a charged liquid ejected from the liquid ejecting nozzle;

a second detecting section for detecting an induced current generated at the second detection member by the charged liquid ejected from the liquid ejecting nozzle; and a judging section for judging, on the liquid ejecting nozzle, whether or not ejection of the liquid is being properly performed based on a magnitude of the induced current detected by each of the first detecting section and the second detecting section.

Furthermore, another primary aspect of the present invention is a computer-readable medium such as the following.

A computer-readable medium for causing a liquid-ejection testing device to operate; includes:

a code for ejecting a charged liquid from a liquid ejecting nozzle that is to be tested;

a code for acquiring a magnitude of an induced current generated by the liquid that has been ejected from the liquid ejecting nozzle at a conductive first detection member arranged in a state of non-contact with respect to the liquid ejecting nozzle;

a code for acquiring a magnitude of an induced current generated by the liquid that has been ejected from the liquid ejecting nozzle at a conductive second detection member arranged in a state of non-contact with respect to the liquid ejecting nozzle; and a code for judging, on the liquid ejecting nozzle, whether or not ejection of the liquid is being properly performed based on the acquired magnitude of the induced current.

BRIEF DESCRIPTION OF THE DRAWINGS

For a more complete understanding of the present invention and the advantages thereof, reference is now made to the following description taken in conjunction with the accompanying drawings.

FIG. 30A is a diagram illustrating the summary of actual measurement values acquired respectively for the nozzles.

FIG. 30B is a diagram illustrating the summary of reference values set respectively for the nozzles based on the actual measurement values.

DETAILED DESCRIPTION OF THE INVENTION

Detailed Description of the Preferred Embodiments

Figure 1:
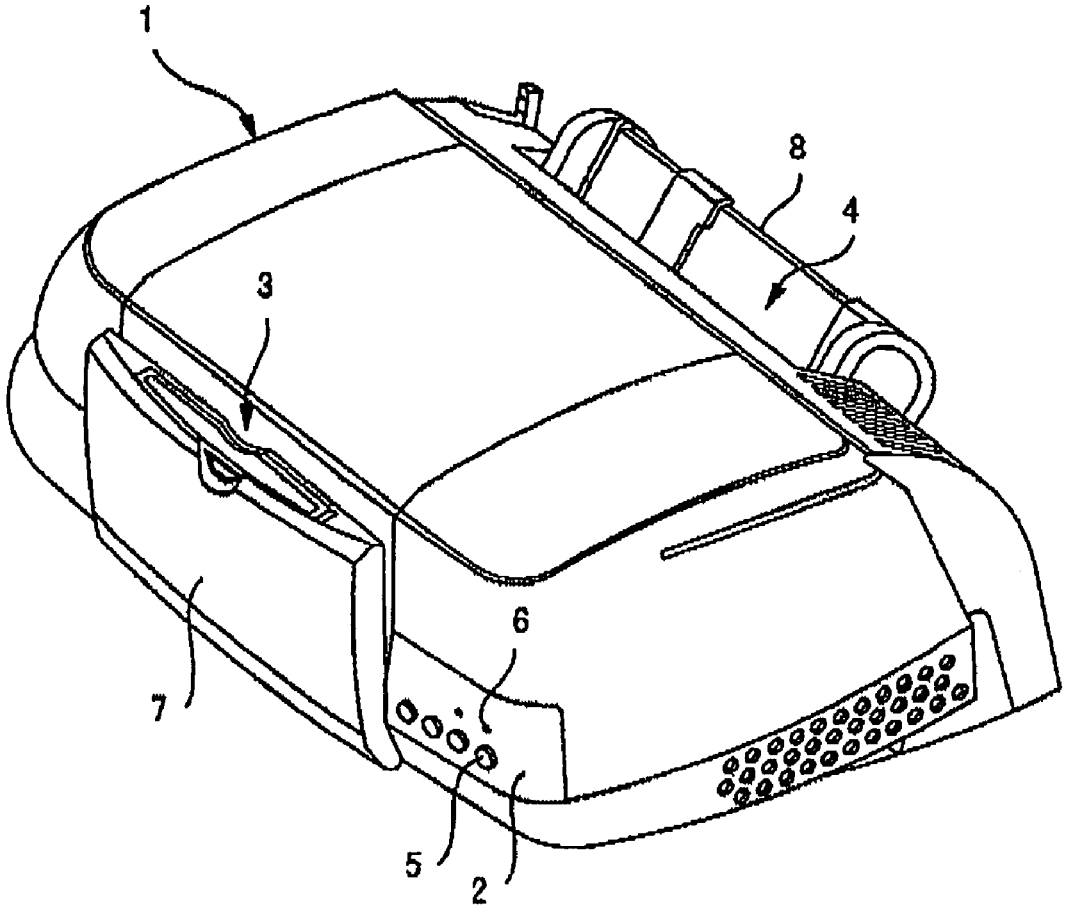
FIG. 1 is a perspective view of an embodiment of a printing apparatus according to the present invention.

At least the following matters will be made clear by the explanation in the present specification and the description of the accompanying drawings.

A liquid-ejection testing method includes:

a step of making a conductive first detection member and a conductive second detection member opposed, in a non-contact state, to a liquid ejecting nozzle that is to be tested;

a step of ejecting a charged liquid from the liquid ejecting nozzle;

a step of detecting an induced current generated at each of the first detection member and the second detection member by the liquid that has been ejected from the liquid ejecting nozzle; and a step of judging, on the liquid ejecting nozzle, whether or not ejection of the liquid is being properly performed based on a magnitude of the detected induced current generated at each of the first detection member and the second detection member.

In this liquid-ejection testing method, the magnitude of the induced current that has been generated by a charged liquid ejected from the liquid ejecting nozzle at each of the first detection member and the second detection member is detected, and based on the magnitude of the detected induced current, it is judged whether or not the liquid is properly ejected. Thus, it is possible to perform the ejection test on the liquid ejecting nozzle easily, efficiently, and at high precision. Accordingly, the time for the test can be shortened and the precision in the test can be improved.

In this liquid-ejection testing method, it is preferable that at least one of the first detection member and the second detection member is made of a plate-shaped member or a wire material.

When at least one of the first detection member and the second detection member is made of a plate-shaped member or a wire material in this manner, it is possible to easily let an induced current be generated at the detection member with a liquid that has been ejected from the liquid ejecting nozzle.

In this liquid-ejection testing method, it is preferable that whether or not ejection of the liquid is being properly performed is judged for the liquid ejecting nozzle based on a difference between the magnitude of the detected induced current that has been generated at the first detection member and the magnitude of the detected induced current that has been generated at the second detection member.

When judgment is performed based on this difference, it is possible to improve the precision in the test.

In this liquid-ejection testing method, it is preferable that whether or not the liquid has been ejected from the liquid ejecting nozzle is judged based on the magnitude of the detected induced current that has been generated at the first detection member and the magnitude of the detected induced current that has been generated at the second detection member.

When whether or not the liquid is ejected from the liquid ejecting nozzle is judged in this manner based on a magnitude of the induced current that has been detected by the first detecting section and the second detecting section, it is possible to easily test whether or not the liquid is ejected.

In this liquid-ejection testing method, it is preferable that whether or not an ejection direction of the liquid from the liquid ejecting nozzle is proper is judged based on the magnitude of the detected induced current that has been generated at the first detection member and the magnitude of the detected induced current that has been generated at the second detection member.

When whether or not an ejection direction of the liquid from the liquid ejecting nozzle is proper is judged in this manner, it is possible to easily test the ejection direction of the liquid.

In this liquid-ejection testing method, it is preferable that the first detection member and the second detection member are arranged in parallel to each other.

When the first detection member and the second detection member are arranged in parallel to each other in this manner, it is possible to judge at a good precision whether or not ejection or the liquid is being properly performed.

In this liquid-ejection testing method, it is preferable that the number of the liquid ejecting nozzle that is to be tested is plural.

When there are a plurality of liquid ejecting nozzles to be tested in this manner, it is possible to efficiently perform the test.

In this liquid-ejection testing method, it is preferable that at least one of the first detection member and the second detection member is disposed in a direction that intersects with a direction in which the liquid ejecting nozzles are arranged.

When at least one of the first detection member and the second detection member is disposed in this direction, it is possible to detect misalignment of the ejection direction of the liquid with respect to the direction in which the liquid ejecting nozzles are arranged.

In this liquid-ejection testing method, it is preferable that the number of at least one of the first detection member and the second detection member is plural.

When at least one of either the first detection member or the second detection member is provided in plurality in this manner, it is possible to efficiently perform the test. Accordingly, it is possible to make the test operation more efficient, so that the time for the test can be shortened.

In this liquid-ejection testing method, it is preferable that the plurality of first detection members or second detection members are arranged in parallel to each other.

When the plurality of first detection members or second detection members are arranged in parallel to each other in this manner, it is possible to efficiently perform the test.

In this liquid-ejection testing method, it is preferable that the plurality of first detection members or second detection members are arranged at even intervals.

When the plurality of first detection members or second detection members are arranged at equal intervals in this manner, it is possible to efficiently perform the test.

In this liquid-ejection testing method, it is preferable that the plurality of first detection members or second detection members are electrically connected to each other via a common line.

When the plurality of first detection members or second detection members are electrically connected to each other via a common line in this manner, it is possible to easily perform the test.

In this liquid-ejection testing method, it is preferable that the common line is connected to a detecting section-for detecting the magnitude of the induced current generated at the first detection members or second detection members.

When the common line is connected to this detecting section, it is possible to easily detect an induced current generated at the plurality of first detection members or second detection members.

In this liquid-ejection testing method, it is preferable that the common line is connected to one end portion of each of the first detection members or second detection members.

When the common line is connected to one end portion of each of the first detection members or the second detection members in this manner, it is possible to simplify the configuration.

In this liquid-ejection testing method, it is preferable that at least one of the first detection member and the second detection member is arranged spanning over an opening section provided in a substrate.

When the detection member is disposed over an opening section of a substrate in this manner, it is possible to easily provide the first detection member or the second detection member.

In this liquid-ejection testing method, it is preferable that a voltage is applied to at least one of the first detection member and the second detection member in order to charge the liquid to be ejected from the liquid ejecting nozzle.

When a voltage is applied to at least one of the first detection member and the second detection member in this manner, it is possible to easily charge the liquid to be ejected from the liquid ejecting nozzle.

In this liquid-ejection testing method, it is preferable that the liquid to be ejected from the liquid ejecting nozzle is charged by an electrode section to which a voltage is applied.

When this electrode section is used, it is possible to easily charge the liquid ejected from the liquid ejecting nozzle.

In this liquid-ejection testing method, it is preferable that the method further includes a step of changing a relative position between the liquid ejecting nozzle, and the first detection member and the second detection members.

When a step of changing a relative position between the plurality of liquid ejecting nozzles, the first detection member, and the second detection member is provided in this manner, it is possible to change the test position.

Furthermore, it is also possible to achieve a liquid-ejection testing device such as the following.

A liquid-ejection testing device includes:

a conductive first detection member arranged in a state of non-contact with respect to a liquid ejecting nozzle that is to be tested;

a conductive second detection member arranged in a state of non-contact with respect to the liquid ejecting nozzle that is to be tested;

a first detecting section for detecting an induced current generated at the first detection member by a charged liquid ejected from the liquid ejecting nozzle;

a second detecting section for detecting an induced current generated at the second detection member by the charged liquid ejected from the liquid ejecting nozzle; and a judging section for judging, on the liquid ejecting nozzle, whether or not ejection of the liquid is being properly performed based on a magnitude of the induced current detected by each of the first detecting section and the second detecting section.

Furthermore, it is also possible to achieve a computer-readable medium such as the following:

a code for ejecting a charged liquid from a liquid ejecting nozzle that is to be tested;

a code for acquiring a magnitude of an induced current generated by the liquid that has been ejected from the liquid ejecting nozzle at a conductive first detection member arranged in a state of non-contact with respect to the liquid ejecting nozzle;

a code for acquiring a magnitude of an induced current generated by the liquid that has been ejected from the liquid ejecting nozzle at a conductive second detection member arranged in a state of non-contact with respect to the liquid ejecting nozzle; and a code for judging, on the liquid ejecting nozzle, whether or not ejection of the liquid is being properly performed based on the acquired magnitude of the induced current generated at each of the first detection member and the second detection member.

Outline of Liquid Ejecting Apparatus and Printing Apparatus

Figure 2:
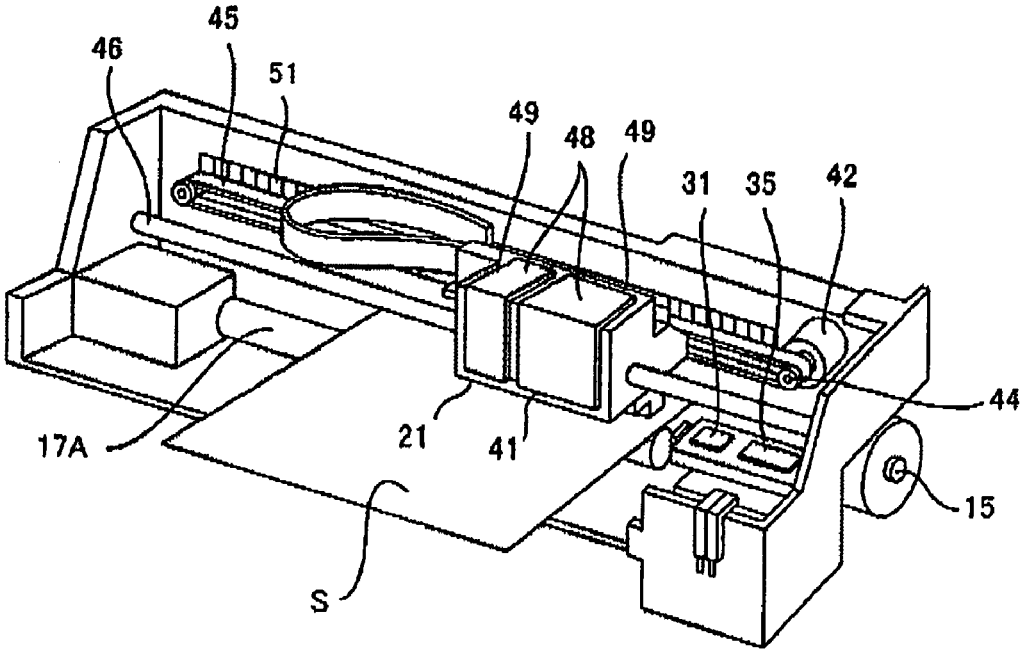
FIG. 2 is a perspective view illustrating the internal configuration of the printing apparatus.
Figure 2:
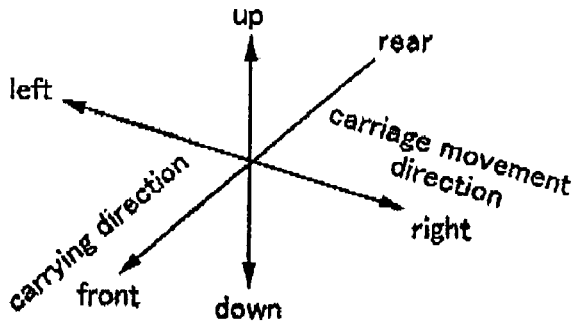
Figure 3:
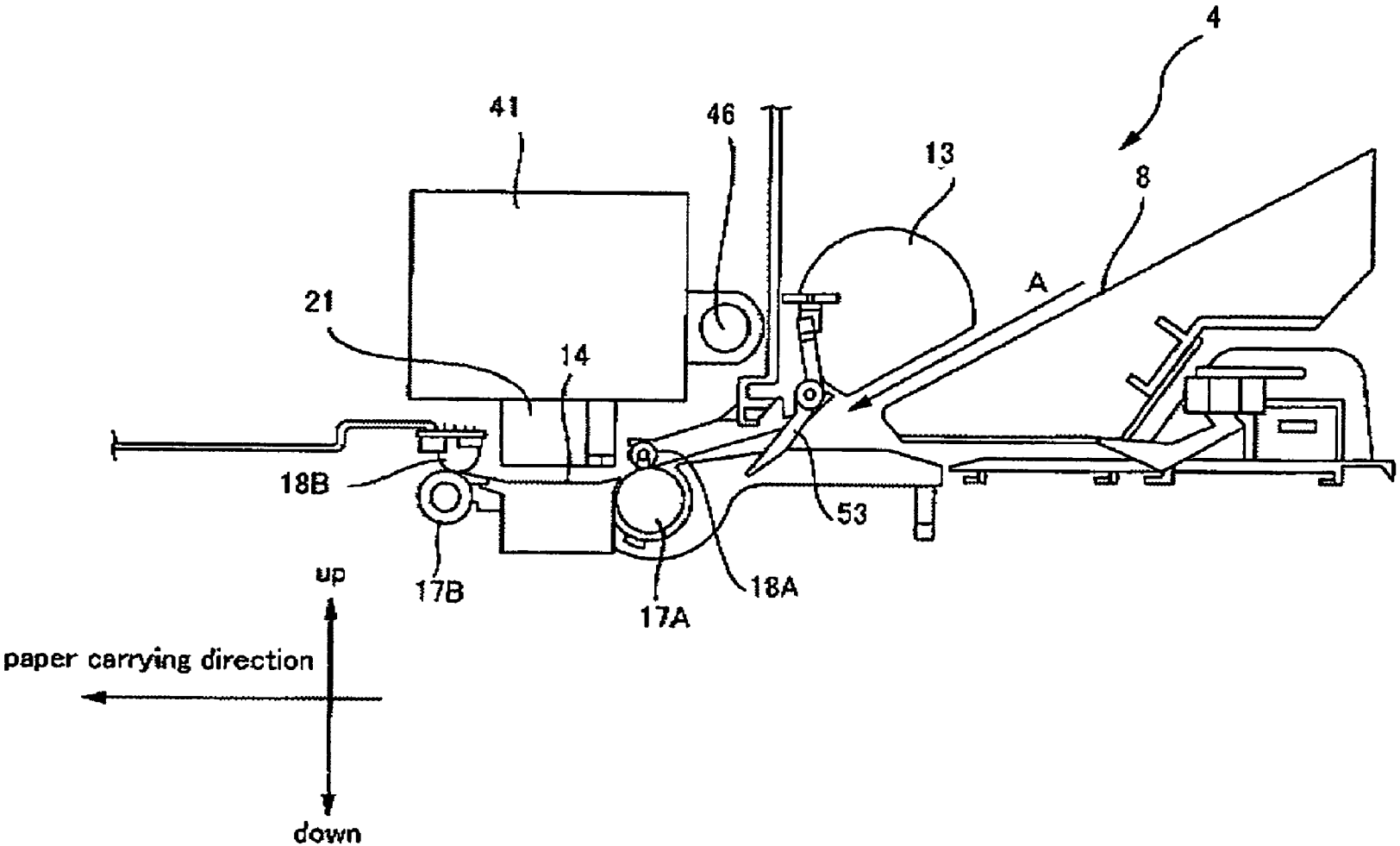
FIG. 3 is a cross-sectional view showing a carrying section of the printing apparatus.
Figure 4:
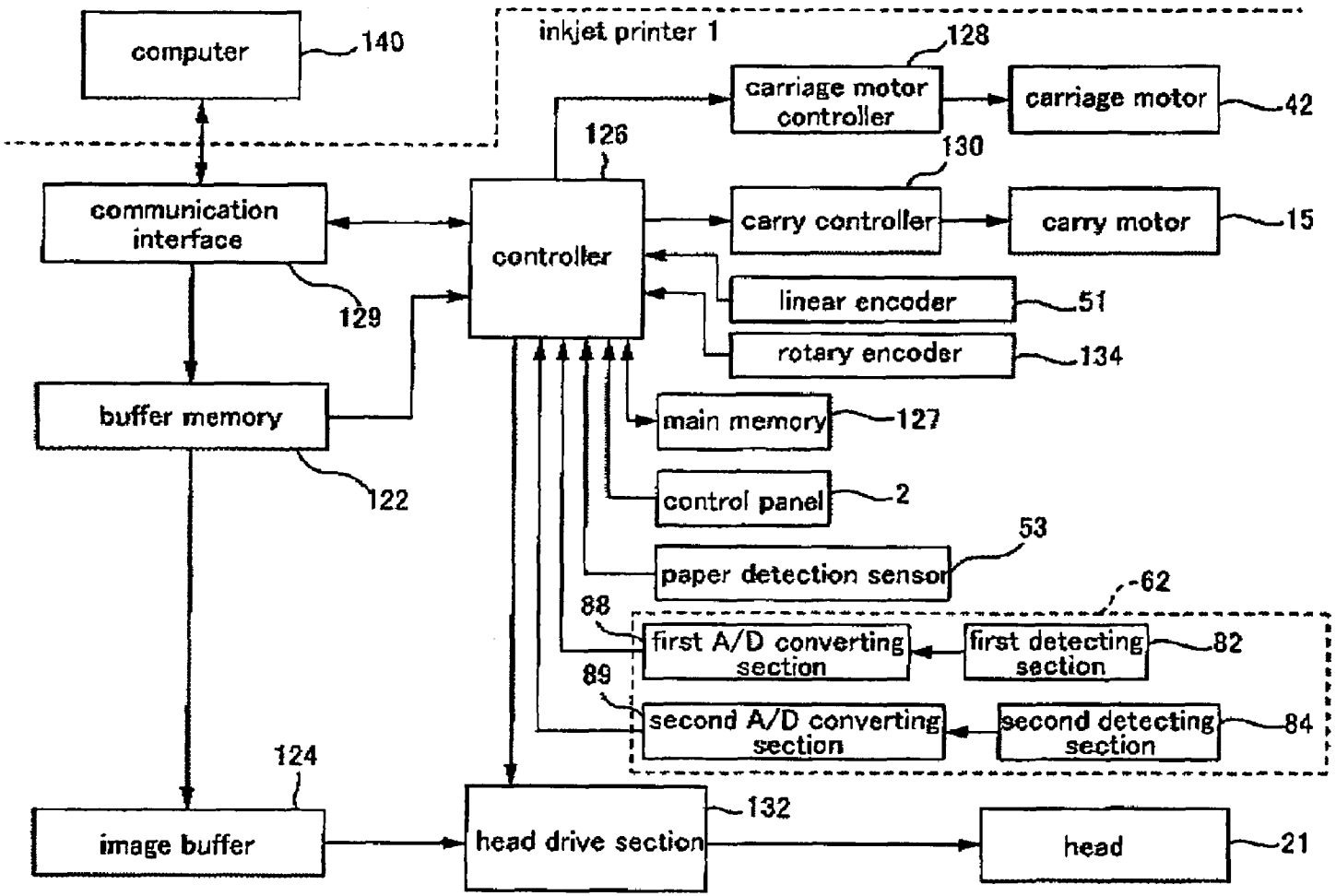
FIG. 4 is a block diagram showing the system configuration of the printing apparatus.

An embodiment of a liquid ejecting apparatus and a printing apparatus according to the present invention is described by taking an inkjet printer 1 as an example. FIGS. 1 to 4 show the inkjet printer 1. FIG. 1 shows the appearance of the inkjet printer 1. FIG. 2 shows the internal configuration of the inkjet printer 1. FIG. 3 shows the configuration of a carrying section of the inkjet printer 1. FIG. 4 shows the system configuration of the inkjet printer 1.

As shown in FIG. 1, the inkjet printer 1 is provided with a structure in which a medium such as print paper that is supplied from the rear face is discharged from the front face. The front face portion is provided with a control panel 2 and a paper discharge section 3, and the rear face portion is provided with a paper supply section 4. The control panel 2 is provided with various types of control buttons 5 and display amps 6. Furthermore, the paper discharge section 3 is provided with a paper discharge tray 7 that blocks the paper discharge opening when the inkjet printer is not used. The paper supply section 4 is provided with a paper supply tray 8 for holding a medium such as cut paper.

As shown in FIG. 2, the internal portion-of the inkjet printer 1 is provided with a carriage 41. The carriage 41 is disposed such that it can move relatively in the left-to-right direction. A carriage motor 42, a pulley 44, a timing belt 45, and a guide rail 46 are arranged in the vicinity of the carriage 41. The carriage motor 42 is constituted by a DC motor or the like and functions as a driving force for moving the carriage 41 relatively in the left-to-right direction (hereinafter, also referred to as "carriage movement direction"). The timing belt 45 is connected via the pulley 44 to the carriage motor 42, and a part of it is also connected to the carriage 41, such that the carriage 41 is moved relatively in the carriage movement direction (left-to-right direction) with the rotational force of the carriage motor 42. The guide rail 46 guides the carriage 41 in the carriage movement direction (left-to-right direction).

In addition to the above, a linear encoder 51 for detecting the position of the carriage 41, a carry roller 17A for carrying a medium S in the direction (front-to-rear direction in the drawing, and hereinafter, also referred to as "carrying direction") that intersects with the movement direction of the carriage 41, and a carry motor 15 for rotatively driving the carry roller 17A are arranged in the vicinity of the carriage 41.

On the other hand, the carriage 41 is provided with ink cartridges 48 that contain various types of ink and a head 21 that carries out printing on the medium S. The ink cartridges 48 contain ink of various colors such as yellow (Y), magenta (M), cyan (C), and black (K), and are mounted in a cartridge mounting section 49 provided in the carriage 41 in a removable manner. Furthermore, in this embodiment, the head 21 carries out printing by ejecting ink onto the medium S. For this reason, the head 21 is provided with a large number of nozzles for ejecting ink.

In addition to the above, the internal portion of the inkjet printer 1 is provided with, for example, a pump device 31 for pumping ink from the nozzles such that clogging in the nozzles of the head 21 is eliminated, and a capping device 35 for capping the nozzles of the head 21 when printing is not being carried out (when being on standby, for example) such that clogging in the nozzles of the head 21 is prevented.

The following is a description concerning a carrying section of the inkjet printer 1. As shown in FIG. 3, the carrying section is provided with a paper supply roller 13, a paper detection sensor 53, the carry roller 17A, a paper discharge roller 17B, a platen 14, and free rollers 18A and 18B.

The medium S to be printed is set at the paper supply tray 8. The medium S that has been set at the paper supply tray 8 is carried along the arrow A in the drawing by the paper supply roller 13, which has a substantially D-shaped cross-section, and is sent into the internal portion of the inkjet printer 1. The medium S that has been sent into the internal portion of the inkjet printer 1 is brought into contact with the paper detection sensor 53. This paper detection sensor 53 is positioned between the paper supply roller 13 and the carry roller 17A, so that it detects the medium S that has been supplied by the paper supply roller 13.

The medium S that has been detected by the paper detection sensor 53 is carried by the carry roller 17A one by one to the platen 14 on which printing is carried out. The free roller 18A is disposed at the position opposed to the carry roller 17A. The medium S is placed between the free roller 18A and the carry roller 17A such that the medium S is smoothly carried.

The medium S that has been sent onto the platen 14 is one by one printed with ink ejected from the head 21. The platen 14 is disposed so as to be opposed to the head 21 and supports the medium S to be printed from the below.

The medium S on which printing has been carried out is discharged by the paper discharge roller 17B one by one to the outside of the printer. The paper discharge roller 17B is driven in synchronization with the carry motor 15, and discharges the medium S to the outside of the printer by holding the medium S between the paper discharge roller 17B and the free roller 18B that is disposed so as to be opposed to this paper discharge roller 17B.

<System Configuration>

The following is a description concerning the system configuration of the inkjet printer 1. As shown in FIG. 4, the inkjet printer 1 is provided with a buffer memory 122, an image buffer 124, a controller 126, a main memory 127, a communication interface 129, a carriage motor controller 128, a carry controller 130, and a head drive section 132.

The communication interface 129 is used by the inkjet printer 1 to exchange data with an external computer 140 such as a personal computer. The communication interface 129 is connected to the external computer 140 such that wired or wireless communications are possible, and receives various types of data such as print data transmitted from the computer 140.

The various types of data such as print data received by the communication interface 129 is temporarily stored in the buffer memory 122. Furthermore, the print data stored in the buffer memory is sequentially stored in the image buffer 124. The print data stored in the image buffer 124 is sequentially sent to the head drive section 132. Furthermore, the main memory 127 is constituted by a ROM, a RAM, or an EEPROM for example. Various programs for controlling the inkjet printer 1 and various types of setting data, for example, are stored in the main memory 127.

The controller 126 reads out control programs and various types of setting data from the main memory 127 and performs overall control of the inkjet printer 1 in accordance with the control programs and the various types of setting data. Furthermore, detection signals from various sensors such as a rotary encoder 134, the linear encoder 51, and the paper detection sensor 53 are input to the controller 126.

When various types of data such as print data that has been sent from the external computer 140 is received by the communication interface 129 and is stored in the buffer memory 122, the controller 126 reads out necessary information from among the stored data from the buffer memory 122. Based on the information that is read out, the controller 126 controls each of the carriage motor controller 128, the carry controller 130, and the head drive section 132, for example, in accordance with control programs while referencing output from the linear encoder 51 and the rotary encoder 134.

The carriage motor controller 128 controls the drive such as the rotation direction, the rotation number, and the torque of the carriage motor 42 in accordance with instructions from the controller 126. The carry controller 130 controls the drive of, for example, the carry motor 15 for rotatively driving the carry roller 17A in accordance with instructions from the controller 126.

The head drive section 132 controls the drive of the color nozzles provided at the head 21 in accordance with instructions from the controller 126 and based on print data stored in the image buffer 124.

In addition to the above, the inkjet printer 1 according to this embodiment is provided with a first detecting section 82, a second detecting section 84, a first A/D converting section 88, and a second A/D converting section 89 as the configuration of a liquid-ejection testing device 62. The liquid-ejection testing device 62 is a device for checking whether or not ink is properly ejected from each nozzle provided at the head 21. More detailed description of the liquid-ejection testing device 62 is given later.

<Head>

Figure 5:
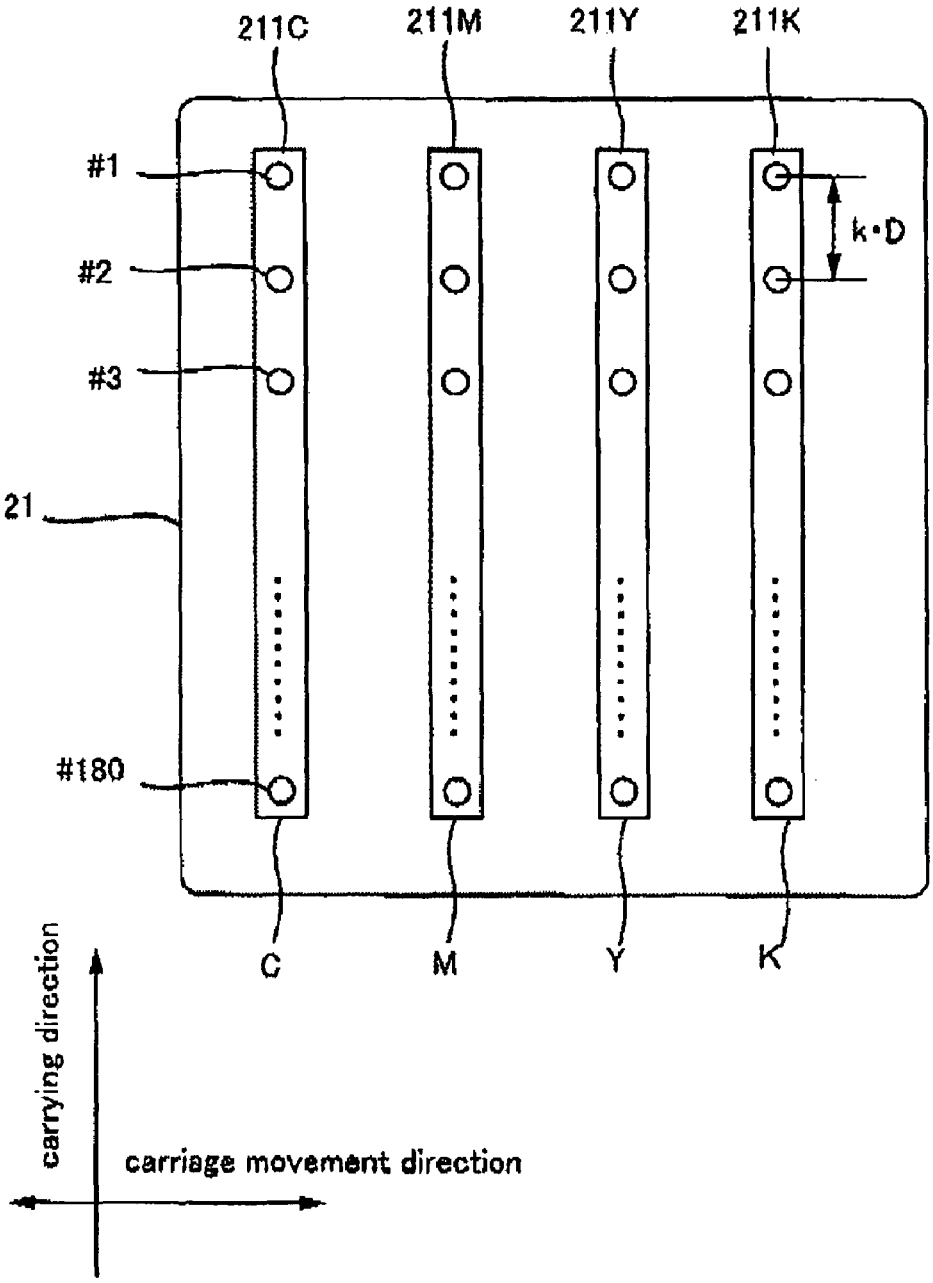
FIG. 5 is an explanatory diagram showing the arrangement of nozzles of a head.

FIG. 5 is a diagram showing the arrangement of the ink nozzles provided on the bottom face portion of the head 21. As shown in FIG. 5, the bottom face portion of the head 21 is provided with nozzle rows constituted by a plurality of nozzles #1 to #180 for each of the colors yellow (Y), magenta (M), cyan (C), and black (K), that is, a cyan nozzle row 211C, a magenta nozzle row 211M, a yellow nozzle row 211Y, and a black nozzle row 211K.

The nozzles #1 to #180 (corresponding to "liquid ejecting nozzles") in each of the nozzle rows 211C, 211M, 211Y, and 211K are arranged in one straight line with a spacing therebetween in a predetermined direction (carrying direction of the medium S in this embodiment). Each spacing between the nozzles #1 to #180 (nozzle spacing) is set to "k·D". Here, D is the minimum dot pitch in the carrying direction (that is, the spacing at the highest resolution of dots formed on the medium S). Also, k is an integer of 1 or larger. For example, if the nozzle pitch is 120 dpi (1/120 inch), and the dot pitch in the carrying direction is 360 dpi (1/360), then k=3. The nozzle rows 211C, 211M, 211Y, and 211K are arranged in parallel to each other with a spacing therebetween in the movement direction (scanning direction) of the head 21. The nozzles #1 to #180 are provided with piezo elements (not shown) as drive elements for ejecting ink droplets.

The nozzles #1 to #180 of each of the nozzle rows 211C, 211M, 211Y, and 211K are arranged in a straight line in a predetermined direction, In this embodiment, when the head is properly disposed, the nozzles #1 to #180 of each of the nozzle rows 211C, 211M, 211Y, and 211K are arranged in the carrying direction of the medium S. The nozzle rows 211C, 211M, 211Y, and 211K are arranged in parallel to each other with a spacing therebetween in the movement direction (scanning direction) of the head 21. The nozzles #1 to #180 are provided with piezo elements (not shown) as drive elements for ejecting ink droplets.

When a voltage of a predetermined duration is applied between electrodes provided at both ends of the piezo element, the piezo element is expanded for the duration of voltage application and deforms a lateral wall of the ink channel. Accordingly, the volume of the ink channel is constricted according to the expansion and constriction of the piezo element, and ink corresponding to this amount of constriction becomes an ink droplet, which is ejected from the corresponding nozzles #1 to #180 of the color nozzle rows 211C, 211M, 211Y, and 211K.

<Drive Circuit>

Figure 6:
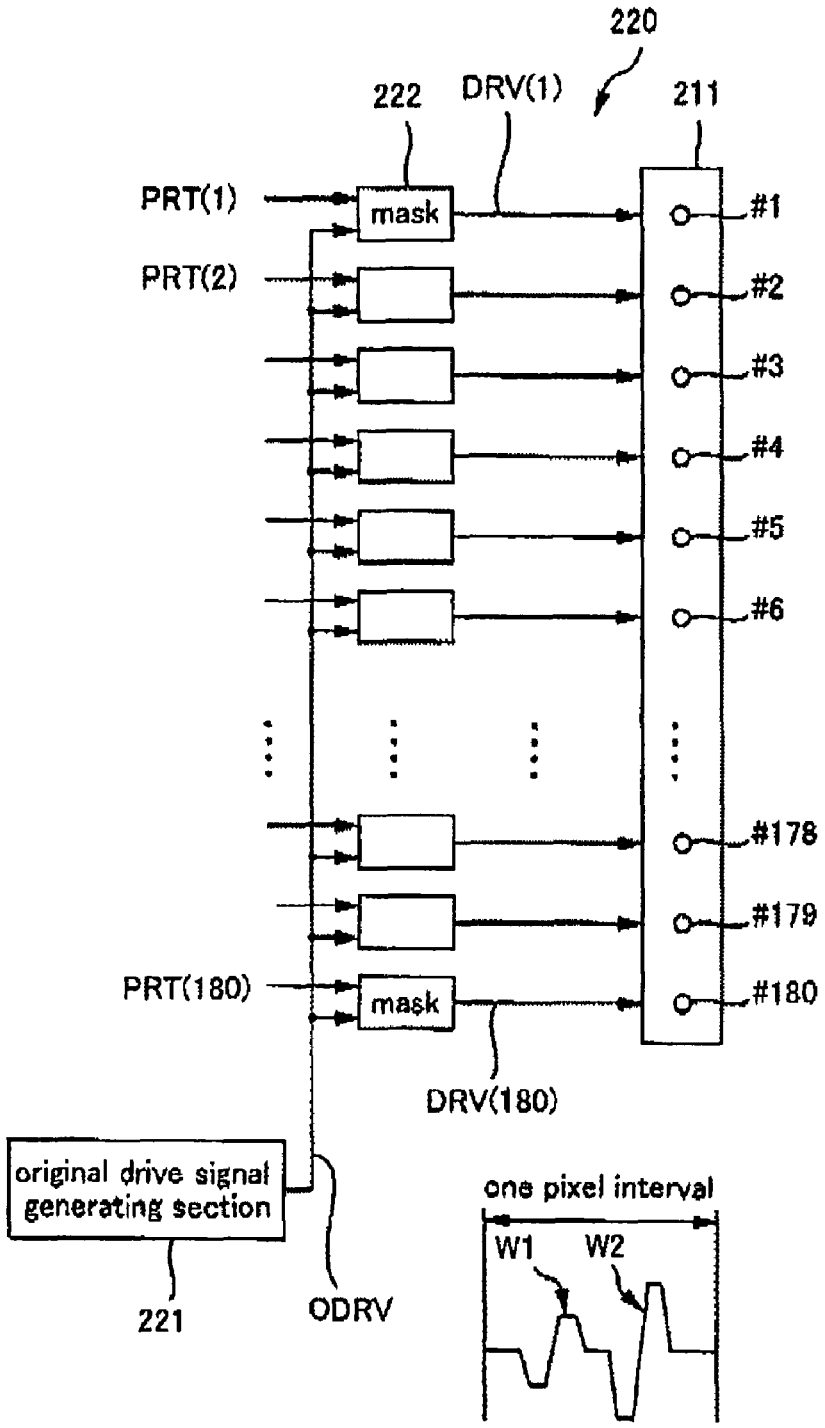
FIG. 6 is a diagram illustrating an example of a drive circuit of the head.

FIG. 6 shows a drive circuit 220 of the nozzles #1 to #180. As shown in FIG. 6, the drive circuit 220 is provided with an original drive signal generating section 221 and a plurality of mask circuits 222. The original drive signal generating section 221 generates an original drive signal ODRV that is commonly used by the nozzles #1 to #180. As shown in a lower portion of FIG. 6, the original drive signal ODRV is a signal that includes two pulses, a first pulse W1 and a second pulse W2 in a main-scanning period for one pixel (within a time during which the carriage 41 passes through the spacing of one pixel). The original drive signal ODRV generated at the original drive signal generating section 221 is output to the mask circuits 222.

The mask circuits 222 are provided in correspondence with the plurality of piezo elements for driving the nozzles #1 to #180 of the head 21. The mask circuits 222 receive the original drive signal ODRV from the original drive signal generating section 221 and also receive print signal PRT(i). The print signal PRT(i) is pixel data corresponding to a pixel, and is a binary signal having 2-bit information corresponding to one pixel. The bits respectively correspond to the first pulse W1 and the second pulse W2. The mask circuits 222 are gates for blocking the original drive signal ODRV or letting it pass through depending on the level of the print signal PRT(i). More specifically, when the print signal PRT(i) is at a level "0", the pulse of the original drive signal ODRV is blocked, but when the print signal PRT(i) is at a level "1", the pulse corresponding to the original drive signal ODRV is led to pass through as it is and is output as a drive signal DRV toward the piezo elements of the nozzles #1 to #180. The piezo elements of the nozzles #1 to #180 are driven based on the drive signal DRV from the mask circuits 222 and eject ink.

<Signal Waveforms>

Figure 7:
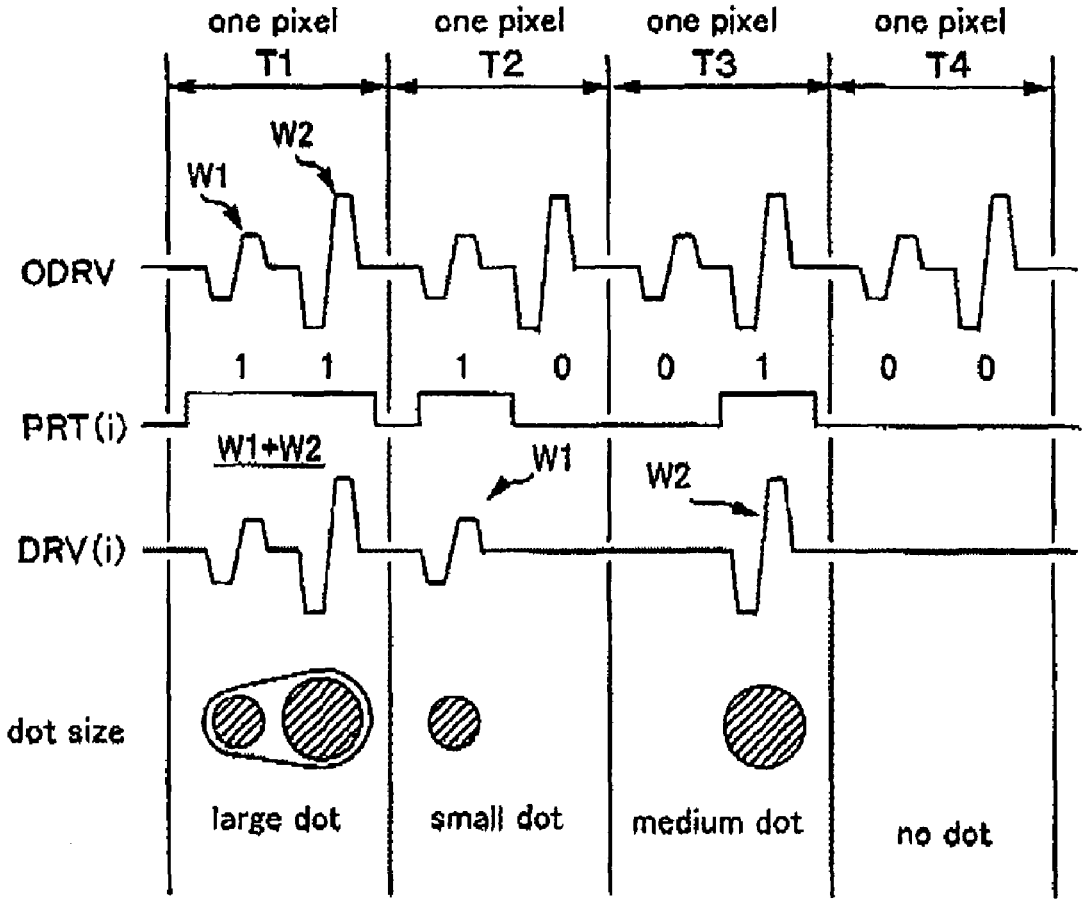
FIG. 7 is a timing chart of signals.

FIG. 7 is a timing chart of the original drive signal ODRV, the print signal PRT(i), and the drive signal DRV(i) indicating the operation of the original drive signal generating Section 221. As shown in FIG. 7, the original drive signal ODRV generates the first pulse W1 and the second pulse W2 in this order during each pixel interval T1, T2, T3, and T4. It should be noted that "pixel interval" has the same meaning as the movement interval of the carriage 41 for a one-pixel amount.

Herein, when the print signal PRT(i) corresponds to 2-bit pixel data "10", then only the first pulse W1 is output in the first half of one pixel interval. Accordingly, a small ink droplet is ejected from the nozzles #1 to #180, and a dot of a small size (small dot) is formed on the medium S. Furthermore, when the print signal PRT(i) corresponds to 2-bit pixel data "01", then only the second pulse W2 is output in the second half of one pixel interval. Accordingly an ink droplet of a medium size is ejected from the nozzles #1 to #180, and a dot of a medium size (medium dot) is formed on the medium S. Furthermore, when the print signal PRT(i) corresponds to 2-bit pixel data "11", then the first pulse W1 and the second pulse W2 are output during one pixel interval. Accordingly an ink droplet of a large size is ejected from the nozzles #1 to #180, and a dot of a large size (large dot) is formed on the medium S. As described above, the drive signal DRV(i) in one pixel interval is shaped such that it has three different waveforms corresponding to three different values of the print signal PRT(i), and based on these signals, the head 21 can form dots of three sizes and can adjust the amount of ink ejected during a pixel interval. Furthermore, if the print signal PRT(i) corresponds to 2-bit pixel data "00" as in the pixel interval T4, then no ink droplet is ejected from the nozzles #1 to #180, and no dot is formed on the medium S.

In the inkjet printer 1 according to this embodiment, the drive circuits 220 of the nozzles #1 to #180 are arranged separately for each of the nozzle rows 211C, 211M, 211Y, and 211K, that is, for each of the colors yellow (Y), magenta (M), cyan (C), and black (K), such that piezo elements are driven separately for each of the nozzles #1 to #180 of the nozzle rows 211C, 211M, 211Y, and 211K.

Printing Operation

Figure 8:
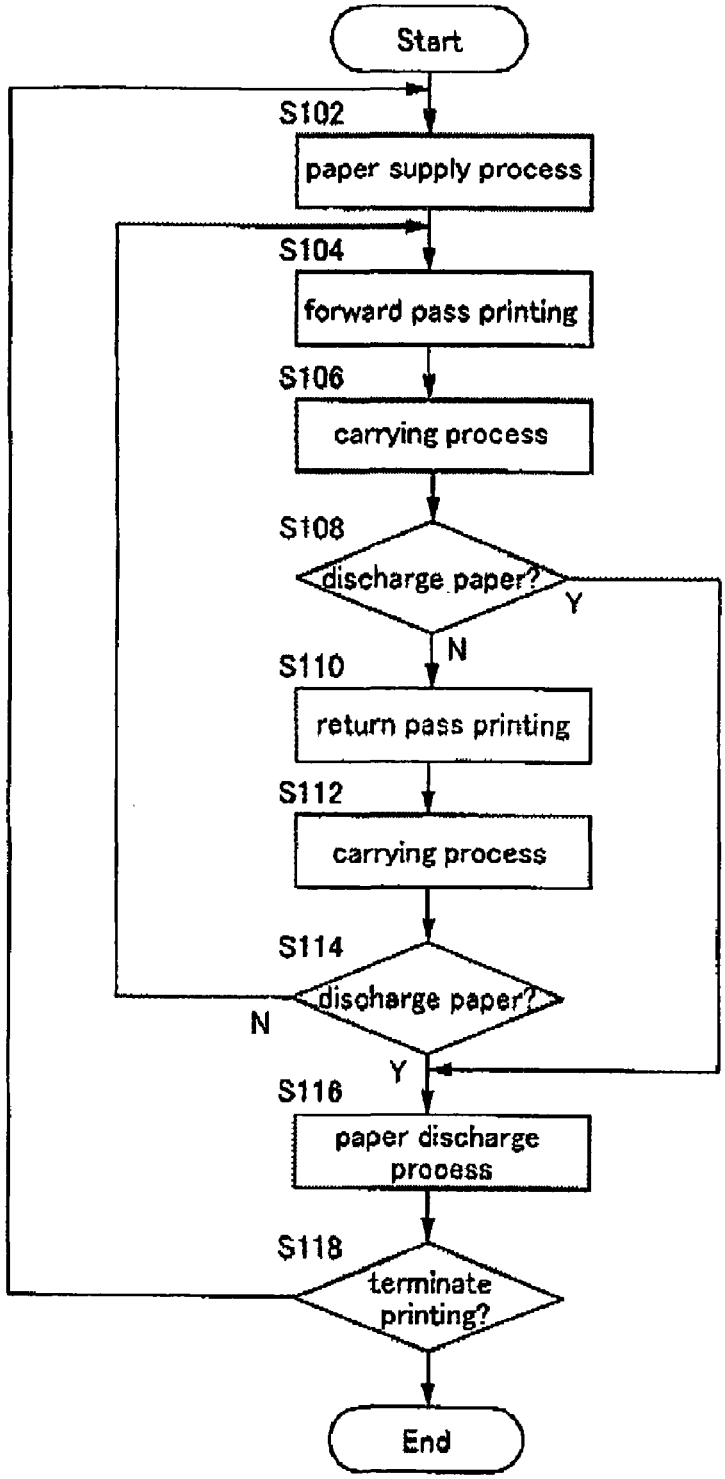
FIG. 8 is a flowchart illustrating an example of a printing process.

The following is a description concerning a printing operation of the above-described inkjet printer 1. Here, an example of "bidirectional printing" is explained. FIG. 8 is a flowchart showing an example of a processing procedure or the printing operation of the inkjet printer 1. The processes described below are each performed when the controller 126 reads out programs from the main memory 127 and controls each of the carriage motor controller 128, the carry controller 130, and the head drive section 132, for example, in accordance with the programs.

When the controller 126 receives print data from the computer 140, in order to carry out printing in accordance with the print data, first, a paper supply process is performed (S102). In the paper supply process, a medium S to be printed is supplied into the inkjet printer 1 and carried to a print starting position (also referred to as "print start position") The controller 126 rotates the paper supply roller 13 to send the medium S to be printed up to the carry roller 17A. The controller 126 rotates the carry roller 17A to position the medium S that has been sent from the paper supply roller 13 at the print starting position (upstream on the platen 14).

Next, the controller 126 performs a printing process in which the medium S is printed while moving the carriage 41 relative to the medium S by driving the carriage motor 42 via the carriage motor controller 128. Here, first, forward pass printing in which ink is ejected from the head 21 while moving the carriage 41 in one direction along the guide rail 46 is performed (S104). The controller 126 moves the carriage 41 by driving the carriage motor 42, and ejects ink by driving the head 21 in accordance with the print data. The ink ejected from the head 21 reaches the medium S, forming dots.

After printing has been carried out in this manner, the controller 126 performs a carrying process for carrying the medium S only by a predetermined amount (S106). Herein, the controller 126 rotates the carry roller 17A by driving the carry motor 15 via the carry controller 130, and carries the medium S only by a predetermined amount in the carrying direction relative to the head 21. With this carrying process, the head 21 can print onto a region that is different from the region printed on before.

After the carrying process has been performed in this manner, the controller 126 performs a paper discharge determination in which it is determined whether or not to discharge the paper (S108). Herein, the controller 126 performs a paper discharge process if there is no more data to be printed onto the medium S that is currently being printed (S116). On the other hand, if there is data left to be printed onto the medium S that is currently being printed, then the controller 126 performs return pass printing without performing a paper discharge process (S110). In this return pass printing, printing is carried out while moving the carriage 41 along the guide rail 46 in the opposite direction to the previous forward pass printing. Also here, the controller 126 moves the carriage 41 by rotatively driving the carriage motor 42 in the opposite direction as before via the carriage motor controller 128, ejects ink by driving the head 21 based on the print data, and carries out printing.

After return pass printing has been performed, a carrying process is performed (S112), and then a paper discharge determination is performed (S114). Here, if there is data left to be printed onto the medium S that is currently being printed, then no paper discharge process is performed, and the procedure returns to step S104, where forward pass printing is carried out again (S104). On the other hand, a paper discharge process is performed if there is no more data to be printed onto the medium S that is currently being printed (S116).

After the paper discharge process has been performed, a print termination determination is performed in which it is determined whether or not to terminate printing (S118). Here, based on the print data from the computer 140, it is checked whether or not there is a further medium S to be printed left. If there is a further medium S to be printed left, then the procedure returns to step S102, where another paper supply process is performed, and printing is started. On the other hand, if no further medium S to be printed is left, then the printing process is terminated.

Testing Principle of Liquid-ejection Testing Device

An embodiment of a liquid-ejection testing device according to the present invention is described. The following is a description concerning an example in which the liquid-ejection testing device according to the present invention is mounted on the above-described inkjet printer 1 (liquid ejecting apparatus, printing apparatus).

<Outline of Device>

Figure 9:
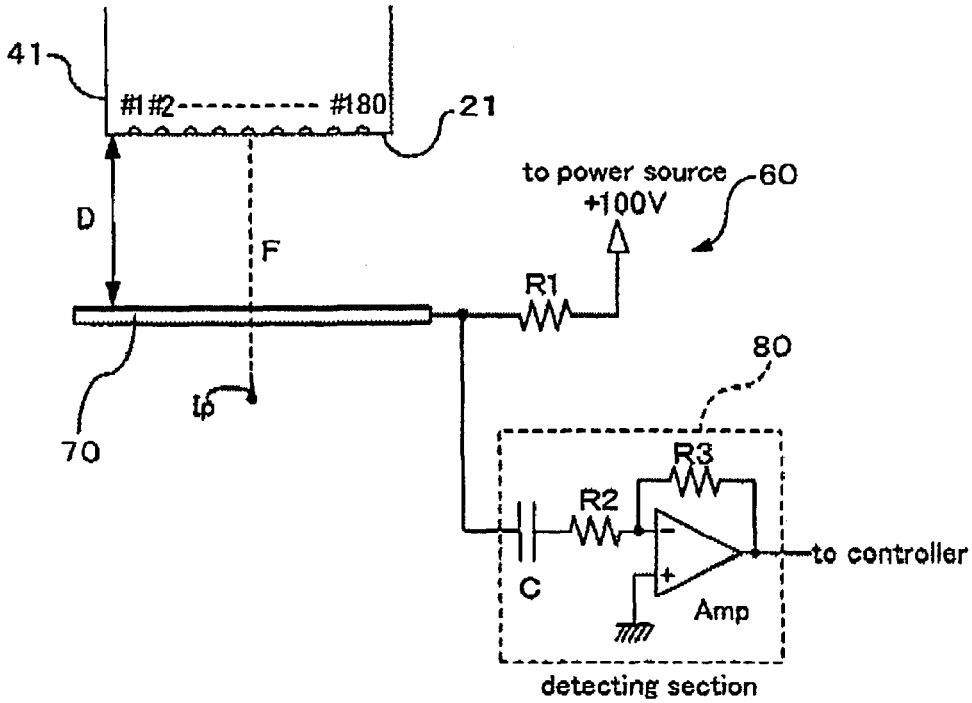
FIG. 9 is an explanatory diagram illustrating a basic configuration of a liquid-ejection testing device according to the embodiment.
Figure 10:
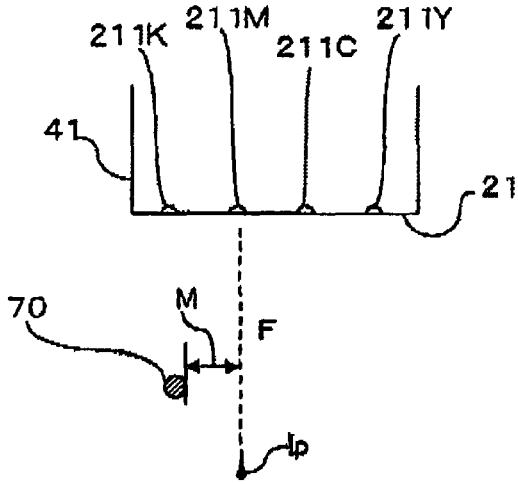
FIG. 10 is an explanatory diagram illustrating the testing principle of the liquid-ejection testing device according to the embodiment.

FIGS. 9 and 10 schematically illustrate a basic configuration 60 of the liquid-ejection testing device 62 mounted on the inkjet printer 1 according to this embodiment and the testing method thereof. FIG. 9 is an explanatory diagram illustrating the basic configuration 60 of the liquid-ejection testing device 62. FIG. 10 is an explanatory diagram for illustrating the testing principle of the liquid-ejection testing device 62.

As shown in FIG. 9, the basic configuration 60 is provided with a detection member 70 disposed at a position that can be opposed to the head 21, and a detecting section 80 connected to this detection member 70. The detection member 70 is made of a conductive wire material such as metal, and is disposed in parallel to the head 21 in such a manner that the detection member 70 is stretched in tension. The detection member 70 is disposed such that it can be opposed to the head 21 in a non-contact state with a spacing D from the head 21, when the carriage 41 moves. The spacing D between the head 21 and the detection member 70 is set to 1 mm, for example.

Furthermore, a power source (not shown) is connected via a protective resistance R1 to the detection member 70. A high voltage such as +100 V (volt) is applied from the power source to the detection member 70.

On the other hand the detecting section 80 detects an electric current generated at the detection member 70. In this embodiment, the detecting section 80 is constituted by a detection circuit provided with a capacitor C, an input resistance R2, a feedback resistance R3, and an operational amplifier Amp. When a change in the electric current is generated at the detection member 70, the capacitor C fulfills the role of inputting the change in the electric current as an electric signal via the input resistance R2 to the operational amplifier Amp. Furthermore, the operational amplifier Amp fulfills the role as an amplifier circuit in which the signal that has been input via the capacitor C is amplified and output. The output signal from the operational amplifier Amp is A/D converted from an analog signal to a digital signal by the A/D converting sections (the first A/D converting section 88 and the second A/D converting section 89, see FIG. 4), and is sent to the controller 126 in an appropriate state as a digital signal such as digital data.

When the ejection test is actually performed, an operation is performed in which ink is separately ejected from each of the nozzles #1 to #180 of the head 21 toward the detection member 70 or its vicinity. FIG. 10 illustrates how ink is ejected from a particular nozzle of the head 21 toward the vicinity of the detection member 70. Here, an ink droplet Ip of a one-time amount, that is, a one-droplet amount, is ejected from each of the nozzles #1 to #180 of the head 21.

At that time, a very high voltage such as 100 V (volt) is applied to the detection member 70 because of the voltage supplied from the power source. Thus, a very strong electric field is formed between the head 21 and the detection member 70. In such a state, when the ink droplet Ip is ejected from the nozzles #1 to #180, the ejected ink droplet Ip is charged.

The charged ink droplet Ip ejected from the nozzles #1 to #180 passes through the vicinity of the detection member 70. When the charged ink droplet Ip passes through the vicinity of the detection member 70, an induced current is generated at the detection member 70. When the charged ink droplet Ip approaches the detection member 70, an induced current is generated in a predetermined direction at the detection member 70. It should be noted that the induced current thus generated is attributable to electrostatic induction accompanying the approach of the charged ink droplet Ip.

At that time, at the detection member 70, the induced current of a magnitude corresponding to a distance M between the detection member 70 and a flight path F of the ink droplet Ip is generated. More specifically, if the flight path F of the ink droplet Ip is close to the detection member 70, then the magnitude of the induced current generated at the detection member 70 becomes large. Furthermore, if the flight path F of the ink droplet Ip is away from the detection member 70, then the magnitude of the induced current generated at the detection member 70 becomes small.

When an induced current corresponding to the distance between the detection ember 70 and the flight path F of the ink droplet Ip is generated at the detection member 70 in this manner, an electric current that is input to the detecting section 80 changes, and this change in the electric current is input as an electric signal via the input resistance R2 to the operational amplifier Amp. Then, the signal that has been input to the operational amplifier Amp is amplified and is output as a detection signal toward the controller 126, for example. Thus, when an induced current is generated at the detection member 70, it is detected by the detecting section 80, and the detection signal is converted from an analog signal to, for example, digital data through the A/D converting sections (the first A/D converting section 88 and the second A/D converting section 89, see FIG. 4), and is output toward the controller 126.

On the other hand, when no ink droplet Ip is ejected from the nozzles #1 to #180, no charged ink droplet Ip passes through the vicinity of the detection member 70, and thus a sufficient induced current is not generated at the detection member 70. Thus, a sufficient detection signal is not output at the detecting section 80.

The controller 126 acquires the magnitude of the induced current that has been generated at the detection member 70 based on the signal level of the detection signal that has been output from the detecting section 80, and judges whether or not the ink droplet Ip is properly ejected from the nozzles #1 to #180, based on the magnitude of the induced current. Herein, the controller 126 judges whether or not the ink droplet Ip is ejected from the nozzles #1 to #180, by comparing the magnitude of the induced current that has been acquired and a predetermined reference value, for example. Furthermore, the controller 126 judges whether or not the ejection direction of the ink droplet Ip is proper, based on the magnitude of the induced current that has been acquired. In addition to the above, the controller 126 may judge whether or not the ejecting speed of the ink droplet Ip from the nozzles #1 to #180 is proper by acquiring the timing at which an induced current is generated at the detection member 70, for example. In this embodiment, the controller 126 corresponds to "judging section" that judges whether or not ink is properly ejected.

It is preferable that the size of the ink droplet Ip ejected from the nozzles #1 to #180 in the ejection test is as large as possible. In other words, in the inkjet printer 1 according to this embodiment, it is preferable that the dot size is set to a size substantially equal to the largest dot size, for example, the ink droplet Ip that is ejected to form a large dot (pixel data "11") on the medium S. The reason for this is that the charge amount that the ink droplet Ip ejected from the nozzles #1 to #180 is charged becomes larger as the size of the ink droplet Ip ejected from the nozzles #1 to #180 becomes larger. When the charge amount of the ink droplet Ip becomes larger in this manner, an induced current can be generated more easily at the detection member 70. Thus, an induced current at the detection member 70 can be detected more easily at the detecting section 80.

It goes without saying that it is not necessarily required to set the size of the ink droplet Ip ejected in the ejection test to the size applied when a dot of the largest size (large dot, for example) is formed. An ink droplet Ip of a large size may be ejected specially only for the ejection test, or an ink droplet Ip of a small size may be ejected.

Furthermore, it is not necessarily required that the ink droplet Ip ejected from the nozzles #1 to #180 is ejected toward the vicinity of the detection member 70. The ink droplet Ip may be ejected so as to be brought into contact with the detection member 70. Also in this case, an induced current is generated at the detection member 70 because the ink droplet Ip approaches the detection member 70, and thus it is possible to check whether or not the ink droplet Ip is ejected.

Furthermore, the number of the ink droplet Ip ejected from the nozzles #1 to #180 is not necessarily limited to one. In other words, ink droplets Ip may be successively ejected a plurality of times from the nozzles #1 to #180. When the ink droplets Ip are successively ejected a plurality of times in this manner, the number of the ink droplets Ip that pass through the vicinity of the detection member 70 increases, and thus an induced current can be generated more easily at the detection member 70. Thus, an induced current can be detected more easily at the detecting section 80.

<Actual Detection Waveforms>

Figure 11:
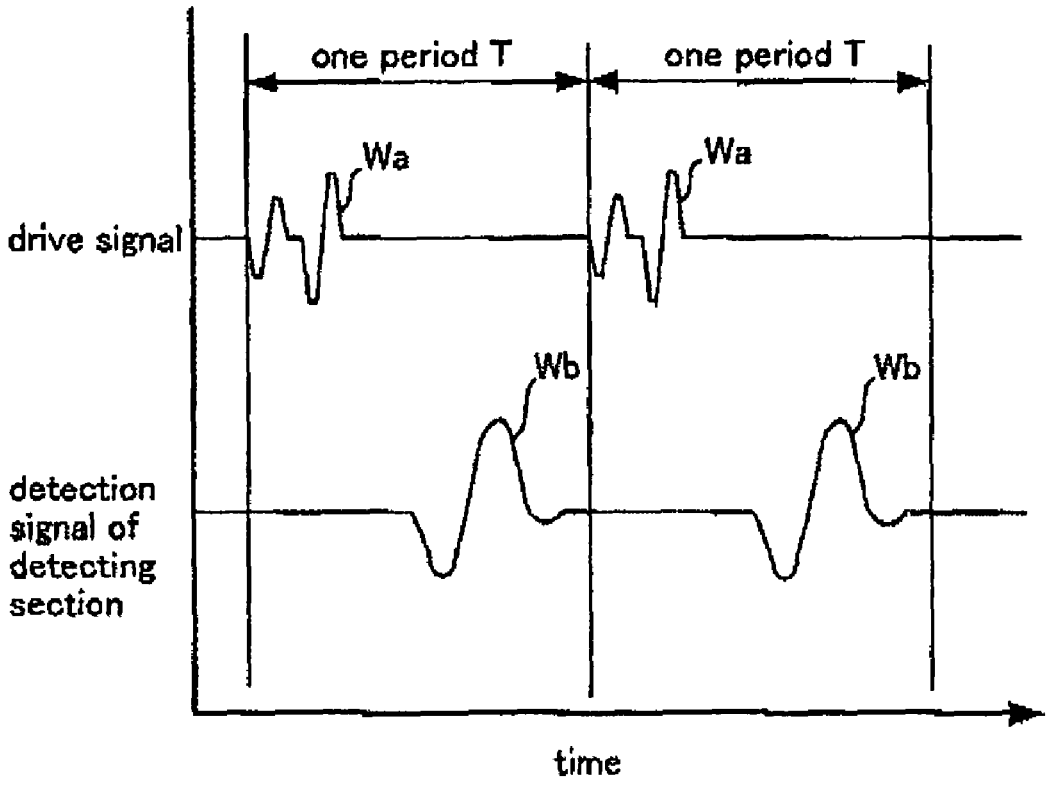
FIG. 11 is an explanatory diagram of a drive signal for letting ink be ejected and a detection signal of a detecting section.

FIG. 11 shows the respective waveforms of a drive signal that is output toward the piezo elements arranged in correspondence with the nozzles #1 to #180 in order to let ink be ejected in the ejection test and a detection signal from the detecting section 80. The upper waveform in FIG. 11 shows the waveform of the drive signal, and the lower waveform in FIG. 11 shows the waveform of the detection signal of the detecting section 80. When the ejection test is to be performed on a particular nozzle, as shown in FIG. 11, a drive pulse Wa for letting an ink droplet of a one-time amount, that is, a one-droplet amount be ejected is input as a drive signal to the piezo element disposed at the nozzle that is to be tested.

On one hand, when ink is properly ejected from the nozzle that is to be tested, based on the drive signal, an induced current is generated at the detection member 70 by the ink droplet Ip that has been ejected from the nozzle that is to be tested. When the induced current is detected by the detecting section 80, a pulse Wb in the waveform that oscillates up and down as shown in FIG. 11 is output as a detection signal from the detecting section 80. Since it takes time from when the ink droplet Ip is ejected from the nozzle that is to be tested until an induced current is generated, and since there is a slight time lag until when the induced current that is generated is detected by the detecting section 80 and output, the rising edge of the pulse of the detection signal that is output from the detecting section 80 is delayed compared to the drive pulse of the drive signal.

On the other hand, when ink is not properly ejected from the nozzles #1 to #180, no induced current is generated at the detection member 70. Thus, the pulse Wb in the waveform as shown in FIG. 11 does not appear clearly in the detection signal of the detecting section 80.

Furthermore, the magnitude of the pulse Wb in the detection signal from the detecting section 80 changes in accordance with the distance between the detection member 70 and the flight path F of the ink droplet Ip. The reason for this is that the magnitude of an induced current generated at the detection member 70 changes in accordance with the distance M between the detection member 70 and the flight path F of the ink droplet Ip.

Figure 12A:
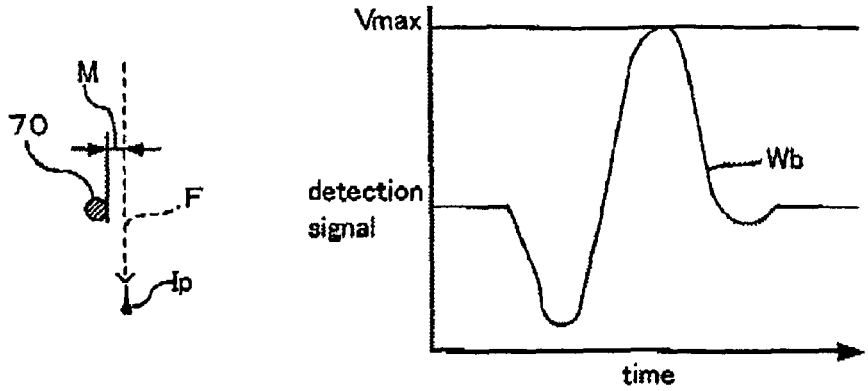
FIG. 12A is a diagram illustrating a case in which a flight path of an ink droplet is close to a detection member.
Figure 12B:
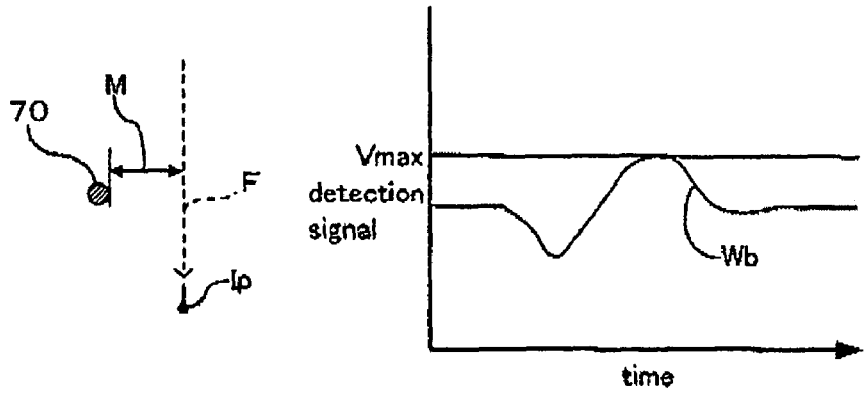
FIG. 12B is a diagram illustrating a case in which the distance between a flight path of an ink droplet and a detection member is appropriate.
Figure 12C:
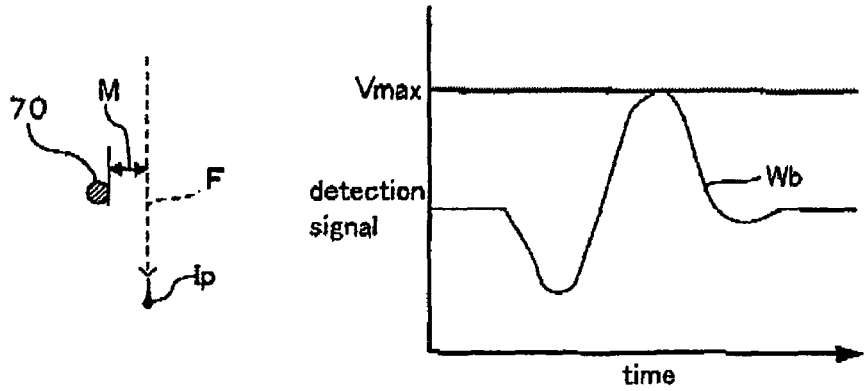
FIG. 12C is a diagram illustrating a case in which a flight path of an ink droplet is away from a detection member.

FIGS. 12A to 12C show the relationship between the distance M between the detection member 70 and the flight path F of the ink droplet Ip, and the waveform of the detection signal from the detecting section 80. FIG. 12A shows a case in which the distance M between the flight path F of the ink droplet Ip and the detection member 70 is very small. FIG. 12B shows a case in which the distance M between the flight path F of the ink droplet Ip and the detection member 70 is large. FIG. 12C shows a case in which the distance M between the flight path F of the ink droplet Ip and the detection member 70 is about medium.

When the flight path F of the ink droplet Ip is close to the detection member 70, the magnitude of the pulse Wb generated in the detection signal from the detecting section 80 is very large as shown in FIG. 12A. Accordingly, the peak value Vmax obtained from the detection signal is very large. On the other hand, when the flight path F of the ink droplet Ip is away from the detection member 70, the magnitude of the pulse Wb generated in the detection signal from the detecting section 80 is very small, and the peak value Vmax obtained from the detection signal is small, as shown in FIG. 12B. Furthermore, when the distance between the flight path F of the ink droplet Ip and the detection member 70 is about medium, the magnitude of the pulse Wb generated in the detection signal from the detecting section 80 is about medium, and the peak value Vmax obtained from the detection signal is about medium, as shown in FIG. 12C.

In this manner, it is possible to detect the distance M between the flight path F of the ink droplet Ip and the detection member 70 based on the peak value of the pulse Wb generated in the detection signal from the detecting section 80. Accordingly, it is possible to judge the ejection direction of the ink droplet Ip from the nozzles #1 to #180.

It should be noted that the ejection test can be performed successively on a plurality of nozzles such as one row of the nozzle rows, that is, 180 nozzles in the nozzles #1 to #180 at one time. At that time, as the drive signal, the drive pulse for letting the ink droplet Ip that is to be tested of a one-time amount (one-droplet amount) be ejected is repeatedly output at a predetermined period T as shown in FIG. 11. Furthermore, when ink is properly ejected from the nozzles #1 to #180 in response to the drive signal, pulses Wb are formed at the predetermined period T in the detection signal of the detecting section 80, as shown in FIG. 11. Herein, the predetermined period T is set as appropriate using, as a reference, the time from when the drive pulse Wa is output to the nozzles #1 to #180 that are to be tested to when the pulse Wb appears in the detection signal of the detecting section 80. The test can be performed separately for each of the nozzles #1 to #180 by checking the detection signal separately from the detecting section 80 in every period T.

Configuration of Liquid-ejection Testing Device of the Present Embodiment

The liquid-ejection testing device according to this embodiment is provided with two sets of: the detection members 70 at which an induced current is generated by the ink droplet Ip that has been ejected from each of the nozzles #1 to #180; and the detecting sections 80 for detecting the induced current generated at the detection members 70. The controller 126 judges whether or not the ink droplet Ip is properly ejected from the nozzles #1 to #180 based on the magnitude of an induced current acquired from the two sets of the detection members 70 and the detecting sections 80.

Figure 13:
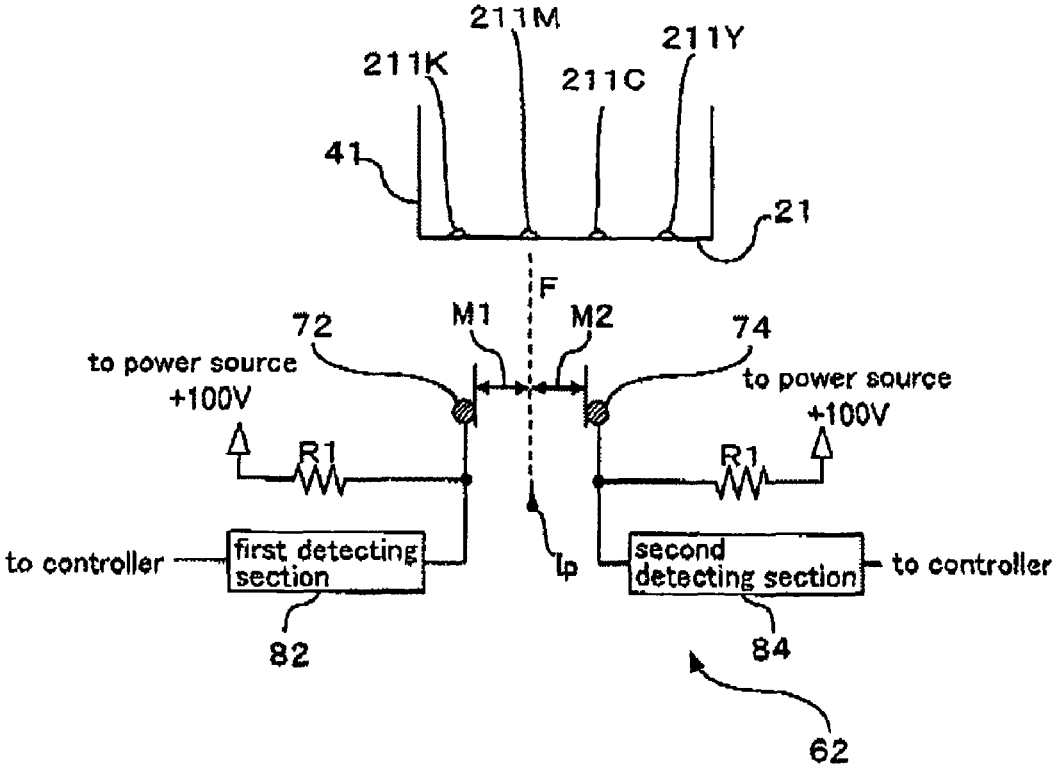
FIG. 13 is an explanatory diagram illustrating an outline of the configuration of the liquid-ejection testing device according to the embodiment.

FIG. 13 shows an example of the configuration of the liquid-ejection testing device 62 according to this embodiment. The liquid-ejection testing device 62 is provided with a first detection member 72 and a second detection member 74 as the detection members 70 at which an induced current is generated by the ink droplet Ip that has been ejected from each of the nozzles #1 to #180. Furthermore, the liquid-ejection testing device 62 is provided with the first detecting section 82 and the second detecting section 84 as the detecting sections 80 for detecting the induced current generated at the detection members 70 (the first detection member 72 and the second detection member 74). The first detecting section 82 detects an induced current generated at the first detection member 72. The second detecting section 84 detects an induced current generated at the second detection member 74.

As shown in FIG. 13, the first detection member 72 and the second detection member 74 are arranged such that they can be opposed to and are in parallel to the head 21. Furthermore, the first detection member 72 and the second detection member 74 are arranged in parallel to each other with a spacing therebetween.

Furthermore, a power source (not shown) is connected via the protective resistance R1 to each of the first detection member 72 and the second detection member 74, and a high voltage such as +100 V (volt) is applied to each of the first detection member 72 and the second detection member 74. The first detecting section 82 and the second detecting section 84 for detecting an induced current generated at the first detection member 72 and the second detection member 74 is connected to the first detection member 72 and the second detection member 74, respectively. The first detecting section 82 and the second detecting section 84 have the same configuration as the configuration of the detecting section 80 described based on FIG. 9.

When the ink droplet Ip is ejected from each of the nozzles #1 to #180, an induced current is generated at each of the first detection member 72 and the second detection member 74. Herein, an induced current of a magnitude according to a distance M1 between the first detection member 72 and the flight path F of the ink droplet Ip is generated at the first detection member 72. Furthermore, an induced current of a magnitude according to a distance M2 between the second detection member 74 and the flight path F of the ink droplet Ip is generated at the second detection member 74. In other words, when the distance M1 or M2 between the first detection member 72 or the second detection member 74 and the flight path F of the ink droplet Ip is small, a large induced current is generated at the first detection member 72 or the second detection member 74. Furthermore, when the distance M1 or M2 between the first detection member 72 or the second detection member 74 and the flight path F of the ink droplet Ip is large, a small induced current is generated at the first detection member 72 or the second detection member 74.

Each of the first detecting section 82 and the second detecting section 84 detects the induced current that has been generated respectively at the first detection member 72 and the second detection member 74, and outputs the magnitude of the detected induced current as a detection signal to the controller 126. In this embodiment, the detection signal that has been output from each of the first detecting section 82 and the second detecting section 64 is input, respectively, to the first A/D converting section 88 and the second A/D converting section 89 (see FIG. 4), is converted from an analog signal to a digital signal (such as digital data) at the first AD converting section 8 and the second A/D converting section 89, and is input to the controller 126.

Judgment of Whether or Not Ejection is Performed

Figure 14:
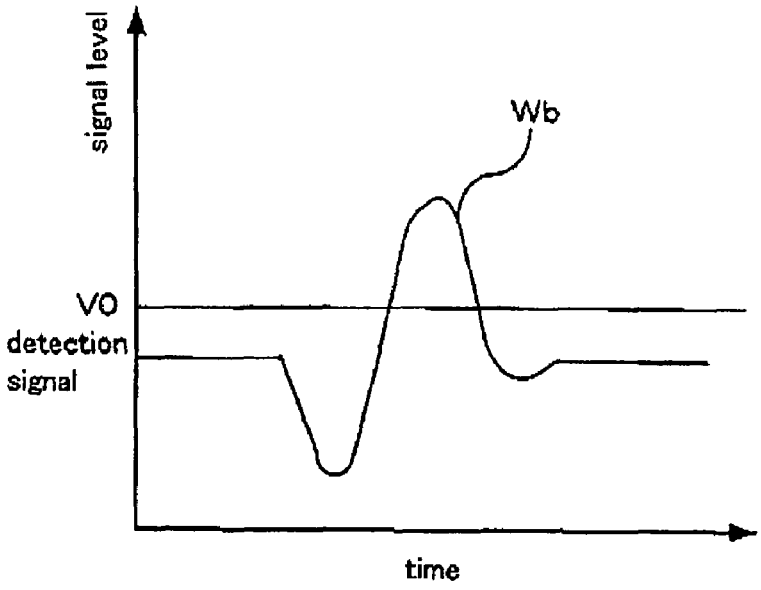
FIG. 14 is an explanatory diagram illustrating an example of a method for judging whether or not ejection is performed.

The following is a description concerning a method for judging with the controller 126 whether or not ejection is performed. FIG. 14 illustrates an example of a method for judging with the controller 126 whether or not the ink droplet Ip is ejected from the nozzles #1 to #180. Herein, the controller 126 performs judgment based on the magnitude of an induced current generated at each of the two detection members (the first detection member 72 and the second detection member 74), that is, a detection signal that is output from each of the first detecting section 82 and the second detecting section 84.

When the ink droplet Ip is ejected from the nozzles #1 to #180, an induced current is generated at the first detection member 72 or the second detection member 74. Accordingly, the pulse Wb is generated in a detection signal from the first detecting section 82 or the second detecting section 84 as shown in FIG. 14. Thus, the signal level of the detection signal from the first detecting section 82 or the second detecting section 84 increases to reach a predetermined reference value V0. When the signal level of the detection signal has reached the predetermined reference value V0 in this manner, the controller 126 determines that an induced current of a sufficient magnitude has been generated at the first detection member 72 or the second detection member 74, and judges that the ink droplet Ip has been ejected from the nozzle.

On the other hand, when no ink droplet Ip is ejected from the nozzles #1 to #180, no induced current is generated at either the first detection member 72 nor the second detection member 74, and thus no pulse Wb is generated in the detection signal from either the first detecting section 82 nor the second detecting section 84. Accordingly, the signal level of the detection signal from neither the first detecting section 82 nor the second detecting section 84 does not increase and does not reach the predetermined reference value V0. Thus, the controller 126 determines that an induced current of a sufficient magnitude has not been generated at either the first detection member 72 nor the second detection member 74, and judges that no ink droplet Ip has been ejected from the nozzle. The controller 126 judges whether or not the ink droplet Ip is ejected from each of the nozzles #1 to #180 based on the detection signal output from the first detecting section 82 and the second detecting section 84 in this manner.

Herein, the predetermined reference value V0 is set to an appropriate value that does not cause an error in the ejection test. Information on the predetermined reference value V0 is stored as data in an appropriate storing section, for example, a memory such as the main memory 127. When comparing the magnitude of the detection signal with the predetermined reference value V0, the controller 126 acquires the information on the predetermined reference value V0 from an appropriate storing section such as the main memory 127.

Figure 15:
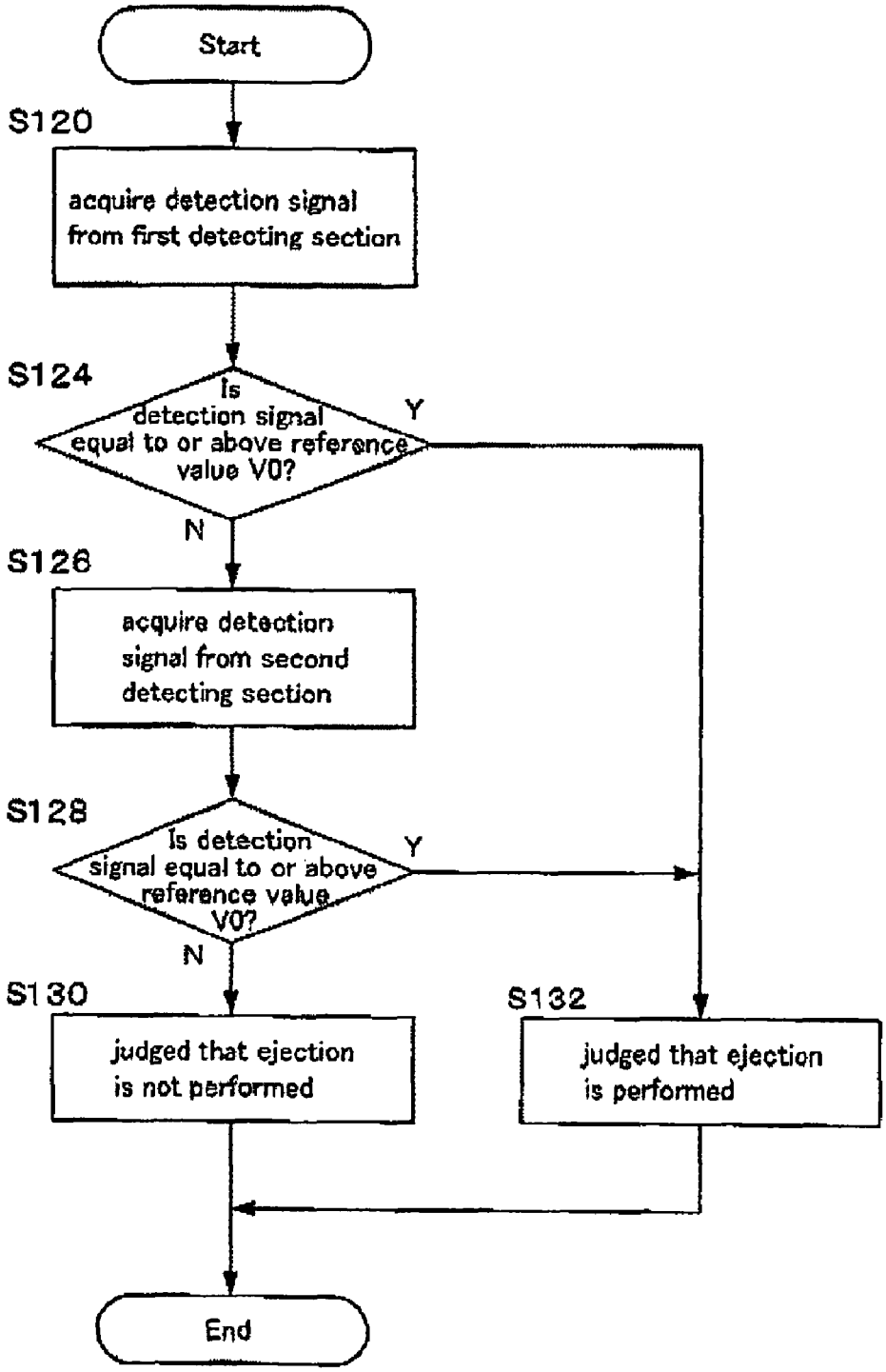
FIG. 15 is a flowchart illustrating an example of a procedure for judging whether or not ejection is performed.

FIG. 15 is a flowchart showing an example of a procedure for judging with the controller 126 whether or not ejection is performed. Herein, first, the controller 126 acquires the detection signal that has been output from the first detecting section 82 (S120). Next, the controller 126 compares the acquired detection signal from the first detecting section 82 with the predetermined reference value V0 (S124). If the result of the comparison is that the detection signal from the first detecting section 82 has reached the predetermined reference value V0, then the procedure proceeds to step S132, where the controller 126 judges that the ink droplet Ip is ejected from the nozzle that is to be tested. Subsequently, the controller 126 ends the process.

On the other hand, if the detection signal from the first detecting section 82 has not reached the predetermined reference value V0, then the procedure proceeds to step S126, where the controller 126 acquires the detection signal output from the second detecting section 84 (S126).

Next, the controller 126 compares the acquired detection signal from the second detecting section 84 with the predetermined reference value V0 (S128). Herein, if the detection signal from the second detecting section 84 has reached the predetermined reference value V0, then the process proceeds to step S132, where the controller 126 judges that the ink droplet Ip is ejected from the nozzle that is to be tested. Subsequently, the controller 126 ends the process.

On the other hand, if the detection signal from the second detecting section 84 has not reached the predetermined reference value V0, then the controller 126 determines that the ink droplet Ip has not been ejected from the nozzles because the detection signal from neither the first detecting section 82 nor the second detecting section 84 has reached the predetermined reference value V0, and judges that the ink droplet Ip is not ejected from the nozzles that are to be tested (S130). Subsequently, the controller 126 ends the process.

Judgment of Ejection Direction

The following is a description concerning an example of a method for testing whether or not the ejection direction of the ink droplet Ip from the nozzles #1 to #180 is proper. Herein, the judgment of whether or not the ejection direction of the ink droplet Ip is proper is also performed by the controller 126. The controller 126 performs the judgment based on the detection signals from the first detecting section 82 and the second detecting section 84. More specifically, the peak values of the detection signals output from the first detecting section 82 and the second detecting section 84 are acquired, and the difference between the two peak values is obtained. Then, based on the difference, it is judged whether or not the ejection direction of the ink droplet Ip from the nozzles #1 to #180 is proper. The magnitudes of the induced currents generated at the first detection member 72 and the second detection member 74 change in accordance with the distance between the first detection member 72 or the second detection member 74 and the flight path F of the ink droplet Ip.

<Detection Signals from Detecting Sections>

Figure 16A:
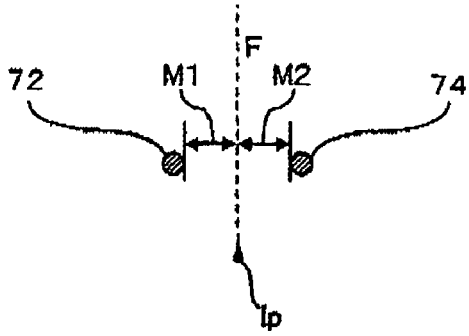
FIG. 16A is a diagram illustrating an example of the positional relationship between a first detection member, a second detection member, and a flight path of an ink droplet.
Figure 16B:
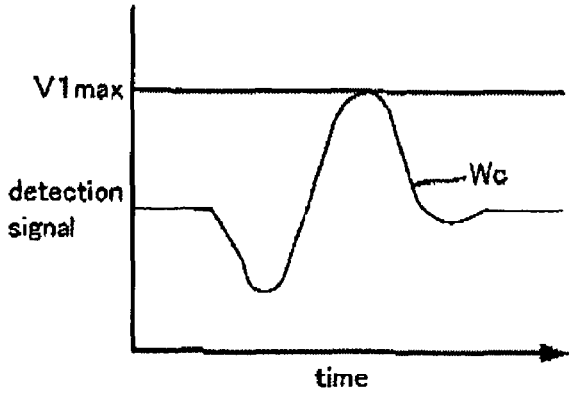
FIG. 16B is a diagram illustrating an example of a detection waveform of an induced current of the first detection member in this case.
Figure 16C:
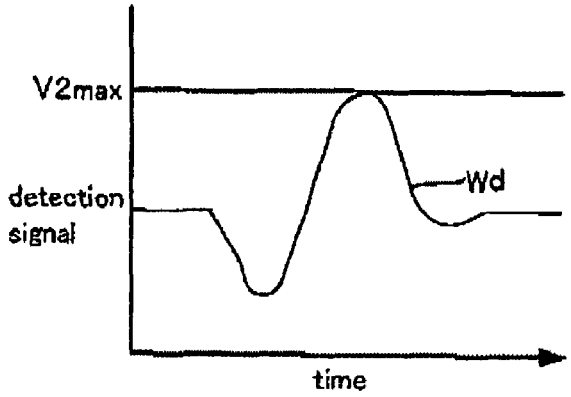
FIG. 16C is a diagram illustrating an example of a detection waveform of an induced current of the second detection member in this case.
Figure 17A:
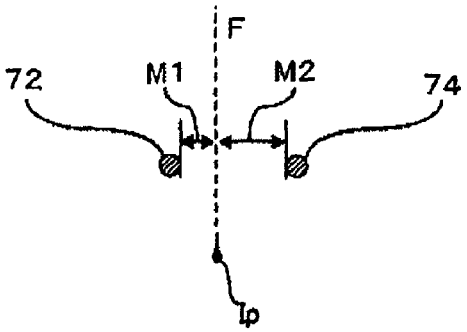
FIG. 17A is a diagram illustrating an example of the positional relationship between the first detection member and the second detection member, and a flight path of an ink droplet.
Figure 17B:
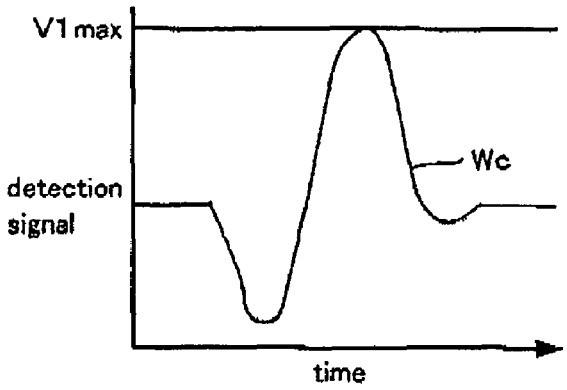
FIG. 17B is a diagram illustrating an example of a detection waveform of an induced current of the first detection member in this case.
Figure 17C:
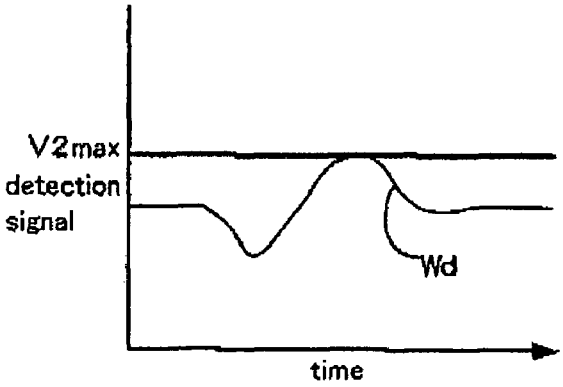
FIG. 17C is a diagram illustrating an example of a detection waveform of an induced current of the second detection member in this case.
Figure 18A:
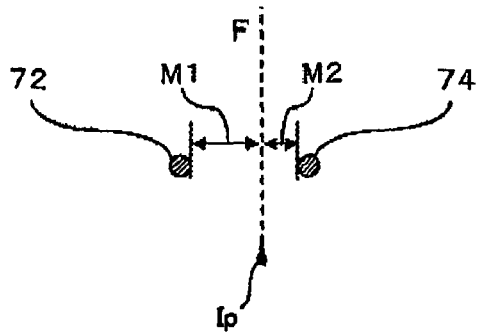
FIG. 18A is a diagram illustrating an example of the positional relationship between the first detection member and the second detection member, and a flight path of an ink droplet.
Figure 18B:
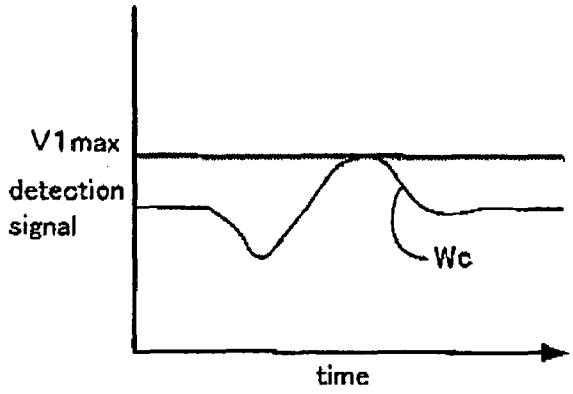
FIG. 18B is a diagram illustrating an example of a detection waveform of an induced current of the first detection member in this case.
Figure 18C:
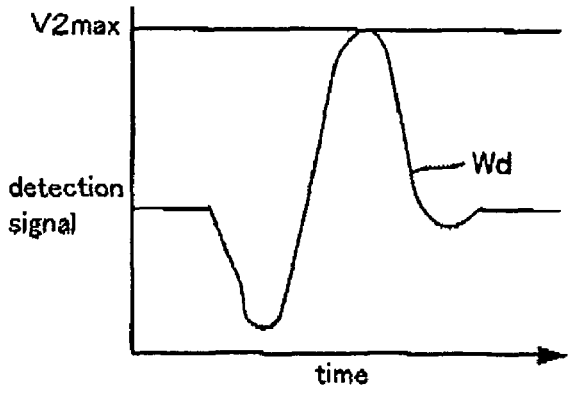
FIG. 18C is a diagram illustrating an example of a detection waveform of an induced current of the second detection member in this

FIGS. 16A to 18C illustrate the positional relationships between the first detection member 72 and the second detection member 74, and the flight path F of the ink droplet Ip, and the waveforms of the detection signals obtained from the first detecting section 82 and the second detecting section 84. FIGS. 16A to 16C illustrate a case in which the flight path F of the ink droplet Ip is substantially in the middle between the first detection member 72 and the second detection member 74. FIGS. 17A to 17C illustrate a case in which the flight path F of the ink droplet Ip has been shifted toward the side of the first detection member 72. FIGS. 18A to 18C illustrate a case in which the flight path F of the ink droplet Ip has been shifted toward the side of the second detection member 74. Each of FIGS. 16A, 17A, and 18A illustrates the positional relationship between the flight path F of the ink droplet Ip, and the first detection member 72 and the second detection member 74. Furthermore, each of FIGS. 16B, 17B, and 18B illustrates the detection signal obtained from the first detecting section 82. Furthermore, each of FIGS. 16C, 17C, and 18C illustrates the detection signal obtained from the second detecting section 84.

When the flight path F of the ink droplet Ip is substantially in the middle between the first detection member 72 and the second detection member 74 as shown in FIG. 16A, the distance M1 between the first detection member 72 and the flight path F of the ink droplet Ip is substantially equal to the distance M2 between the second detection member 74 and the flight path F of the ink droplet Ip. Thus, as shown in FIGS. 16B and 16C, the magnitude of the induced current generated at the first detection member 72 by the ink droplet Ip that has been ejected from the nozzles #1 to #180 is substantially equal to the magnitude of the induced current generated at the second detection member 74. Accordingly, a peak value V1max of a pulse Wc in the detection signal from the first detecting section 82 is substantially equal to a peak value V2max of a pulse Wd in the detection signal from the second detesting section 84.

On the other hand, when the flight path F of the ink droplet Ip has been shifted toward the side of the first detection member 72 as shown in FIG. 17A, the distance M1 between the first detection member 72 and the flight path F of the ink droplet Ip is smaller than the distance M2 between the second detection member 74 and the flight path F of the ink droplet Ip. Thus, as shown in FIGS. 17B ad 17C, the magnitude of the induced current generated at the first detection member 72 by the ink droplet Ip that has been ejected from the nozzles #1 to #18O is larger than the magnitude of the induced current generated at the second detection member 74. Accordingly, the peak value V1max of the pulse Wc in the detection signal from the first detecting section 82 is larger than the peak value V2max of the pulse Wd in the detection signal from the second detecting section 84.

Furthermore, when the flight path r of the ink droplet Ip has been shifted toward the side of the second detection member 74 as shown in FIG. 18A, the distance M2 between the second detection member 74 and the flight path F of the ink droplet Ip is smaller than the distance M1 between the first detection member 72 and the flight path F of the ink droplet Ip. Thus, as shown in FIGS. 18B and 18C, the magnitude of the induced current generated at the second detection member 74 by the ink droplet Ip that has been ejected from the nozzles #1 to #180 is larger than the magnitude of the induced current generated at the first detection member 72. Accordingly, the peak value V2max of the pulse Wd in the detection signal from the second detecting section 84 is larger than the peak value V1max of the pulse Wc in the detection signal from the first detecting section 82.

<Judgment Method>

When testing whether or not the ejection direction of the ink droplet Ip from the nozzles #1 to #180 is proper, the difference between the peak values V1max and V2max of the detection signals output from the first detecting section 82 and the second detecting section 84 is obtained and the judgment is performed based on the difference. The following is a description concerning an example in which the flight path F of the ink droplet Ip described based on FIGS. 16A, 17A, and 18A is a proper flight path.

Figure 19A:
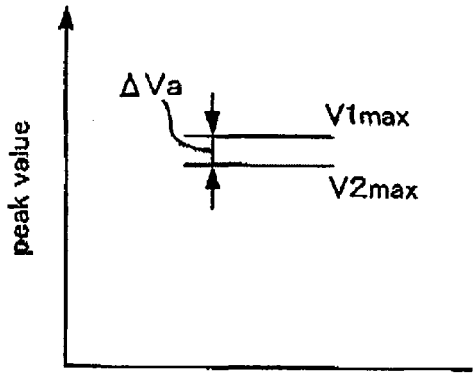
FIG. 19A is an explanatory diagram of the difference between the peak values in FIGS. 16B and 16C.
Figure 19B:
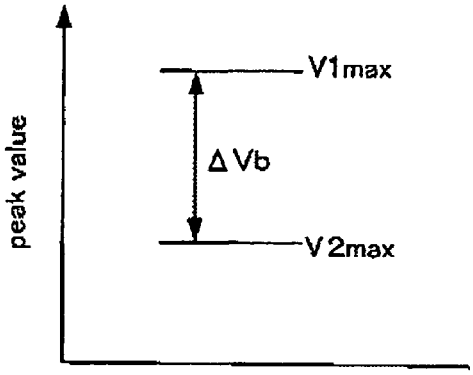
FIG. 19B is an explanatory diagram of the difference between the peak values in FIGS. 17B and 17C.
Figure 19C:
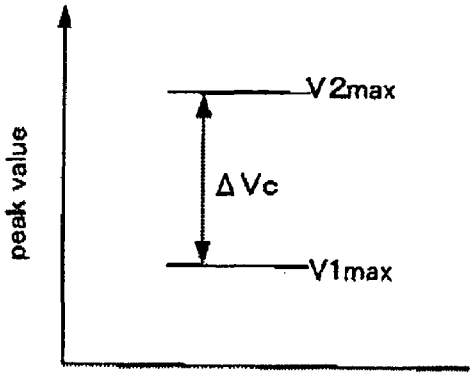
FIG. 19C is an explanatory diagram of the difference between the peak values in FIGS. 18B and 18C.

FIGS. 19A to 19C illustrate differences ΔVa, ΔVb, and ΔVc between the peak values V1max and V2max of the detection signals from the first detecting section 82 and the second detecting section 84 in FIGS. 16A to 18C. FIG. 19A illustrates the difference ΔVa between the peak values V1max and the V2max in FIGS. 16B and 16C. FIG. 19B illustrates the difference ΔVa between the peak values V1max and the V2max in FIGS. 17B and 17C, FIG. 19C illustrates the difference ΔVc between the peak values V1max and the V2max in FIGS. 18B and 18C. Herein, each of the differences ΔVa, ΔVb, and ΔVc are obtained based on a formula "V1max−V2max".

When the flight path F of the ink droplet Ip is substantially in the middle between the first detection member 72 and the second detection member 74 as shown in FIG. 16A, the peak value V1max of the detection signal from the first detecting section 82 is substantially equal to the peak value V2max of the detection signal from the second detecting section 84, and thus the difference ΔVa takes a very small value that is substantially close to zero as shown in FIG. 19A.

On the other hand, when the flight path F of the ink droplet Ip has been shifted toward the side of the first detection member 72 as shown in FIG. 17A, the peak value V1max of the detection signal from the first detecting section 82 is larger than the peak value V2max of the detection signal from the second detecting section 84, and thus the difference ΔVb takes a positive value whose absolute value is larger than that of the difference ΔVa, as shown in FIG. 19B.

Furthermore, when the flight path F of the ink droplet Ip has been shifted toward the side of the second detection member 74 as shown in FIG. 18A, the peak value V2max of the detection signal from the second detecting section 84 is larger than the peak value V1max of the detection signal from the first detecting section 82, and thus the difference ΔVc takes a negative value whose absolute value is larger than that of the difference ΔVa, as shown in FIG. 19C.

Herein, when the ejection direction of the ink droplet Ip from the nozzles #1 to #180 has been shifted, the flight path F of the ink droplet Ip moves, and the distance M1 between the flight path F of the ink droplet Ip and the first detection member 72 and the distance M2 between the flight path F of the ink droplet Ip and the second detection member 74 are changed. Thus, the magnitudes of the induced currents generated at the first detection member 72 and the second detection member 74 change, and the peak values V1max and V2max of the detection signals obtained from the first detecting section 82 and the second detecting section 84 are increased or decreased. Accordingly, the differences ΔVa, ΔVb, and ΔVc obtained from the two peak values V1max and V2max are changed.

Figure 20A:
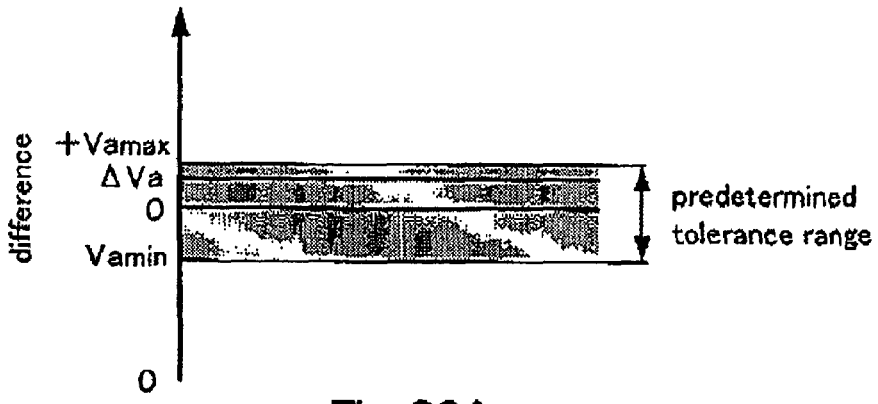
FIG. 20A is a diagram showing a setting example of a tolerance range that is set in accordance with the difference in FIG. 19A.
Figure 20B:
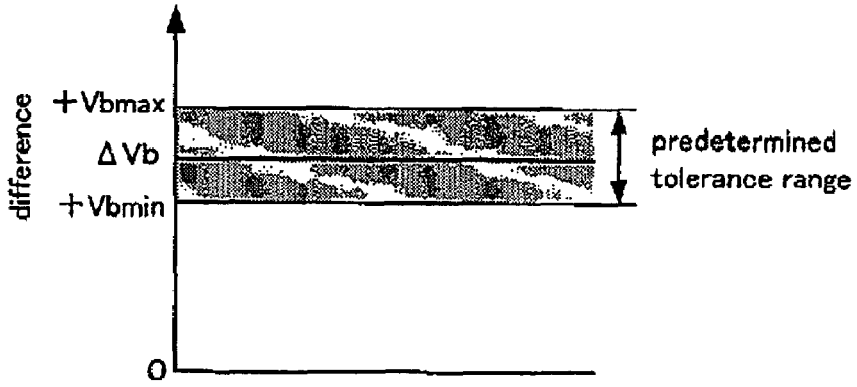
FIG. 20B is a diagram showing a setting example of a tolerance range that is set in accordance with the difference in FIG. 19B.
Figure 20C:
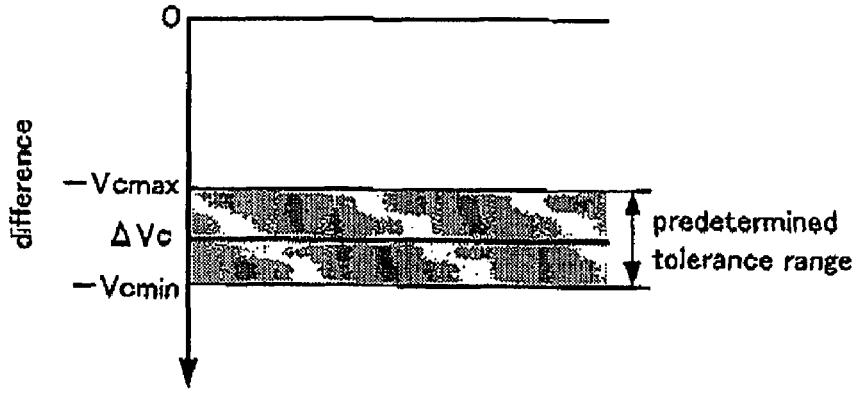
FIG. 20C is a diagram showing a setting example of a tolerance range that is set in accordance with the difference in FIG. 19C.

When judging whether or not the ejection direction of the ink droplet Ip from the nozzles #1 to #180 is proper, it is checked whether or not the differences ΔVa, ΔVb, or ΔVc is within a predetermined tolerance range. FIGS. 20A to 20C illustrate an example of predetermined tolerance ranges set with respect to the differences ΔVa, ΔVb, and ΔVc. FIG. 20A illustrates an example of a predetermined tolerance range set with respect to the difference ΔVa. FIG. 20B illustrates an example of a predetermined tolerance range set with respect to the difference ΔVb. FIG. 20C illustrates an example of a predetermined tolerance range set with respect to the difference ΔVc.

The difference ΔVa takes a very small value that is substantially close to zero when the ejection direction of the ink droplet Ip from the nozzles #1 to #180 is proper. Thus, the predetermined tolerance range in correspondence with the difference ΔVa is set such that the center is zero, the upper limit value is "+Vamax", and the lower limit value is "−Vamin", as shown in FIG. 20A. Herein, if the difference ΔVa is within the predetermined tolerance range, that is, at most "+Vamax" and at least "−Vamin", then it is judged that the ejection direction of the ink droplet Ip from the nozzles #1 to #180 is proper. On the other hand, if the difference ΔVa is out of the predetermined tolerance range, then it is judged that the ejection direction of the ink droplet Ip from the nozzles #1 to #180 is not proper.

Furthermore, the difference ΔVb changes in a positive range when the ejection direction of the ink droplet Ip from the nozzles #1 to #180 is proper. Thus, the predetermined tolerance range in correspondence with the difference ΔVb is set such that the upper limit value is "+Vbmax" and the lower limit value is "+Vbmin" as shown in FIG. 208. Herein, if the difference ΔVb is within the predetermined tolerance range, that is, at most "+Vbmax" and at least "+Vbmin", then it is judged that the ejection direction of the ink droplet Ip from the nozzles #1 to #180 is proper. On the other hand, if the difference ΔVb is out of the predetermined tolerance range, then it is judged that the ejection direction of the ink droplet Ip from the nozzles #1 to #180 is not proper.

Furthermore, the difference ΔVc changes in a negative range when the ejection direction of the ink droplet Ip from the nozzles #1 to #180 is proper. Thus, the predetermined tolerance range in correspondence with the difference ΔVc is set such that the upper limit value is "−Vcmax" and the lower limit value is "−Vcmin" as shown in FIG. 20C. Herein, if the difference ΔVc is within the predetermined tolerance range, that is, at most "−Vcmax" and at least "−Vcmin", then it is judged that the ejection direction of the ink droplet Ip from the nozzles #1 to #180 is proper. On the other hand, if the difference ΔVc is out of the predetermined tolerance range, then it is judged that the ejection direction of the ink droplet Ip from the nozzles #1 to #180 is not proper.

When the judgment is performed in this manner, it is possible to perform the test as appropriate on the nozzles #1 to #180 even when the positional relationship between the nozzles #1 to #180, which are to be tested, and the first detection member 72 and the second detection member 74 changes depending on the nozzles #1 to #180.

Herein, the upper limit values (such as "+Vamax", "+Vbmax", and "−Vcmax") and the lower limit values (such as "−Vamin", "+Vbmin", and "−Vcmin") which define the predetermined tolerance ranges correspond to "reference values". Information on the upper limit values (such as "+Vamax", "+Vbmax", and "−Vcmax") and the lower limit values (such as "−Vamin", "+Vbmin", and "−Vcmin") is stored as data in an appropriate storing section, for example, a memory such as the main memory 127. When judging the ejection direction, the controller 126 performs the judgment by acquiring the reference values from an appropriate storing section such as the main memory 127.

Furthermore, in this embodiment, the difference is obtained based on the peak values V1max and V2max of the detection signals from the first detecting section 82 and the second detecting section 84, and based on this difference, it is judged whether or not the ejection direction of the ink droplet Ip is proper. However, the method for judging the ejection direction of the ink droplet Ip is not limited to the method in which the difference is obtained by acquiring the peak values V1max and V2max of the detection signals from the first detecting section 82 and the second detecting section 84 and the judgment is performed based on the difference in this manner. Any judgment method may be applied as long as the judgment is performed based on the magnitude of the induced current generated at the first detection member 72 and the second detection member 74.

<Judgment Process Procedure>

Figure 21:
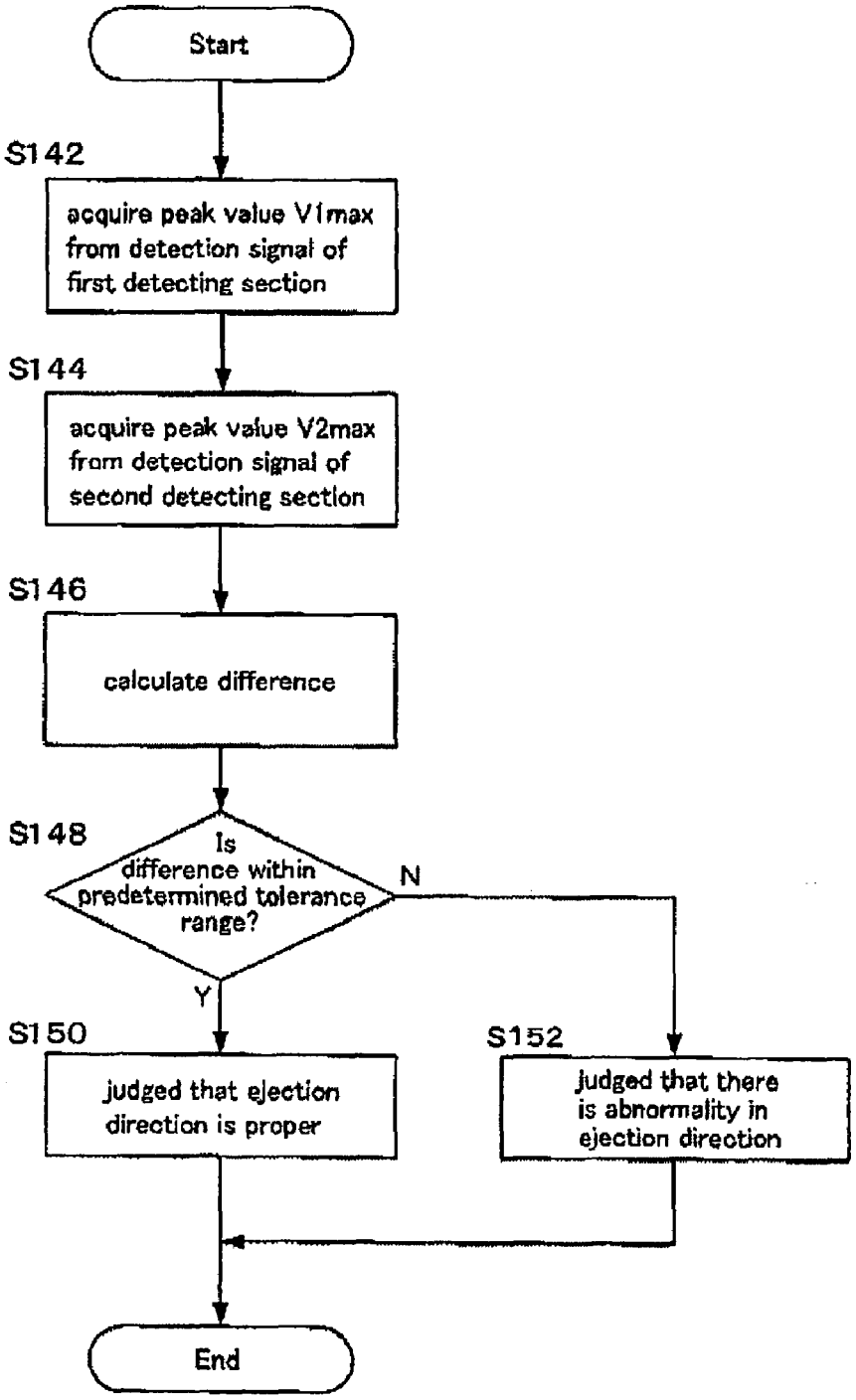
FIG. 21 is a flowchart illustrating an example of a procedure for judging the ejection direction.

FIG. 21 is a flowchart showing an example of a procedure for judging with the controller 126 the ejection direction. Herein, first, the controller 126 acquires the peak value V1max from the detection signal output from the first detecting section 82 (S142). Next, the controller 126 acquires the peak value V2max from the detection signal output from the second detecting section 84 (S144). Next, the controller 126 calculates the difference based on the acquired peak values V1max and V2max (S146).

Next, the controller 126 checks whether or not the difference is within a predetermined tolerance range (S148). Herein, if the difference is within the predetermined tolerance range, then the controller 126 judges that the ejection direction of the ink droplet Ip from the nozzles #1 to #180 is proper (S150). On the other hand, if the difference is out of the predetermined tolerance range, then the controller 126 judges that the ejection direction of the ink droplet Ip from the nozzles #1 to #180 is not proper (S152).

Detection Members of the Present Embodiment

In the inkjet printer 1 according to this embodiment, the first detection member 72 and the second detection member 74 have the configuration as below in order to efficiently perform the ejection test on the nozzles #1 to #180 of the nozzle rows 211C, 211M, 211Y, and 211K.

<Arrangement Method>

Figure 22A:
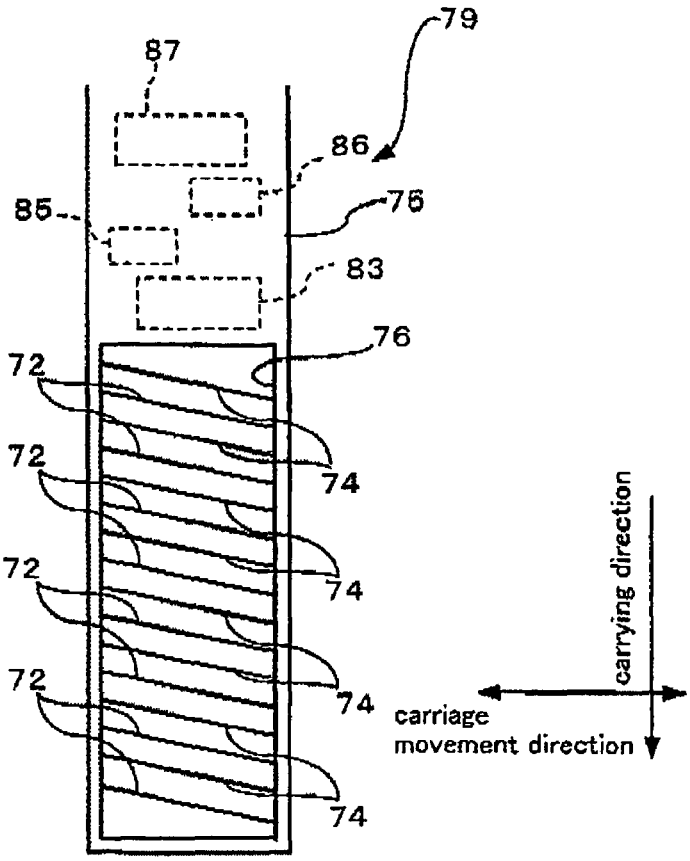
FIG. 22A is a plan view illustrating the configuration of the first detection member and the second detection member according to the embodiment.
Figure 22B:
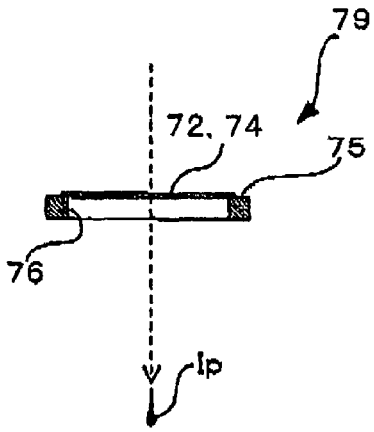
FIG. 22B is a vertical cross-sectional view illustrating the configuration.

FIGS. 22A and 22B show the configuration of the first detection member 72 and the second detection member 74 of the liquid-ejection testing device 62 that is mounted on the inkjet printer 1 according to this embodiment. FIG. 22A is a plan view showing the outline of the first detection member 72 and the second detection member 74. FIG. 22B is a vertical cross-sectional view showing the first detection member 72 and the second detection member 74.

As shown in FIG. 22A, the first detection member 72 and the second detection member 74 are arranged on a rectangular substrate 75. The substrate 75 is constituted by, for example, a printed wiring board. The first detection member 72 and the second detection member 74 span at an angle over an opening section 76 formed at the front end portion (lower end portion) of the substrate 75 such that the first detection member 72 and the second detection member 74 intersect with the movement direction of the carriage 41.

A plurality of first detection members 72 and second detection members 74 are arranged over the opening section 76. The first detection members 72 and the second detection members 74 are alternately arranged in parallel to each other with a spacing therebetween in the lengthwise direction of the substrate 75. Herein, the spacings between the first detection members 72 and the second detection members 74 are equal to each other. The diameter of the first detection embers 72 and the second detection members 74 is about 0.2 mm.

Both end portions of each of the first detection members 72 and the second detection members 74 are fixed on the edge portions of the opening section 76 of the substrate 75. Thus, the first detection members 72 and the second detection members 74 are arranged so as to be stretched over the opening section 76 of the substrate 75. As shown in FIG. 22B, an ink droplet Ip ejected from one of the nozzles #1 to #180 of the head 21 passes by the sides of a first detection member 72 and a second detection member 74 through the gap between the first detection member 72 and the second detection member 74 to drop downward from the substrate 75.

The reason why the first detection members 72 and the second detection members 74 are arranged at an angle with respect to the movement direction of the carriage 41 is to detect misalignment in the carrying direction of the ink droplet Ip ejected from the nozzles #1 to #180. When the ink droplet Ip is shifted in the carrying direction, "white streaks" in the movement direction of the carriage 41 may be generated in an image to be printed. Thus, the image quality of an image to be printed is affected more when the ink droplet Ip ejected from the nozzles #1 to #180 is shifted in the carrying direction than when it is shifted in the movement direction of the carriage 41. Therefore, it is necessary to test misalignment in the carrying direction of the ejected ink droplet Ip in detail.

Furthermore, in this embodiment, circuit elements 83, 85, 86, and 87 constituting, for example, the protective resistance R1, the capacitor C, the input resistance R2, the feedback resistance R3, and the operational amplifier Amp, which constitute the first detecting section 82 and the second detecting section 84, are integrally mounted on the substrate 75 provided with the first detection members 72 and the second detection members 74. Accordingly, the substrate 75 serves as one ejection testing unit 79 on which the first detection members 72, the second detection members 74, and the circuit elements 83, 85, 86, and 87 for performing the ejection test are mounted.

<Configuration of Detection Members>

Figure 23:
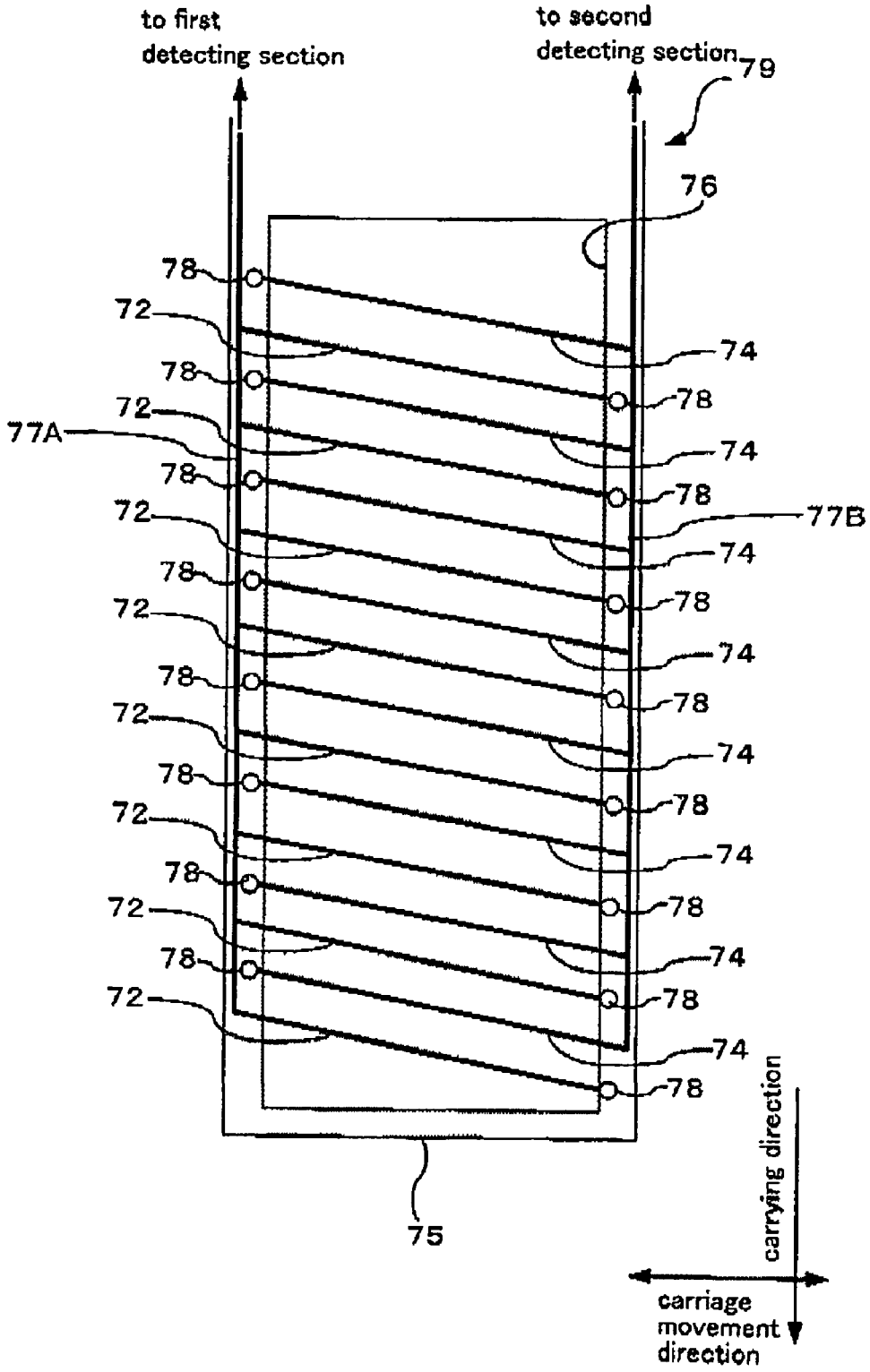
FIG. 23 is a diagram illustrating a circuit configuration of the first detection member and the second detection member.

FIG. 23 illustrates in detail the circuit configuration of the first detection members 72 and the second detection members 74 arranged on the substrate 75. As shown in FIG. 23, the first detection members 72 arranged on the substrate 75 are arranged at an angle with an equal spacing therebetween in the lengthwise direction of the substrate 75. End portions on one side (left end portions in this embodiment) of the first detection members 72 are connected to one first common line 77A disposed along the edge portion (left edge portion in this embodiment) of the opening section 76 of the substrate 75. The first common line 77A is connected to the first detecting section 82 that detects an induced current generated at the first detection members 72.

On the other hand, unlike the end portions on one side (left end portions in this embodiment), the other end portions (right end portions in this embodiment) of the first detection members 72 are not electrically connected to each other via the first common line 77A, for example, and each of them is electrically open. The other end portions (right end portions in this embodiment) of the first detection members 72 are fixed via respective fixing sections 78 on the edge portion of the opening section 76 of the substrate 75. Accordingly, the plurality of first detection members 72 and the first common line 77A are configured in the shape of a comb.

On the other hand, as the first detection members 72, the second detection members 74 are arranged at an angle with an equal spacing therebetween in the lengthwise direction of the substrate 75. Each of the second detection members 74 is disposed between the first detection members 72 so as to be in parallel to the first detection members 72. End portions on one side (right end portions in this embodiment) of the second detection members 74 are connected to one second common line 77B disposed along the edge portion (right edge portion in this embodiment) of the opening section 76 of the substrate 75. The second common line 77B is connected to the second detecting section 84 that detects an induced current generated at the second detection members 74.

Unlike the end portions on one side (right end portions in this embodiment), the other end portions (left end portions in this embodiment) of the second detection members 74 are not electrically connected to each other via the second common line 77B, for example, and each of them is electrically open. The other end portions (left end portions in this embodiment) of the second detection members 74 are fixed via respective fixing sections 78 on the edge portion of the opening section 76 of the substrate 75. Accordingly, the plurality of second detection members 74 and the second common line 77B are configured in the shape of a comb.

In this manner, one end portions (left end portions of the first detection members 72 and right end portions of the second detection members 74) of the first detection members 72 and the second detection members. 74 are connected to the first common line 77A or the second common line 77B, and the other end portions (right end portions of the first detection members 72 and left end portions of the second detection members 74) of the first detection members 72 and the second detection members 74 are not electrically connected to each other but are electrically open. Thus, it is possible to efficiently detect an induced current generated at the plurality of first detection members 72 or the plurality of second detection members 74. Accordingly, one detecting section, that is, either the first detecting section 82 or the second detecting section 84, will suffice for each of the set of first detection members 72 and the set of second detection members 74.

Furthermore, the first detection members 72 and the first common line 77A, and the second detection members 74 and the second common line 77B are each configured in the shape of a comb. Thus, it is possible to compactly perform the ejection test on the plurality of nozzles #1 to #180 at one time. Especially, since the plurality of first detection members 72 and the plurality of second detection members 74 are arranged side by side, it is possible to compactly perform the ejection test on a large number of nozzles #1 to #180 even when the length of the detection members 72 and 74 is short.

Furthermore, in this embodiment, the arrangement is such that the above-described two combs, that is, the comb constituted by the first detection members 72 and the first common line 77A and the comb constituted by the second detection members 74 and the second common line 77B are meshed with each other on the substrate 75.

Position at Which Ejection Testing Unit is Disposed

Figure 24:
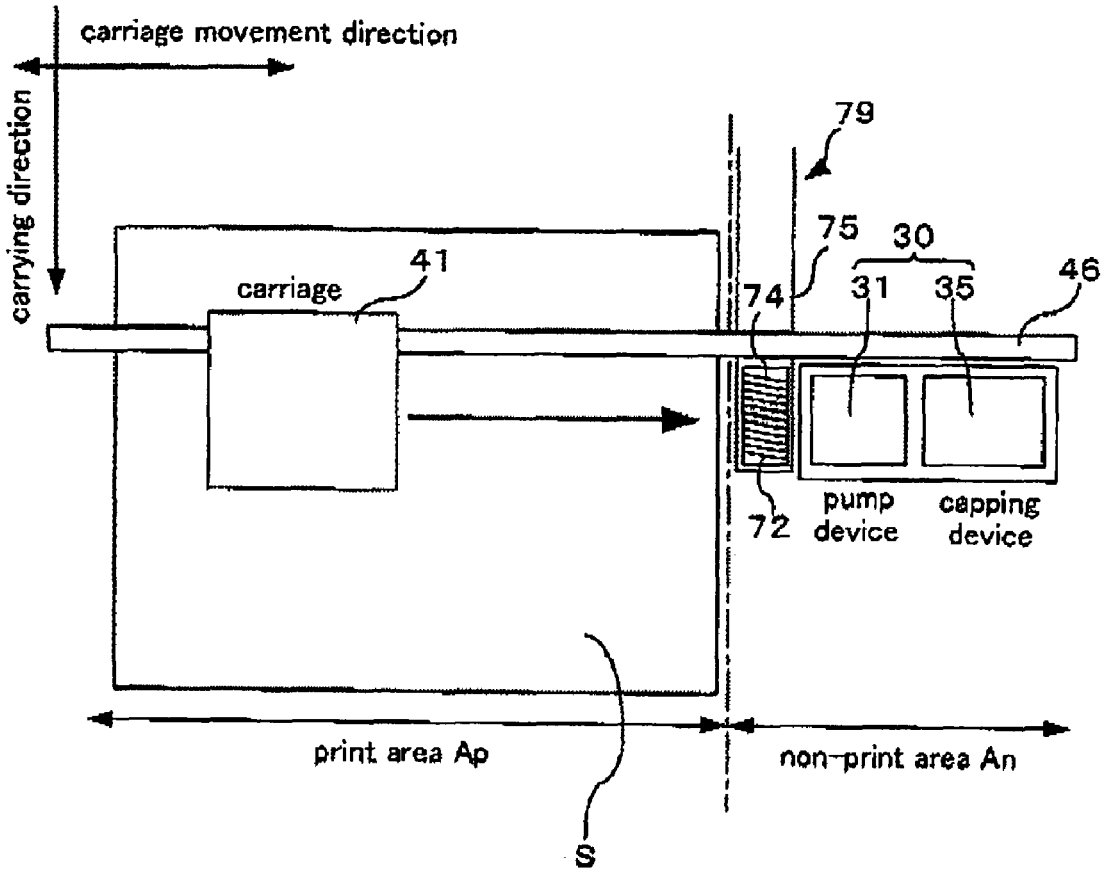
FIG. 24 is a diagram illustrating an example of the position at which an ejection testing unit according to the embodiment is disposed.

FIG. 24 illustrates in detail the position at which the ejection testing unit 79 according to this embodiment is disposed. As shown in FIG. 24, the ejection testing unit 79 according to this embodiment is disposed in an area An (hereinafter, referred to as "non-print area") that is out of a print area Ap onto which ink is ejected from the nozzles #1 to #180 to carry out printing. The non-print area An is provided with the pump device 31, serving as a cleaning device for the nozzles #1 to #180, for pumping ink from the nozzles #1 to #180 such that clogging in the nozzles is eliminated. Furthermore, the non-print area An is provided with the capping device 35 for capping the nozzles #1 to #180 of the head 21 when printing is not being carried out. The pump device 31 and the capping device 35 constitute a cleaning unit 30. In addition to the above, the cleaning unit 30 may be provided with various devices such as a wiping device for wiping away excessively-attached ink from the opening sections of the nozzles #1 to #180. The ejection testing unit 79 according to this embodiment is disposed adjacent to the pump device 31 and the capping device 35.

In this embodiment, the ejection testing unit 79 is disposed in the non-print area An but at a position that is close to the print area Ap, that is, between the print area Ap and the cleaning unit 30, as shown in FIG. 24. Accordingly, when the carriage 41 moves from the print area Ap to the non-print area An, it passes above the opening section 76 of the ejection testing unit 79, that is, the first detection members 72 and the second detection members 74 without fail. This makes it possible to perform the ejection test of ink during any non-printing time in which the carriage 41 moves to the non-print area An.

Positional Relationship Between Ejection Testing Unit and Nozzle Rows

Figure 25:
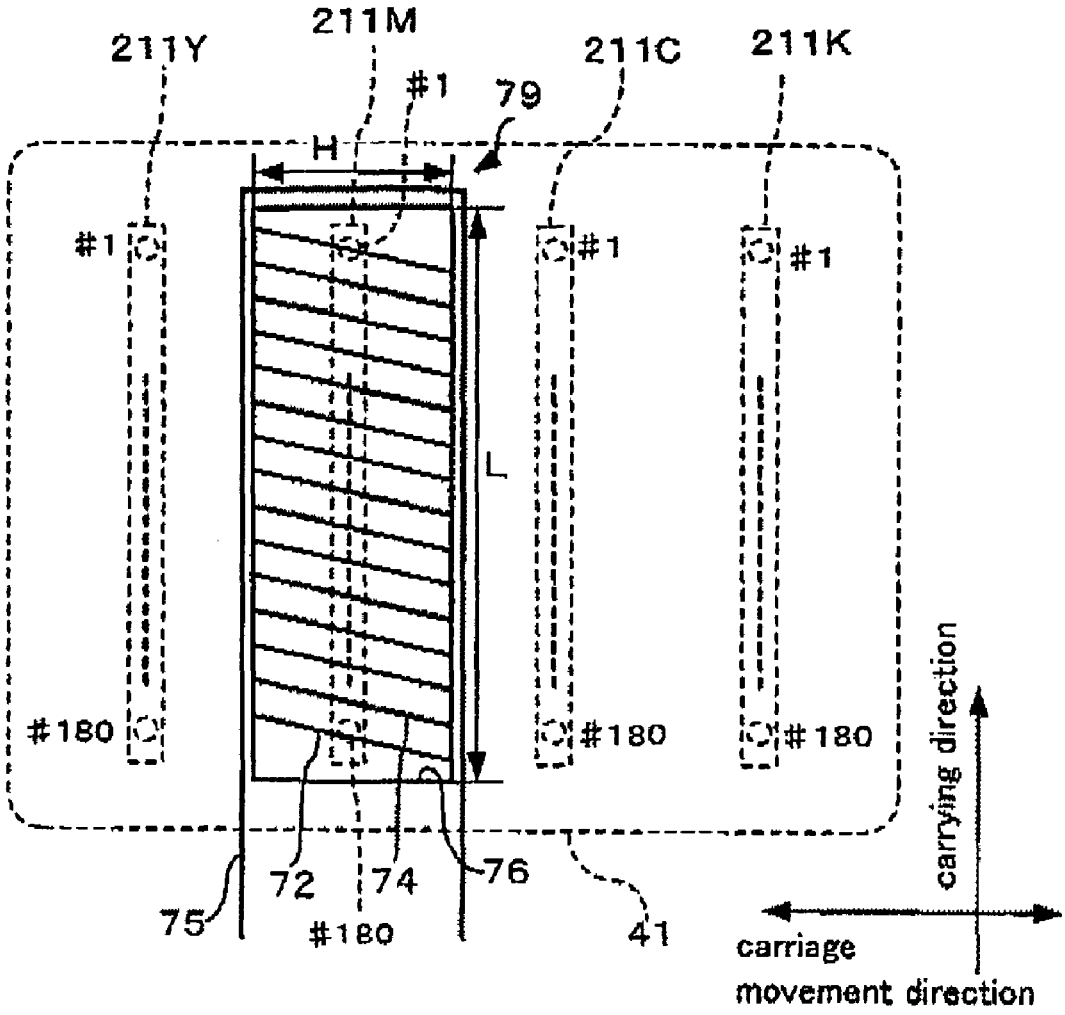
FIG. 25 is a diagram illustrating the positional relationship between the first detection member and the second detection member, and nozzle rows.

FIG. 25 illustrates the positional relationship between the ejection testing unit 79 and the nozzle rows 211C, 211M, 211Y, and 211K when the ejection test is performed. As shown in FIG. 25, the longitudinal length L of the opening section 76 disposed in the substrate 75 of the erection testing unit 79 is set in accordance with the lengthwise length, of the nozzle rows 211C, 211M, 211Y, and 211K such that the longitudinal length L is slightly longer than the lengthwise length. Furthermore, the lateral length H of the opening section 76 is set so as to correspond to a width of one row of the nozzle rows 211C, 211M, 211Y, and 211K. The first detection members 72 and the second detection members 74 arranged over the opening section 76 of the ejection testing unit 79 are arranged at an angle in the direction that intersects with the arrangement direction (parallel to the carrying direction in this embodiment) of the nozzles #1 to #180 of the nozzle rows 211C, 211M, 211Y, and 211K, in correspondence with the nozzles #1 to #180 of the nozzle rows 211C, 211M, 211Y, and 211K.

As shown in FIG. 25, when the ejection test is performed, the positional alignment is carried out such that one nozzle row (nozzle row 211M in this embodiment) among the plurality of nozzle rows 211C, 211M, 211Y, and 211K arranged in the head 21 is positioned directly above the opening section 76 of the ejection testing unit 79, that is, directly above the first detection members 72 and the second detection members 74. After the positional alignment is completed, ink is ejected from the nozzles #1 to #180 of the nozzle row 211M toward the respective gaps between the first detection members 72 and the second detection members 74 to perform the ejection test.

After the ejection test on the one nozzle row 211M is completed, the carriage 41 moves such that the ejection test is performed on other nozzle rows 211C, 211Y, and 211K on which the ejection test has not been performed. Then, the opening section 76 of the ejection testing unit 79, that is, the first detection members 72 and the second detection members 74 is/are positionally aligned with the next nozzle row (such as the nozzle row 211Y in this embodiment) on which the eject on test is to be performed, so that the ejection test is performed on the nozzle row 211Y. In this manner, the ejection test is performed one by one on the plurality of nozzle rows 211C, 211M, 211Y, and 211K arranged at the head 21.

Positional Relationship Between Detection Members and Nozzles <No. 1>

Figure 26:
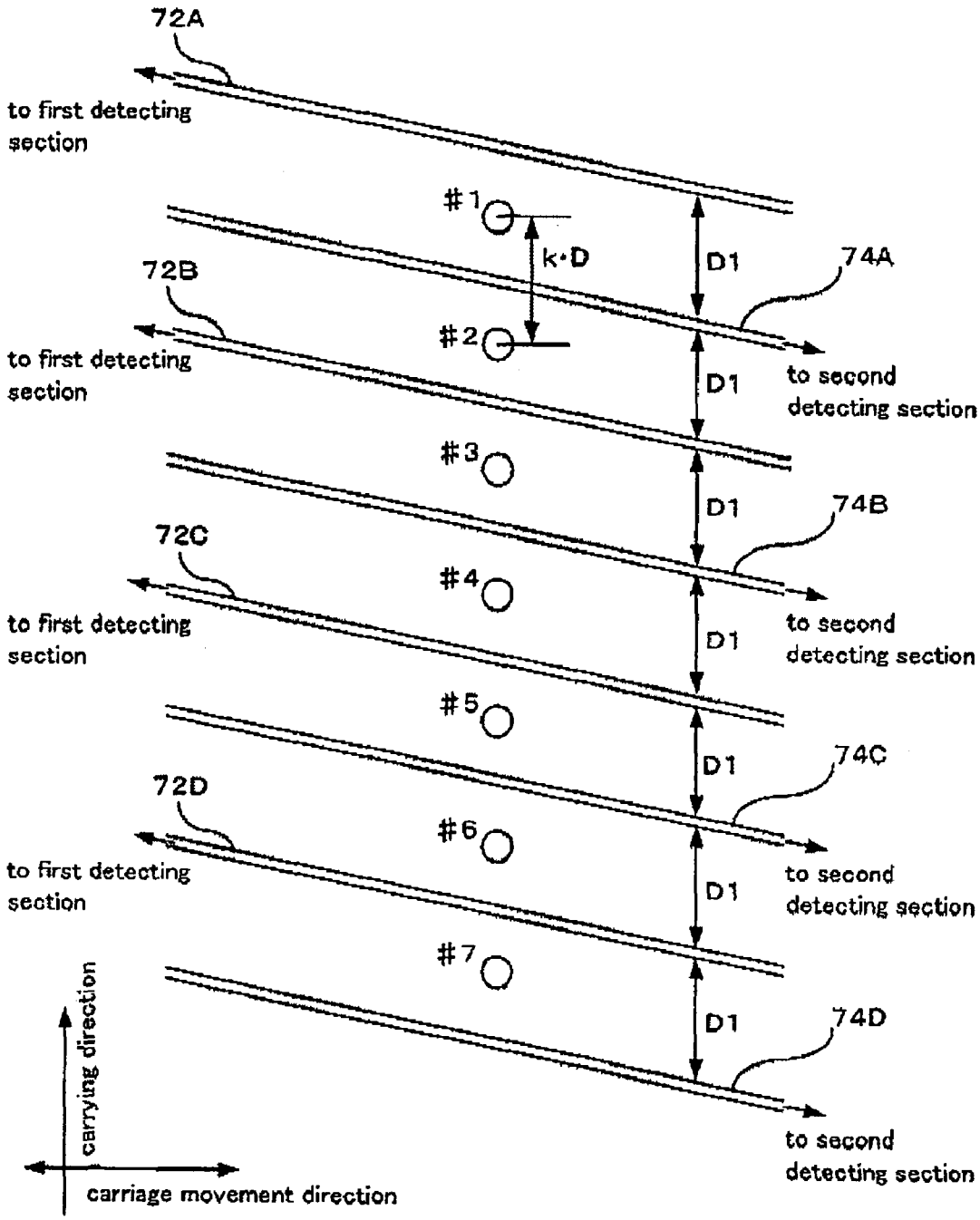
FIG. 26 is a diagram illustrating an example of the positional relationship between the detection members and the nozzles.

FIG. 26 illustrates an example of the positional relationship between the first detection members 72 and the second detection members 74, and the nozzles #1 to #180 in the ejection test. The following is a description concerning an example in which the ejection test is performed on seven nozzles #1 to #7 with four first detection members 72A, 72B, 72C, and 72D and four second detection members 74A, 74B, 74C, and 74D.

Herein, the first detection members 72A, 72B, 72C, and 72D and the second detection members 74A, 74B, 74C, and 74D are alternately arranged in parallel to each other with an equal spacing therebetween. One of the first detection members 72A, 72B, 72C, and 72D and one of the second detection members 74A, 74B, 74C, and 74D are arranged so as to correspond to each of the nozzles #1 to #7. More specifically, the first detection member 72A and the second detection member 74A correspond to the nozzle #1. Furthermore, the first detection member 72B and the second detection member 74A correspond to the nozzle #2. Furthermore, the first detection member 72B and the second detection member 74B correspond to the nozzle #3. Furthermore, the first detection member 72C and the second detection member 74B correspond to the nozzle #4. Furthermore, the first detection member 72C and the second detection member 74C correspond to the nozzle #5. Furthermore, the first detection member 72D and the second detection member 74C correspond to the nozzle #6. Furthermore, the first detection member 72D and the second detection member 74D correspond to the nozzle #7.

The spacings D1 in the carrying direction between the first detection members 72A, 72B, 72C, and 72D and the second detection members 74A, 74B, 74C, and 74D are all equal to each other. Herein, each spacing D1 is set to be equal to the nozzle spacing k·D. Furthermore, each of the nozzles #1 to #7 is disposed in the middle between the first detection members 72A, 72B, 72C, and 72D and the second detection members 74A, 74B, 74C, and 74D. More specifically, the nozzle #1 is disposed in the middle between the first detection member 72A and the second detection member 74A. Furthermore, the nozzle #2 is disposed in the middle between the first detection member 72B and the second detection member 74A. Furthermore, the nozzle #3 is disposed in the middle between the first detection member 72B and the second detection member 74B. Furthermore, the nozzle #4 is disposed in the middle between the first detection member 72C and the second detection member 74B, Furthermore, the nozzle #5 is disposed in the middle between the first detection member 72C and the second detection member 74C. Furthermore, the nozzle #6 is disposed in the middle between the first detection member 72D and the second detection member 74C. Furthermore, the nozzle #7 is disposed in the middle between the first detection member 72D and the second detection member 74D.

Accordingly, the spacings between the nozzles #1 to #7, and the first detection members 72A, 72B, 72C, and 72D and the second detection members 74A, 74B, 74C, and 74D corresponding to the nozzles #1 to #7 are all equal to each other. More specifically, the spacings between the nozzle #1, and the first detection member 72A and the second detection member 74A are equal to each other. Furthermore, the spacings between the nozzle #2, and the first detection member 72B and the second detection member 74A are equal to each other. Furthermore, the spacings between the nozzle #3, and the first detection member 72B and the second detection member 74B are equal to each other. Furthermore, the spacings between the nozzle #4, and the first detection member 72C and the second detection member 74B are equal to each other. Furthermore, the spacings between the nozzle #5, and the first detection member 72C and the second detection member 74C are equal to each other. Furthermore, the spacings between the nozzle #6, and the first detection member 72D and the second detection member 74C are equal to each other. Furthermore, the spacings between the nozzle #7, and the first detection member 72D and the second detection member 74D are equal to each other.

When the ink droplet Ip is ejected from the nozzle #1, an induced current is generated mainly at each of the first detection member 72A and the second detection member 74A. Furthermore, when the ink droplet Ip is ejected from the nozzle #2, an induced current is generated mainly at each of the first detection member 72B and the second detection member 74A. Furthermore, when the ink droplet Ip is ejected from the nozzle #3, an induced current is generated mainly at each of the first detection member 72B and the second detection member 74B. Furthermore, when the ink droplet Ip is ejected from the nozzle #4, an induced current is generated mainly at each of the first detection member 72C and the second detection member 74B. Furthermore, when the ink droplet Ip is ejected from the nozzle #5, an induced current is generated mainly at each of the first detection member 72C and the second detection member 74C. Furthermore, when the ink droplet Ip is ejected from the nozzle #6, an induced current is generated mainly at each of the first detection member 72D and the second detection member 74C. Furthermore, when the ink droplet Ip is ejected from the nozzle #7, an induced current is generated mainly at each of the first detection member 72D and the second detection member 74D.

The induced current that has been generated at the first detection members 72A, 72B, 72C, and 72D is input via the first common line 77A to the first detecting section 82 and is detected by the first detecting section 82. Furthermore, the induced current that has been generated at the second detection members 74A, 74B, 74C, and 74D is input via the second common line 77B to the second detecting section 84 and is detected by the second detecting section 84.

<Ejection Test>

When the ejection test is performed, an induced current that has been generated at each of the first detection members 72A, 72B, 72C, and 72D and the second detection members 74A, 74B, 74C, and 74D by the ink droplet Ip that has been ejected from each of the nozzles #1 to #7 is detected by the first detecting section 82 and the second detecting section 84, and based on the detection result, it is judged whether or not the ink droplet Ip is properly ejected from each of the nozzles #1 to #7.

More specifically, as described with reference to FIGS. 14 and 15, the signal levels of the detection signals from the first detecting section 82 and the second detecting section 84 that have detected the induced currents generated at the first detection members 72A, 72B, 72C, and 72D and the second detection members 74A, 74B, 74C, and 74D are compared with the predetermined reference value V0, and it is checked whether or not the signal level of the detection signal from either one of the first detecting section 82 and the second detecting section 84 reaches the predetermined reference value V0, so that whether or not ejection is performed is tested.

Furthermore, as described with reference to FIGS. 16A to 21, the peak values V1max and V2max are acquired from the detection signals from the first detecting section 82 and the second detecting section 84 that have detected the induced currents generated at the first detection members 72A, 72B, 72C, and 72D and the second detection members 74A, 74B, 74C, and 74D, and the difference between the peak values V1max and V2max is obtained. It is checked whether or not the difference is within a predetermined tolerance range, so that whether or not the ejection direction is proper is tested. The judgment is performed by the controller 126.

Herein, the spacings between the nozzles #1 to #7, and the first detection members 72A, 72B, 72C, and 72D and the second detection members 74A, 74B, 74C, and 74D corresponding to the nozzles #1 to #7 are all equal to each other. Thus, the judgment of the ejection direction can be performed using the method described based on FIGS. 16A to 16C, 19A, and 20A.

Positional Relationship Between Detection Members and Nozzles <No. 2>

Figure 27:
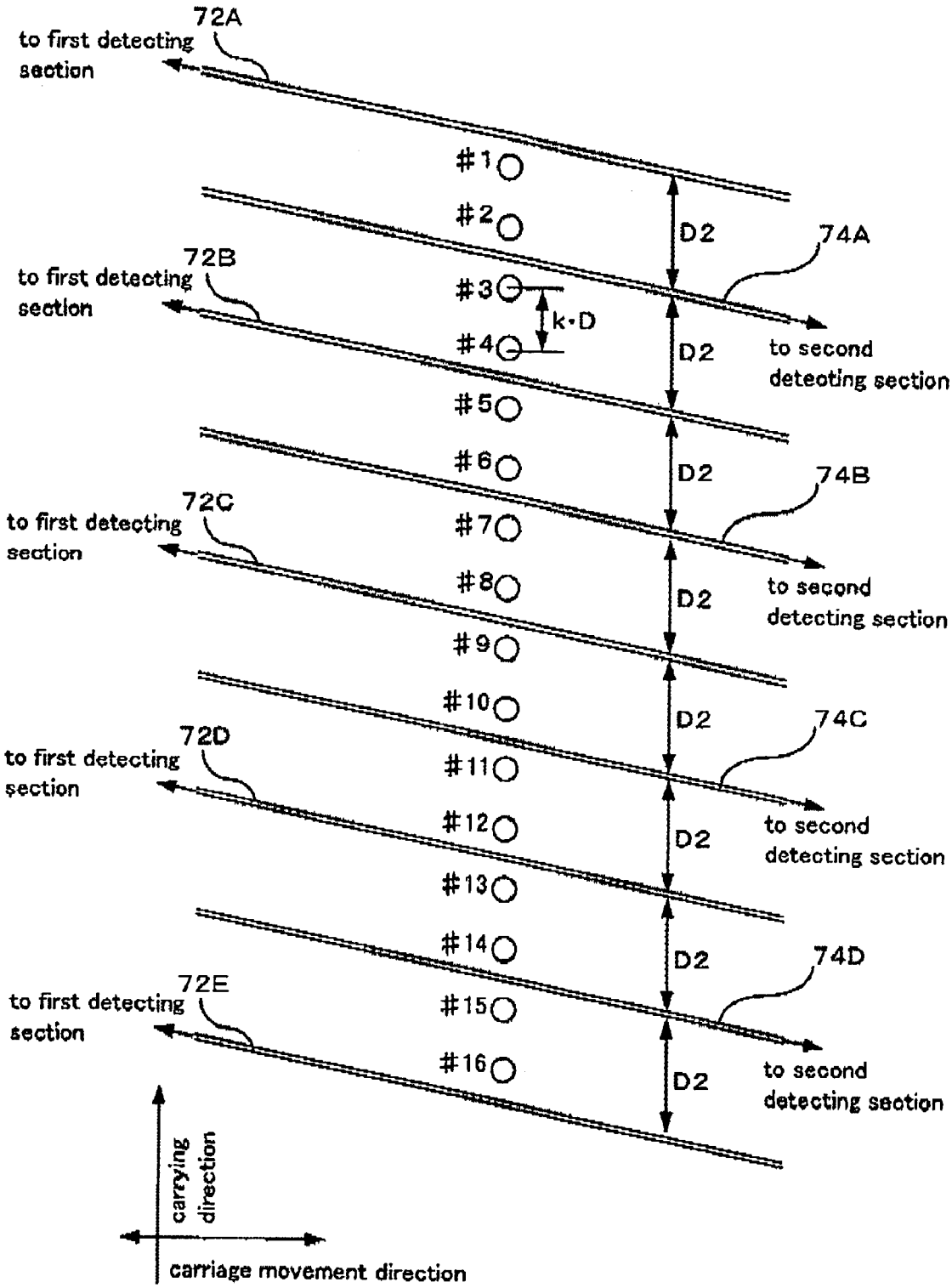
FIG. 27 is a diagram illustrating another example of the positional relationship between the detection members and the nozzles.

FIG. 27 illustrates another example of the positional relationship between the first detection members 72 and the second detection members 74, and the nozzles #1 to #180 in the ejection test. The following is a description concerning an example in which the ejection test is performed on 16 nozzles #1 to #16 with five first detection members 72A, 72B, 72C, 72D, and 72E and four second detection members 74A, 74B, 74C, and 74D.

Herein, the first detection members 72A, 72B, 72C, 72D, and 72E and the second detection members 74A, 74B, 74C, and 74D are alternately arranged in parallel to each other with an equal spacing therebetween. The spacings D2 in the carrying direction between the first detection members 72A, 72B, 72C, 72D, and 72E and the second detection members 74A, 74B, 74C, and 74D are all equal to each other. Herein, each spacing D2 is set to be equal to twice the nozzle spacing k·D.

Two of the nozzles #1 to #16 are positioned between each pair of the first detection members 72A, 72B, 72C, 72D, and 72E and the second detection members 74A, 74B, 74C, and 74D. More specifically, the nozzles #1 and #2 are arranged between the first detection member 72A and the second detection member 74A. Furthermore, the nozzles #3 and #4 are arranged between the first detection member 72B and the second detection member 74A. Furthermore, the nozzles #5 and #6 are arranged between the first detection member 72B and the second detection member 74B. Furthermore, the nozzles #7 and #8 are arranged between the first detection member 72C and the second detection member 74B. Furthermore, the nozzles #9 and #10 are arranged between the first detection member 72C and the second detection member 74C. Furthermore, the nozzles #11 and #12 are arranged between the first detection member 72D and the second detection member 74C. Furthermore, the nozzles #13 and #14 are arranged between the first detection member 72D and the second detection member 74D. Furthermore, the nozzles #15 and #16 are arranged between the first detection member 72E and the second detection member 74D.

When the ink droplet Ip is ejected from the nozzle #1 or the nozzle #2, an induced current is generated mainly at each of the first detection member 72A and the second detection member 74A. Furthermore, when the ink droplet Ip is ejected from the nozzle #3 or the nozzle #4, an induced current is generated mainly at each of the first detection member 72B and the second detection member 74A. Furthermore, when the ink droplet Ip is ejected from the nozzle #5 or the nozzle #6, an induced current is generated mainly at each of the first detection member 72B and the second detection member 74B. Furthermore, when the ink droplet Ip is ejected from the nozzle #7 or the nozzle #8, an induced current is generated mainly at each of the first detection member 72C and the second detection member 74B. Furthermore, when the ink droplet Ip is ejected from the nozzle #9 or the nozzle #10, an induced current is generated mainly at each of the first detection member 72C and the second detection member 74C. Furthermore, when the ink droplet Ip is ejected from the nozzle #11 or the nozzle #12, an induced current is generated mainly at each of the first detection member 72D and the second detection member 74C. Furthermore, when the ink droplet Ip is ejected from the nozzle #13 or the nozzle #14, an induced current is generated mainly at each of the first detection member 72D and the second detection member 74D. Furthermore, when the ink droplet Ip is ejected from the nozzle #15 or the nozzle #16, an induced current is generated mainly at each of the first detection member 72E and the second detection member 74D.

The induced current that has been generated at the first detection members 72A, 72B, 72C, 72D, and 72F and the second detection members 74A, 74B, 74C, and 74D is input via the first common line 77A or the second common line 77B to the first detecting section 82 or the second detecting section 84 and is detected by the first detecting section 82 or the second detecting section 84.

<Ejection Test>

As in the above-described case, when the ejection test is performed, an induced current that has been generated at each of the first detection members 72A, 72B, 72C, 72D, and 72E and the second detection members 74A, 74B, 74C, and 74D by the ink droplet Ip that has been ejected from each of the nozzles #1 to #16 is detected by the first detecting section 82 and the second detecting section 84, and based on the detection result, it is judged whether or not the ink droplet Ip is properly ejected from each of the nozzles #1 to #16.

When testing whether or not ejection is performed, as described based on FIGS. 14 and 15, the signal levels of the detection signals from the first detecting section 82 and the second detecting section 84 that have detected the induced currents generated at the first detection members 72A, 72B, 72C, 72D, and 72E and the second detection members 74A, 74B, 74C, and 74D are compared with the predetermined reference value V0, and it is checked whether or not the signal level of the detection signal from either one of the first detecting section 82 and the second detecting section 84 reaches the predetermined reference value V0, so that whether or not ejection is performed is judged.

When testing the ejection direction, as described based on FIGS. 16 to 21, the peak values V1max and V2max are acquired from the detection signals from the first detecting section 82 and the second detecting section 84 that have detected the induced currents generated at the first detection members 72A, 72B, 72C, 72D, and 72E and the second detection members 74A, 74B, 74C, and 74D, and the difference between the peak values V1max and V2max is obtained. It is checked whether or not the difference is within a predetermined tolerance range, so that whether or not the ejection direction is proper is tested.

Herein, the nozzles #1, #4, #5, #8, #9, #12, #13, and #16 arranged so as to be shifted toward the side of the first detection members 72A, 72B, 72C, 72D, and 72E, and the nozzles #2, #3, #6, #7, #10, #11, #14, and #15 arranged so as to be shifted toward the side of the second detection members 74A, 74B, 74C, and 74D are provided. Thus, the judgment of the ejection direction can be performed using the method described based on FIGS. 17A to 17C, 18A to 18C, 19B, 19C, 20B, and 20C. More specifically, the method described based on FIGS. 17A to 17C, 19B, and 20B can be used for the nozzles #1, #4, #5, #8, #9, #12, #13, and #16 arranged so as to be shifted toward the side of the first detection members 72A, 72B, 72C, 72D, and 72E. Furthermore, the method described based on FIGS. 18A to 18C, 19C, and 20C can be used for the nozzles #2, #3, #6, #7, #10, #11, #14, and #15 arranged so as to be shifted toward the side of the second detection members 74A, 74B, 74C, and 74D.

Positional Relationship Between Detection Members and Nozzles <No. 3>

Figure 28:
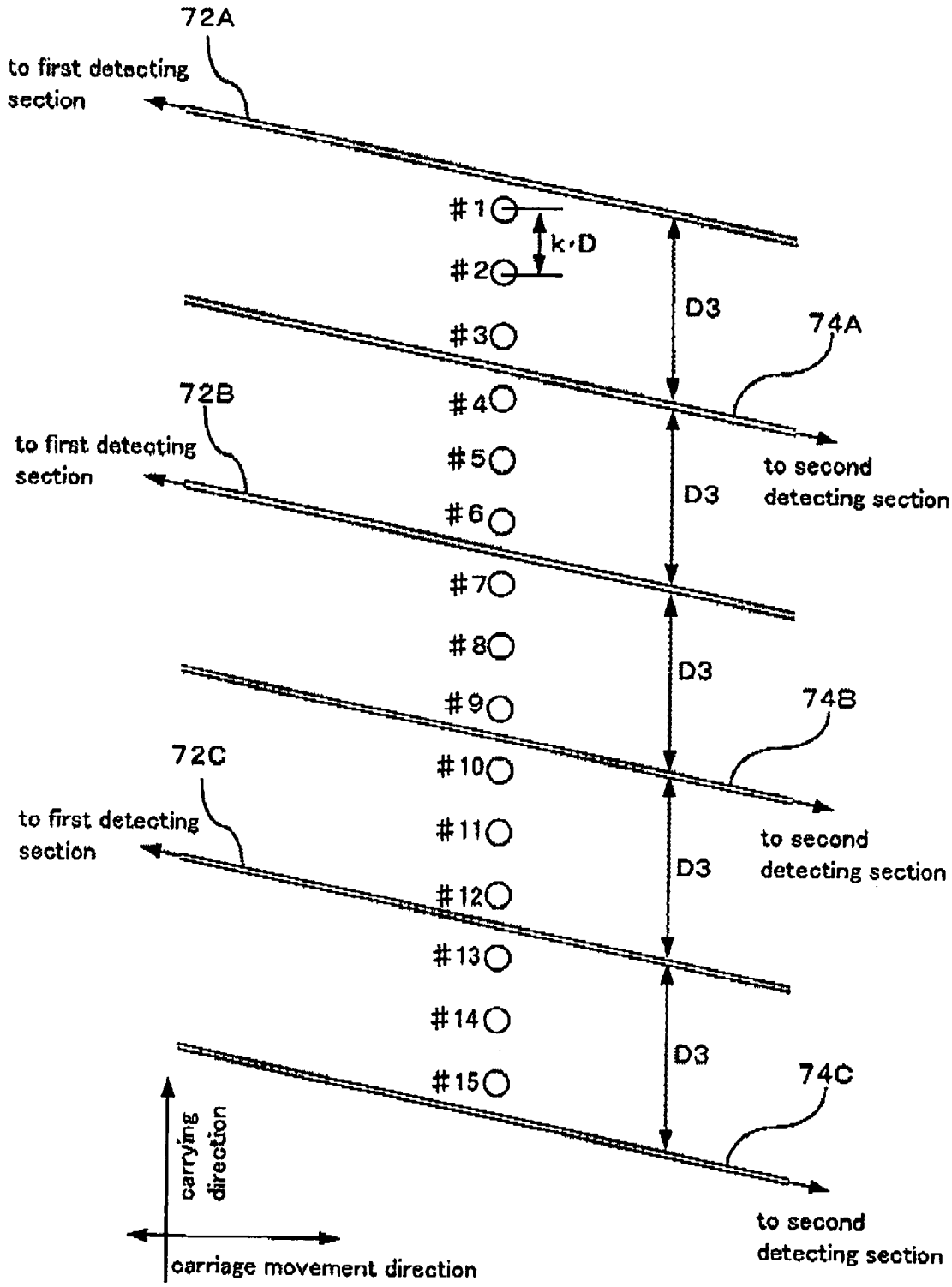
FIG. 28 is a diagram illustrating another example of the positional relationship between the detection members and the nozzles.

FIG. 28 illustrates another example of the positional relationship between the first detection members 72 and the second detection members 74, and the nozzles #1 to #180 in the ejection test. The following is a description concerning an example in which the ejection test is performed on 15 nozzles #1 to #15 with three first detection members 72A, 72B, and 72C and three second detection members 74A, 74B, and 74C.

Herein, the first detection members 72A, 72B, and 72C, and 72E and the second detection members 74A, 74B, and 74C are alternately arranged in parallel to each other with an equal spacing therebetween. The spacings D3 in the carrying direction between the first detection members 72A, 72B, and 72C and the second detection members 74A, 74B, and 74C are all equal to each other. Herein, each spacing D3 is set to be equal to three times the nozzle spacing k·D.

Three of the nozzles #1 to #16 are positioned between each pair of the first detection members 72A, 72B, and 72C and the second detection members 74A, 74B, and 74C. More specifically, the nozzles #1, #2, and #3 are arranged between the first detection member 72A and the second detection member 74A. Furthermore, the nozzles #4, #5, and #6 are arranged between the first detection member 72B and the second detection member 74A. Furthermore, the nozzles #7, #8, and #9 are arranged between the first detection member 72B and the second detection member 74B. Furthermore, the nozzles #10, #11, and #12 are arranged between the first detection member 72C and the second detection member 74B. Furthermore, the nozzles #13, #14, and #15 are arranged between the first detection member 72C and the second detection member 74C.

When the ink droplet Ip is ejected from any one of the nozzles #1 to #3, an induced current is generated mainly at each of the first detection member 72A and the second detection member 74A. Furthermore, when the ink droplet Ip is ejected from any one of the nozzles #4 to #6, an induced current is generated mainly at each of the first detection member 72B and the second detection member 74A. Furthermore, when the ink droplet Ip is ejected from any one of the nozzles #7 to #9, an induced current is generated mainly at each of the first detection member 72B and the second detection member 74B. Furthermore, when the ink droplet Ip is ejected from any one of the nozzles #10 to #12, an induced current is generated mainly at each of the first detection member 72C and the second detection member 74B. Furthermore, when the ink droplet Ip is ejected from any one of the nozzles #13 to #15, an induced current is generated mainly at each of the first detection member 72C and the second detection member 74C.

The induced current that has been generated at the first detection members 72A, 72B, and 72C and the second detection members 74A, 74B, and 74C is input via the first common line 77A or the second common line 77B to the first detecting section 82 or the second detecting section 84 and is detected by the first detecting section 82 or the second detecting section 84.

<Ejection Test>

As in the above-described case, when the ejection test is performed, an induced current generated at each of the first detection members 72A, 72B, and 72C and the second detection members 74A, 74B, and 74C by the ink droplet Ip that has been ejected from each of the nozzles #1 to #15 is detected by the first detecting section 82 and the second detecting section 84, and based on the detection result, it is judged whether or not the ink droplet Ip is properly ejected from each of the nozzles #1 to #15.

When testing whether or not ejection is performed, as described based on FIGS. 14 and 15, the signal levels of the detection signals from the first detecting section 82 and the second detecting section 84 that have detected the induced currents generated at the first detection members 72A, 72B, and 72C and the second detection members 74A, 74B, and 74C are compared with the predetermined reference value V0, and it is checked whether or not the signal level of the detection signal from either one of the first detecting section 82 and the second detecting section 84 reaches the predetermined reference value V0, so that whether or not ejection is performed is judged.

When testing the ejection direction, as described based on FIGS. 16A to 21, the peak values V1max and V2max are acquired from the detection signals from the first detecting section 82 and the second detecting section 84 that have detected the induced currents generated at the first detection members 72A, 72B, and 72C and the second detection members 74A, 74B, and 74C, and the difference between the peak values V1max and V2max is obtained, It is checked whether or not the difference is within a predetermined tolerance range, so that whether or not the ejection direction is proper is tested.

Herein, when testing the ejection direction, the method described based on FIGS. 17A to 17C, 19B, and 20B can be used for the nozzles #1, #6, #7, #12, and #13 arranged so as to be shifted toward the side of the first detection members 72A, 72B, and 72C. Furthermore, when testing the ejection direction, the method described based on FIGS. 18A to 18C, 19C, and 20C can be used for the nozzles #3, #4, #9, #10, and #15 arranged so as to be shifted toward the side of the second detection members 74A, 74B, and 74C. Furthermore, when testing the ejection direction, the method described based on FIGS. 16A to 16C, 19A, and 20A can be used for the nozzles #2, #5, #8, #11, and #14 positioned in the middle between the first detection members 72A, 72B, and 72C and the second detection members 74A, 74B, and 74C.

Positional Relationship Between Detection Members and Nozzles <No. 4>

Figure 29:
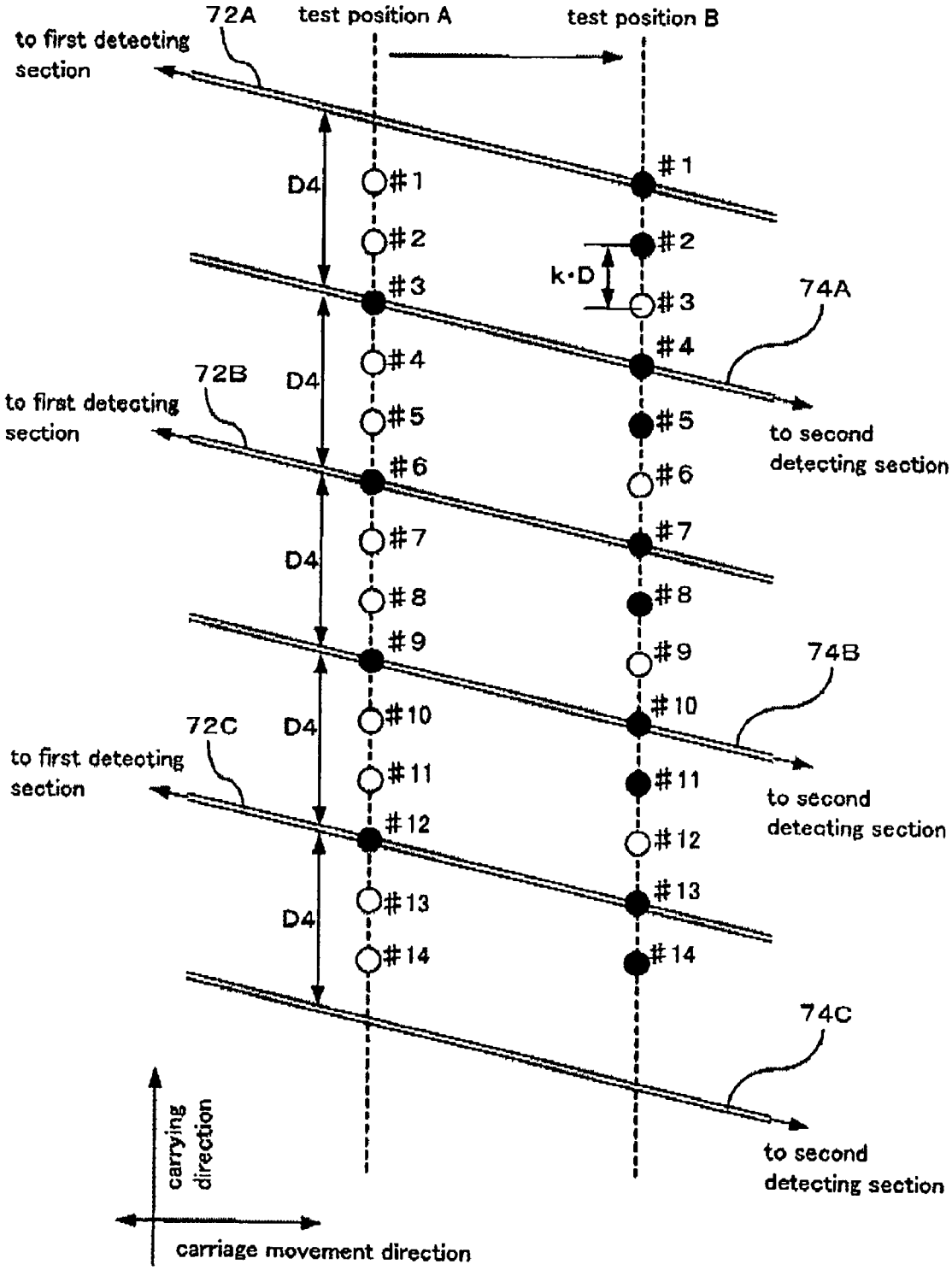
FIG. 29 is a diagram illustrating another example of the positional relationship between the detection members and the nozzles.

FIG. 29 illustrates another example of the positional relationship between the first detection members 72 and the second detection members 74, and the nozzles #1 to #180 in the ejection test. The following is a description concerning an example in which the ejection test is performed on 14 nozzles #1 to #14 with three first detection members 72A, 72B, and 72C and three second detection members 74A, 74B, and 74C.

Herein, the first detection members 72A, 72B, and 72C and the second detection members 74A, 74B, and 74C are alternately arranged in parallel to each other with an equal spacing therebetween. The spacings D4 in the carrying direction between the first detection members 72A, 72B, and 72C and the second detection members 74A, 74B, and 74C are all equal to each other. Herein, each spacing D4 is set to be equal to three times the nozzle spacing k·D.

Herein, two test positions A and B are provided such that the ejection test is performed on the nozzles #1 to #14. The test position A is set such that the ejection test is performed on the nozzles #1, #2, #4, #5, #7, #8, #10, #11, #13, and #14. On the other hand, the test position B is set such that the ejection test is performed on the nozzles #3, #6, #9, and #12. Here, the nozzles that are to be tested at the test position A or B are represented by white circles "○". Furthermore, the nozzles that are not to be tested at the test position A or B are represented by black circles "●".

The two test positions A and B are changed when the carriage 41 (nozzles #1 to #14) moves in the movement direction of the carriage 41. More specifically, when the nozzles #1 to #180 (nozzles #1 to #14 in this embodiment) arranged in the head 21 of the carriage 41 move relative to the first detection members 72A, 72B, and 72C and the second detection members 74A, 74B, and 74C (ejection testing unit 79), the test positions are changed. Herein, first, the ejection test is performed at the test position A. Next, after the carriage 41 has moved, the ejection test is performed at the test position B. In other words, the nozzles #1 to #14 move relatively from the test position A to the test position B in accordance with the movement of the carriage 41.

The reason why two test positions A and B are provided is that the positions of the first detection members 72B and 72C, and the second detection members 74A and 74B overlap with the positions of the nozzles #3, #6, #9, and #12 at the test position A. When the positions of the first detection members 72B and 72C, and the second detection members 74A and 74B overlap with the positions of the nozzles #3, #6, #9, and #12 in this manner, the ink droplet Ip ejected from the nozzles #3, #6, #9, and #12 may be brought into contact with the first detection members 72B or 72C, or the second detection members 74A or 74B in the ejection test. When the ink droplet Ip ejected from the nozzles #3, #6, #9, and #12 is brought into contact with the first detection members 72B or 72C, or the second detection members 74A or 74B, there is a possibility that a sufficient induced current is not generated at the first detection members 72B or 72C, or the second detection members 74A or 74B. When an induced current is not sufficiently generated in this manner, the ejection test may not be sufficiently performed on the nozzles #3, #6, #9, and #12. Thus, it is preferable that ink ejected from the nozzles #1 to #15 that are to be tested is not brought into contact with the first detection members 72A, 72B, and 72C and the second detection members 74A, 74B, and 74C to the extent possible. In this embodiment, the contact of ink ejected from the nozzles that are to be tested with the first detection members 72A, 72B or 72C or the second detection members 74A, 74B, or 74C is avoided, However, it goes without saying that it is not necessarily required to avoid the contact.

At the test position A, since the nozzles #3, #6, #9, and #12 overlap with the first detection members 72B and 72C, and the second detection members 74A and 74B, the nozzles are not to be tested. On the other hand, when the nozzles #1 to #15 move to the test position B in accordance with the movement of the carriage 41, the nozzles #3, #6, #9, and #12 that are not tested at the test position A do not overlap with the first detection members 72A, 72B, and 72C and the second detection members 74A, 74B, and 74C. Thus, at the test position B, it is possible to perform the ejection test on the nozzles #3, #6, #9, and #12 that are not tested at the test position A.

At the test position A, the ejection test on the nozzles #1 and #2 is performed with the first detection member 72A and the second detection member 74A. Furthermore, the ejection test on the nozzles #4 and #5 is performed with the first detection member 72B and the second detection member 74A. Furthermore, the ejection test on the nozzles #7 and #8 is performed with the first detection member 72B and the second detection member 74B. Furthermore, the ejection test on the nozzles #10 and #11 is performed with the first detection member 72C and the second detection member 74B. Furthermore, the ejection test on the nozzles #13 and 14 is performed with the first detection member 72C and the second detection member 74C.

On the other hand, at the test position B, the ejection test on the nozzle #3 is performed with the first detection member 72A and the second detection member 74A. Furthermore, the ejection test on the nozzle #6 is performed with the first detection member 72B and the second detection member 74A. Furthermore, the ejection test on the nozzle #9 is performed with the first detection member 72B and the second detection member 74B. Furthermore, the ejection test on the nozzle #12 is performed with the first detection member 72C and the second detection member 74B.

The induced current that has been generated at the first detection members 72A, 72B, and 72C and the second detection members 74A, 74B, and 74C is input via the first common line 77A or the second common line 77B to the first detecting section 82 or the second detecting section 84 and is detected by the first detecting section 82 or the second detecting section 84.

<Ejection Test>

As in the above-described case, when the ejection test is performed, an induced current generated at each of the first detection members 72A, 72B, and 72C and the second detection members 74A, 74B, and 74C by the ink droplet Ip that has been ejected from each of the nozzles #1 to #14 is detected by the first detecting section 82 and the second detecting section 84, and based on the detection result, it is judged whether or not the ink droplet Ip is properly ejected from each of the nozzles #1 to #14.

When testing whether or not ejection is performed, as described based on FIGS. 14 and 15, the signal levels of the detection signals from the first detecting section 82 and the second detecting section 84 that have detected the induced currents generated at the first detection members 72A, 72B, and 72C and the second detection members 74A, 745, and 74C are compared with the predetermined reference value V0, and it is checked whether or not the signal level of the detection signal from either one of the first detecting section 82 and the second detecting section 84 reaches the predetermined reference value V0, so that whether or not ejection is performed is judged.

When testing the ejection direction, as described based on FIGS. 16A to 21, the peak values V1max and V2max are acquired from the detection signals from the first detecting section 82 and the second detecting section 84 that have detected the induced currents generated at the first detection members 72A, 72B, and 72C and the second detection members 74A, 74B, and 74C, and the difference between the peak values V1max and V2max is obtained. It is checked whether or not the difference is within a predetermined tolerance range, so that whether or not the ejection direction is proper is tested.

Herein, at the test position A and the test position B, when testing the ejection direction, the method described based on FIGS. 17A to 17C, 19B, and 20B can be used for the nozzles #1, #5, #6, #7, #11, #12, and #13 arranged so as to be shifted toward the side of the first detection members 72A, 72B, and 72C. Furthermore, when testing the ejection direction, the method described based on FIGS. 18A to 18C, 19C, and 20C can be used for the nozzles #2, #3, #4, #8, #9, #10, and #14 arranged so as to be shifted toward the side of the second detection members 74A, 74B, and 74C.

Other Setting Examples of Reference Values

The reference values serving as the judgment reference in the ejection test may be set using other methods. FIGS. 30A and 30B illustrate examples of a case in which the reference values are set using another setting method. The following is a description concerning a case in which the reference values are set based on an actual measurement value obtained when the first detecting section 82 and the second detecting section 84 detect the magnitude of an induced current respectively generated at the first detection member 72 and the second detection member 74 with ink actually ejected from each of the nozzles #1 to #180.

FIG. 30A shows an example of actual measurement values obtained when the first detecting section 82 and the second detecting section 84 detect an induced current generated at the first detection member 72 and the second detection member 74 with ink actually ejected from each of the nozzles #1 to #180. Herein, the peak value V1max of the detection signal from the first detecting section 82 and the peak value V2max of the detection signal from the second detecting section 84 are acquired for each of the nozzles #1 to #180. Here, the peak values V1max for the nozzles #1 to #180, which are obtained from the detection signals from the first detecting section 82, are respectively taken as "V1max1" to "V1max180". Furthermore, the peak values V2max for the nozzles #1 to #180, which are obtained from the detection signals from the second detecting section 84, are respectively taken as "V2max1" to "V2max180".

In this embodiment, based on the peak value V1max ("V1max1" to "V1max180") and V2max ("V2max1" to "V2max180") for each of the nozzles #1 to #180, which are obtained from the detection signals from the first detecting section 82 and the second detecting section 84, a reference value serving as the judgment reference in the ejection test is acquired for each of the nozzles #1 to #180. More specifically, based on the peak value V1max ("V1max1" to "V1max180") and the peak value V2max ("V2max1" to "V2max180") corresponding to each of the nozzles #1 to #180, the reference value "V0" for judging whether or not ejection is performed from each of the nozzles #1 to #180 and the reference values for judging the ejection direction from each of the nozzles #1 to #180, that is, the lower limit value (such as "−Vamin", "+Vbmin", and "−Vcmin") and the upper limit value (such as "+Vamax", "+Vbmax", and "−Vcmax") which define a predetermined tolerance range are acquired.

Herein, examples of a method for acquiring the reference value "V0" for judging whether or not ejection is performed from each of the nozzles #1 to #180 include a method in which the smaller one of the peak values (V1max or V2max) is selected from among the acquired two peak values V1max ("V1max1" to "V1max180") and V2max ("V2max1" to "V2max180") corresponding to each of the nozzles #1 to #180, and a value at a predetermined ratio of the peak value (V1max or V2max) is set as the reference value "V0". More specifically, a value at a ratio of 5% or 10% of the peak value (V1max or V2max) is set as the reference value "V0", for example.

Furthermore, examples of a method for acquiring the lower limit value (such as "−Vamin", "+Vbmin", and "−Vcmin") and the upper limit value (such as "+Vamax", "+Vbmax", and "−Vcmax") of a predetermined tolerance range, for judging the ejection direction from each of the nozzles #1 to #180, include a method in which the difference between the peak values V1max ("V1max1" to "V1max180") and V2max ("V2max1" to "V2max180") corresponding to each of the nozzles #1 to #180 is obtained, a predetermined range is set based on the difference, and the upper limit value and the lower limit value of the predetermined range are acquired. More specifically, it is possible to adopt a method by which a value obtained by adding a predetermined value to the difference is taken as the upper limit value, and a value obtained by subtracting a predetermined value from the difference is taken as the lower limit value.

FIG. 30B illustrates the outline of the reference values acquired based on the peak values V1max ("V1max1" to "V1max180") and V2max ("V2max1" to "V2max180") corresponding to each of the nozzles #1 to #180. The reference value "V0" serving as the reference when judging whether or not ejection is performed is set as α1 to α180 respectively for the nozzles #1 to #180, Furthermore, the lower limit value (such as "−Vamin", "+Vbmin", and "−Vcmin") of the predetermined tolerance range is set as β1 to β180. Furthermore, the upper limit value (such as "+Vamax", "+Vbmax", and "−Vcmax") of the predetermined tolerance range, serving as the reference when judging the ejection direction, is set as γ1 to γ180.

When the reference values are set separately for each of the nozzles #1 to #180 in this manner, it is possible to separately perform the ejection test suited for each of the nozzles #1 to #180, in accordance with the difference in the characteristics between the nozzles #1 to #180, such as the difference in the characteristics caused by design errors caused by the characteristics of the piezo elements or the shape of the nozzles, for example. Accordingly, the precision in the test can be further improved.

As the timing at which an actual measurement value is acquired by actually ejecting ink from each of the nozzles #1 to #180, timings in the manufacturing process in the plants or during the maintenance are conceivable.

The respective reference values α1 to α180, β1 to β180, and γ1 to γ180 for the nozzles #1 to #180 are preferably stored as data in an appropriate storing section, for example, a memory such as the main memory 127.

Furthermore, the respective reference values α1 to α180, β1 to β180, and γ1 to γ180 for the nozzles #1 to #180 may be set separately for each of the nozzle rows 211C, 211M, 211Y, and 211K.

Testing Procedure

<Outline of Testing Procedure>

Figure 31A:
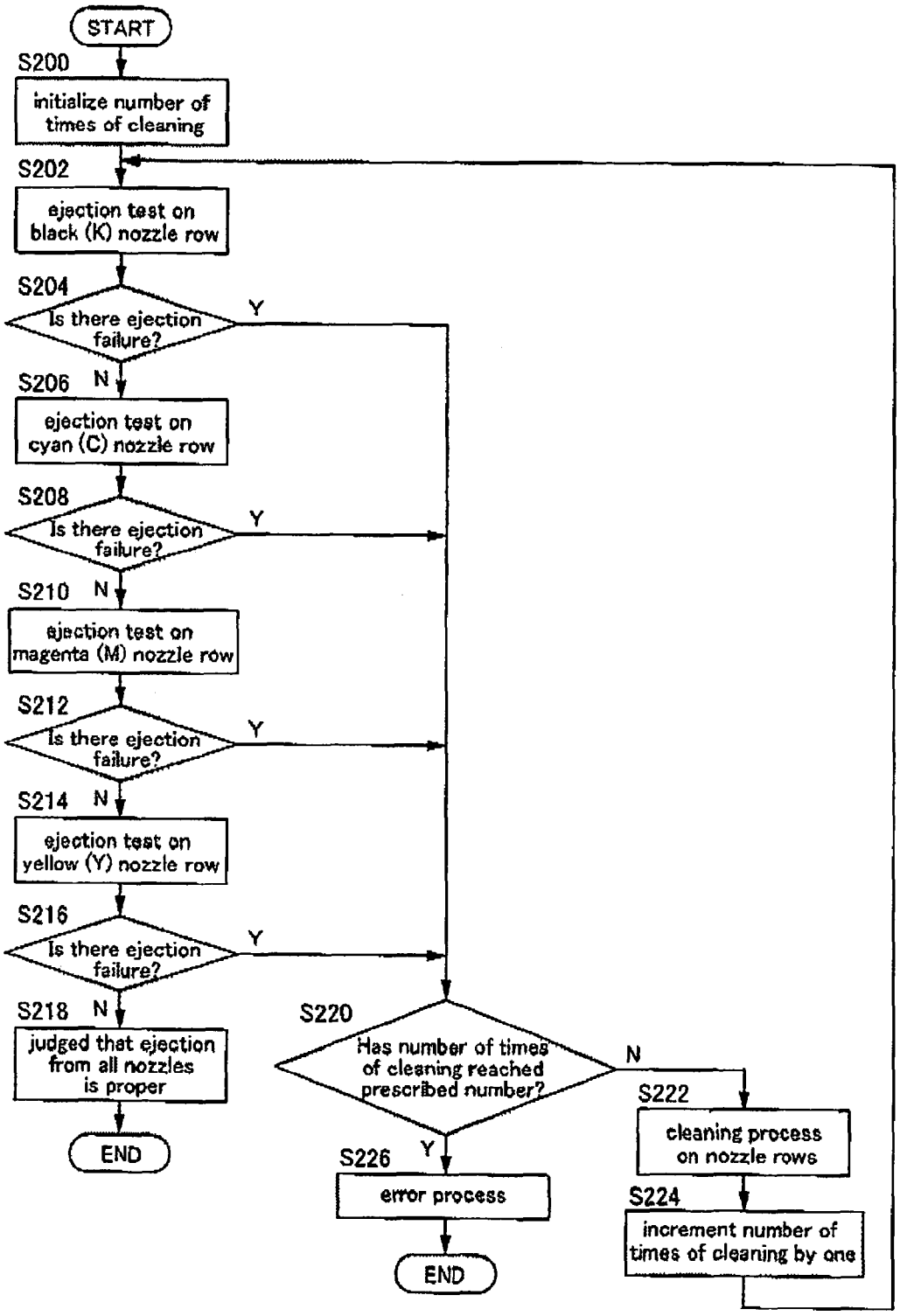
FIG. 31A is a flowchart illustrating an ejection testing procedure for each nozzle row.

Next, the testing procedure is described. FIG. 31A is a flowchart illustrating an example of the testing procedure in the inkjet printer 1 according to this embodiment. In this embodiment, since the ejection testing unit 79 corresponds to only one row of the nozzle rows, the ejection test is performed separately for each of the nozzle rows 211K, 211C, 211M, and 211Y while moving the carriage 41 (head 21) with the nozzle rows 211K, 211C, 211M, and 211Y. Herein, the ejection test is performed in the order: black (K) nozzle row 211K, to cyan (C) nozzle row 211C, to magenta (M) nozzle row 211M, and to yellow (Y) nozzle row 211Y.

First, the number of times of cleaning is initialized (S200). In this step, a counter for counting the number of times of cleaning process is set to 0. Then, the ejection test is performed on the black (K) nozzle row 211K (S202). Here, the ejection test refers to a rest of whether or not ink is ejected from the nozzles and a test of the ejection direction of ink, for example. More detailed description of the ejection test for each of the nozzle rows 211K, 211C, 211M, and 211Y, which is performed here, is given later. After the ejection test ends, it is checked whether or not there is a nozzle among the nozzles #1 to #180 of the black (K) nozzle row 211K from which ink is not properly ejected (S204). Here, if there is an ejection failure at even one nozzle among the nozzles #1 to #180 of the black (K) nozzle row 211K, then it is checked whether or not the number of times of cleaning has reached a prescribed number by checking the number of times of cleaning up to this point (S220). Here, the prescribed number is a number at which it is not conceivable that ejection will be restored even if a cleaning process is repeated this number or more. For example, when this number of times is taken as three, if the number of times of cleaning is smaller than three, then the cleaning process is performed on the nozzle row (S222). Herein, the cleaning process is performed with the pump device 31, for example, and may be performed only on the black (K) nozzle row 211K or may be performed at the same time on other nozzle rows. After the cleaning process ends, the number of times of cleaning is incremented by one (S224), and then the ejection test on the nozzle row is again performed.

If the number of times of cleaning has reached the prescribed number in step S220, then an error process is performed (S226), and then the procedure ends. Herein, the error process is a process in which a user is notified that there is a nozzle with an ejection failure that is not eliminated even with cleaning, so as to recommend the user taking more effective measure for restoring ejection. In this error process, changing the head 21 having a nozzle with such an ejection failure may be recommended. Furthermore, in this error process, information on a nozzle with an ejection failure may be stored such that printing is continued using another nozzle instead of the nozzle with an ejection failure.

On the other hand, if there is no nozzle with an ejection failure among the nozzles #1 to #180 of the black (K) nozzle row 211K, then the procedure proceeds to step S206, where the ejection test is performed on the cyan (C) nozzle row 211C (S206). After the ejection test ends, it is checked whether or not there is an ejection failure at the nozzles #1 to #180 of the cyan (C) nozzle row 211C (S208). Herein, if there is an ejection failure at even one nozzle among the nozzles #1 to #180 of the cyan (C) nozzle row 211C, then the procedure proceeds to step S220 in which the number of times of cleaning is checked.

On the other hand, if there is no nozzle with an ejection failure among the nozzles #1 to #180 of the cyan (C) nozzle row 211C, then the procedure proceeds to step S210, where the ejection test is performed on the magenta (M) nozzle row 211M (S210). After the ejection test ends, it is checked whether or not there is a nozzle with an ejection failure among the nozzles #1 to #180 of the magenta (M) nozzle row 211M (S212). Herein, if there is an ejection failure at even one nozzle among the nozzles #1 to #180 of the magenta (M) nozzle row 211M, then the procedure proceeds to step S220 in which the number of times of cleaning is checked.

On the other hand, if there is no nozzle with an ejection failure in the magenta (M) nozzle row 211M, then the procedure proceeds to step S214, where the ejection test is performed on the yellow (Y) nozzle row 211Y (S214). After the ejection test ends, it is checked whether or not there is a nozzle with an ejection failure among the nozzles #1 to #180 of the yellow (Y) nozzle row 211Y (S216). Herein, if there is an ejection failure at even one nozzle among the nozzles #1 to #180 of the yellow (Y) nozzle row 211Y, then the procedure proceeds to step S220 in which the number of times of cleaning is checked.

On the other hand, if there is no nozzle with an ejection failure among the nozzles #1 to #180 of the yellow (Y) nozzle row 211Y, it is judged that there is no nozzle with an ejection failure among the nozzles #1 to #180 of the nozzle rows 211K, 211C, 211M, and 211Y of all colors, that is, all nozzles are proper (S218), and then the procedure ends.

<Other Testing Procedures>

Figure 31B:
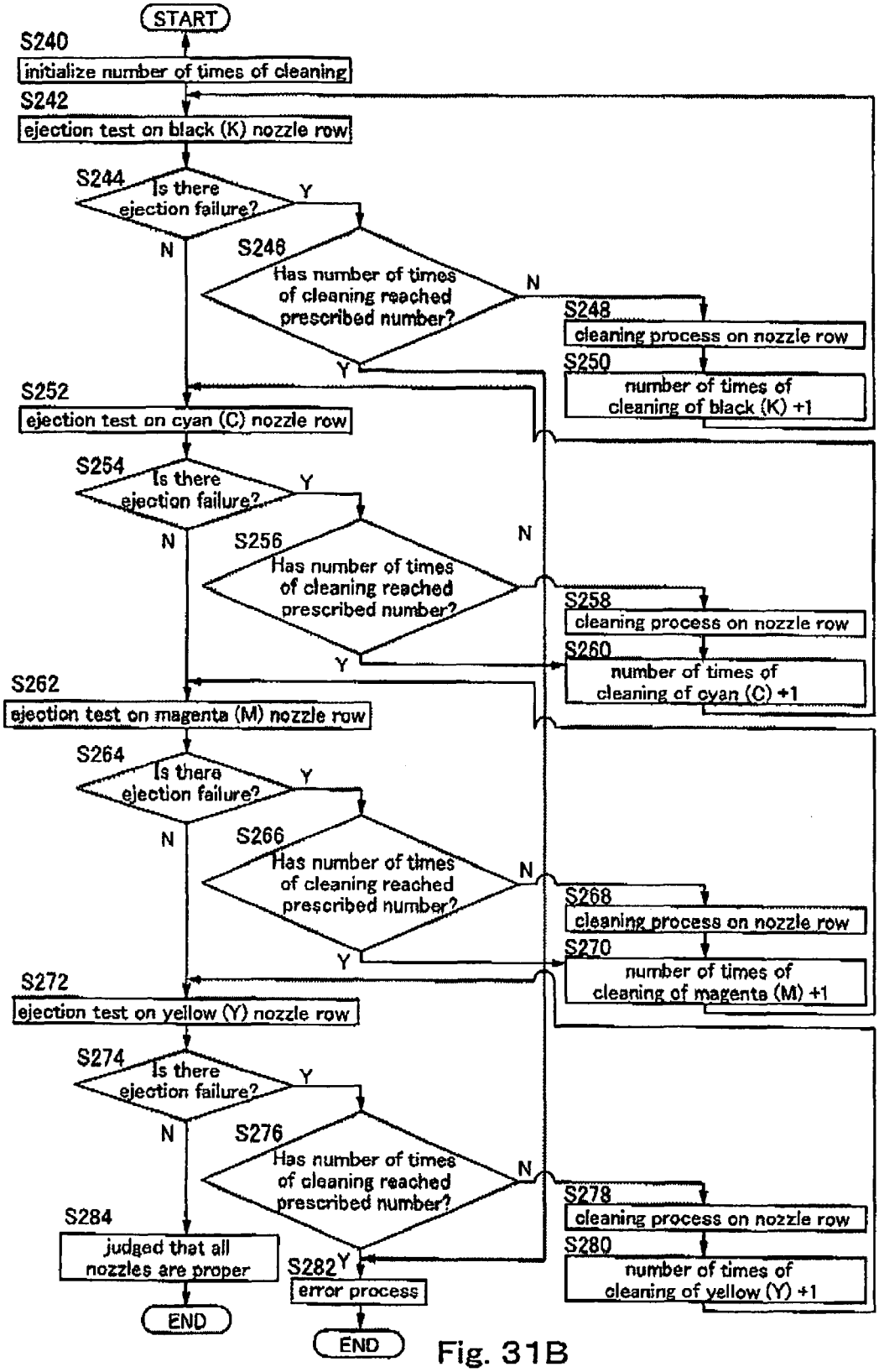
FIG. 31B is a flowchart illustrating an ejection testing procedure for each nozzle row.

FIG. 31B is a flowchart illustrating a case in which the cleaning process is performed on each nozzle row. First, the number of times of cleaning is initialized (S240). In this step, all counters for counting, with respect to each nozzle row, the number of times the cleaning process is performed during a single ejection test, that is, the number of times a nozzle from which ejection is not proper is found, are get to 0. Then, the ejection test is performed on the black (K) nozzle row 211K (S242). After the ejection test ends, it is checked whether or not there is a nozzle among the nozzles #1 to #180 of the black (K) nozzle row 211K from which ink is not properly ejected (S244). Here, if there is even one nozzle among the nozzles #1 to #180 of the black (K) nozzle row 211K from which ejection is not proper, then it is checked whether or not the number of times of clearing of the black (K) nozzle row 211K has reached a prescribed number (S246). If the number of times of cleaning is smaller than the prescribed number, then the cleaning process is performed on the black (K) nozzle row 211K (S248). After the cleaning process ends, the number of times of cleaning of the black (K) nozzle row 211K is incremented by one (S250), and then the ejection test on the nozzle row is again performed or the black (K) nozzle row 211K.

If the number of times of cleaning has reached the prescribed number in step S246, then the error process is performed (S282), and then the procedure ends.

On the other hand, if ejection from all of the nozzles #1 to #180 of the black (K) nozzle row 211K is proper, then the procedure proceeds to step S252, where the ejection test is performed on the cyan (C) nozzle row 211C (S252). After the ejection test, it is checked whether or not there is a nozzle among the nozzles #1 to #180 of the cyan (C) nozzle row 211C from which ink is not properly ejected (S254). Herein, if there is even one nozzle among the nozzles #1 to #180 of the cyan (C) nozzle row 211C from which ink is not properly ejected, then it is checked whether or not the number of times of cleaning of the cyan (C) nozzle row 211C has reached a prescribed number (S256). If the number of times of cleaning is smaller than the prescribed number, then the cleaning process is performed on the cyan (C) nozzle row 211C (S258). After the cleaning process ends, the number of times of cleaning of the cyan (C) nozzle row 211C is incremented by one (S260), and then the ejection test on the nozzle row is again performed on the cyan (C) nozzle row 211C.

If the number of times of cleaning has reached the prescribed number in step S256, then the error process is performed (S282), and then the procedure ends.

Subsequently, the ejection test is performed in a similar manner also on the magenta (M) and yellow (Y). If there is even one nozzle among the nozzles #1 to #180 from which ejection is not proper, then it is checked whether or not the number of times of cleaning of the nozzle row has reached a prescribed number. If the number of times of cleaning is smaller than the prescribed number, then the cleaning process is performed. Then, the number of times of cleaning of the nozzle row is incremented by one, and the ejection test is again performed. If the number of times of cleaning has reached the prescribed number, then the error process is performed (S282), and then the procedure ends.

When ejection from all of the nozzles #1 to #180 of the yellow (Y) nozzle row 211Y is proper in step S274, there is no nozzle among the nozzles #1 to #180 of the nozzle rows 211K, 211C, 211M, and 211Y of all colors from which ejection is not proper, and thus it is judged that "all ejection is proper" (S284) and the process ends.

<Ink Ejection>

Figure 32A:
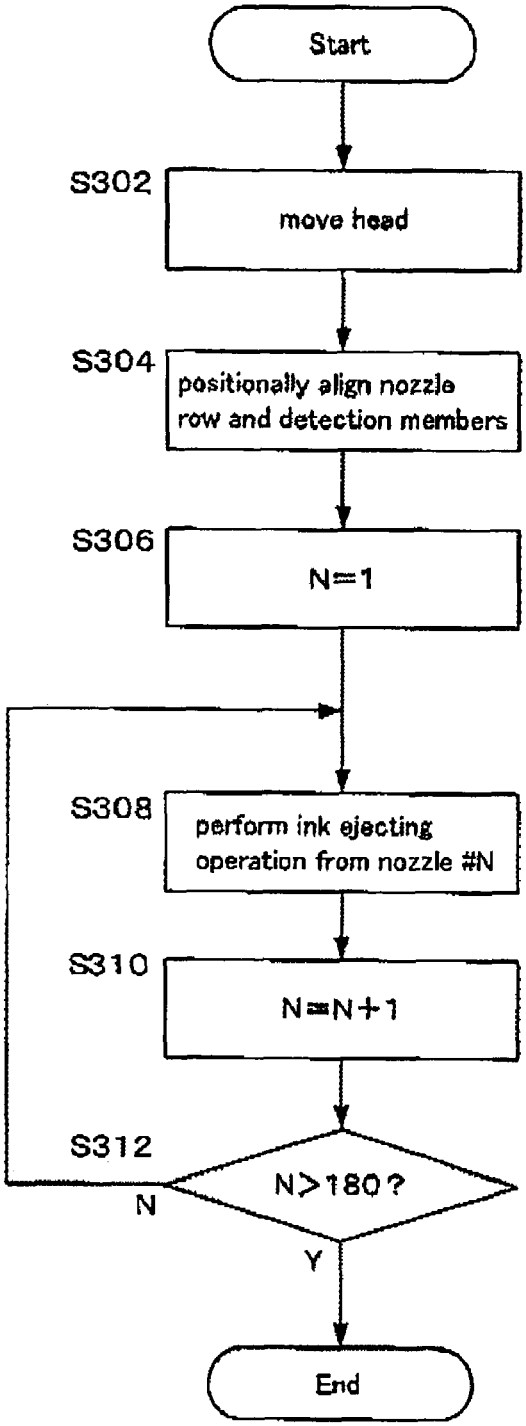
FIG. 32A is a flowchart illustrating an example of an ink ejecting procedure from each nozzle row when testing.

FIG. 32A is a flowchart illustrating the procedure of the ejection test on each of the nozzle rows 211K, 211C, 211M, and 211Y. First, the head 21 is led to move toward the ejection testing unit 79 (S302). Then, any one nozzle row of the nozzle rows 211C, 211M, 211Y, and 211K that are to be tested and the ejection testing unit 79 are positionally aligned (S304). Next, a variable N is set to an initial value of 1 (S306), and the ejection test is performed by carrying out an operation in which the ink droplet Ip of a one-time amount (one-droplet amount) is ejected from an N-th nozzle (nozzle #N) toward the gap between the first detection member 72 and the second detection member 74 (S308). After the ejection, the variable N is set to a value of N+1 (S310), and it is checked whether or not the variable N is larger than the number of nozzles 180 (S312), Herein, if the variable N is larger than 180, then the procedure ends because the ejection test ends on all of the nozzles.

On the other hand, if the variable N is not larger than 180, then the procedure returns to step S308 because the ejection test has not ended on all of the nozzles #1 to #180, so that the ejection test is performed by carrying out an operation in which ink is ejected from an N+1-th nozzle (nozzle #N+1) (S308). Then, the variable N is again set to a value of N+1 (S310), and the ejection test is sequentially performed separately for each of the nozzles #1 to #180 until the variable N becomes larger than the number of nozzles 180.

It should be noted that these series of testing process is performed by the controller 126 based on programs read out from the main memory 127, or may be performed based on instructions from the computer 140, in this embodiment.

<Judging Process>

Figure 32B:
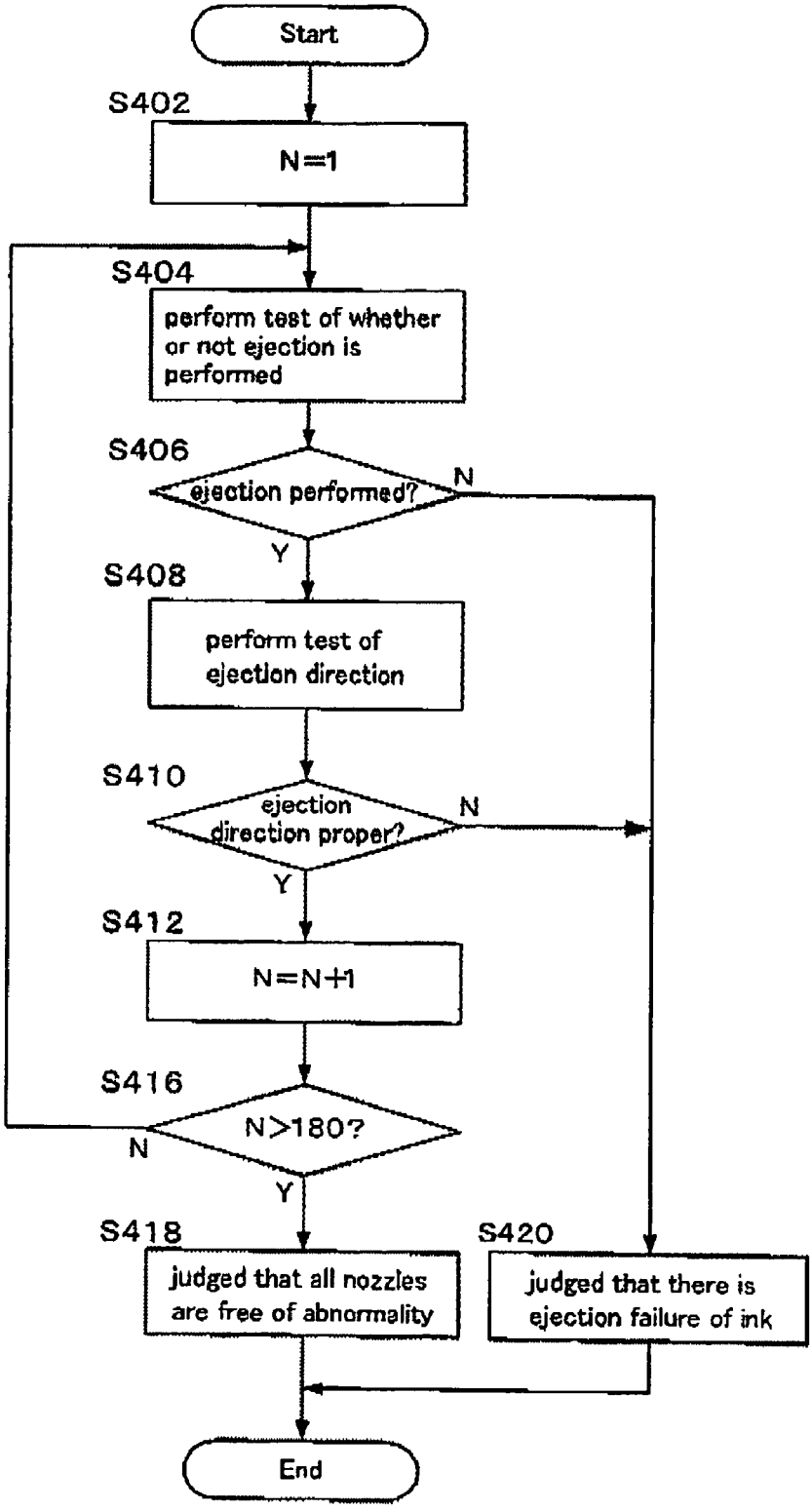
FIG. 32B is a flowchart illustrating an example of an ejection judging procedure from each nozzle when testing.

FIG. 32B is a flowchart illustrating an example of the judging procedure performed by the controller 126. The controller 126 sets the variable N to an initial value of 1 (S402). Next, the controller 126 performs the test of whether or not ejection is performed from the N-th nozzle (nozzle #N) (S404). This test is performed using the method described based on FIGS. 14 and 15, for example. Then, the controller 126 judges whether or not ejection is performed from the N-th nozzle (nozzle #N) (S406). If it is judged that ejection is not performed from the N-th nozzle (nozzle #N) as the result of the test, then the procedure proceeds to step S420, where the controller 126 determines that there is an ejection failure of ink (S420). Subsequently, the controller 126 ends the process.

On the other hand, if it is judged that ejection is performed from the N-th nozzle (nozzle #N), then the procedure proceeds to step S408, where the controller 126 performs the test of the ejection direction from the N-th nozzle (nozzle #N) (S408). This test is performed using the method described based on FIGS. 16A to 21, for example. Then, the controller 126 judges whether or not the ejection direction is proper (S410). If it is judged that the ejection direction from the N-th nozzle (nozzle #N) is not proper as the result of the test, then the procedure proceeds to step S420, where the controller 126 determines that there is an ejection failure of ink (S420). Subsequently, the controller 126 ends the process.

On the other hand, if it is judged that the ejection direction from the N-th nozzle (nozzle #N) is proper, then the procedure proceeds to step S412, where the controller 126 sets the variable N to a value of N+1 to perform the test on the next nozzle (S412). Then, the controller 126 checks whether or not the set variable N is larger than the number of nozzles 180 (S416), Herein, if the variable N is not larger than 180, then the procedure returns to step S404, where the controller 126 performs the test on another new nozzle (N+1-th nozzle) on which the test has not been performed. On the other hand, if the variable N is larger than 180, then the controller 126 judges that the test has been completed on all of the nozzles of a nozzle row that is to be tested, and the procedure proceeds to step S418, where it is determined that there is no abnormality at any of the nozzles of the nozzle row that is to be tested (S418), and then the process ends immediately.

Test Timing

Examples of the timing at which the ejection test is performed include the followings.

(1) During a Printing Process

The ejection test is performed at an appropriate timing during a printing process. For example, in the case of "bidirectional printing", the carriage 41 moves to the standby position and the ejection test is performed on the nozzles #1 to #180 each time the movement direction is changed. Thus, it is possible to avoid a trouble being caused in a print image due to clogging of the nozzles for example during a printing process.

(2) When the Power is Turned On

The ejection test is performed when the power is turned on. In this case, the ejection test is performed when the power of a printer (printing apparatus) is turned on in order to carry out printing, and the ejection test is performed on the nozzles #1 to #180 as one of the processes that are carried out during initialization of the inkjet printer 1. By performing the ejection test at this timing, a printing process can be carried out smoothly without clogging or the like in the nozzles #1 to #180.

(3) When Supplying Paper

The ejection test is performed at the time of an operation in which the medium S is sent to a predetermined position such that printing is carried out, that is, when supplying paper. In this case, it is checked whether or not ink is properly ejected when a printing process is about to be performed on one medium S, and the ejection test may be performed every time the medium S is supplied, or the ejection test may be performed for every predetermined number of media at an appropriate interval.

(4) When Acquiring Print Data

The ejection test is performed when the inkjet printer 1 receives print data from the computer 140 such as a personal computer. In other words, it is checked whether or not ink is properly ejected when print data is received from the computer 140 and printing is about to be carried out. It is possible to carry out a printing process smoothly without clogging in the nozzles #1 to #180, by performing the ejection test at this timing.

It should be noted that it is not necessarily required that the timing at which the ejection test of the present invention is performed is the above-described timings (1) to (4), and the ejection test may be performed at a timing other than the timings (1) to (4).

Summary

As described above, according to this embodiment, the magnitude of an induced current generated by ink ejected from each of the nozzles #1 to #180 at each of the first detection member 72 and the second detection member 74 is detected, and based on the magnitude of the induced current that has been detected, it is judged whether or not ink is properly ejected. Thus, it is possible to easily and efficiently perform the ejection test on each of the nozzles #1 to #180, and to perform the test at high precision. Accordingly, the time for the test can be shortened and the precision in the test can be improved.

Furthermore, in this embodiment, based on the difference between the magnitude of an induce current at the first detection member 72, which is detected by the first detecting section 82, and the magnitude of an induced current at the second detection member 74, which is detected by the second detecting section 84, it is judged whether or not the ejection direction is proper. Thus, it is possible to perform the ejection test at higher precision.

Furthermore, in this embodiment, the first detection member 72 and the second detection member 74 are arranged in the direction that intersects with the arrangement direction of the nozzles #1 to #180. Thus, it is possible to detect, in more detail, misalignment in the carrying direction of the ink droplet Ip ejected from the nozzles #1 to #180, Accordingly, it is possible to prevent "White streaks" from being generated in an image to be printed, in the movement direction of the carriage 41, so that the image quality of a print image can be significantly improved.

Furthermore, in this embodiment, the test is performed based on an induced current generated at the first detection member 72 and the second detection member 74 with ink ejected from each of the nozzles #1 to #180. Thus, it is possible to detect not only whether or not ink is ejected from the nozzles #1 to #180 but also the ejection direction of ink from the nozzles #1 to #180.

Furthermore, in this embodiment, the plurality of first detection members 72 and second detection members 74 are provided, and the plurality of first detection members 72 and second detection members 74 are arranged in parallel to each other. Thus, it is possible to efficiently perform the test on the nozzles #1 to #180.

Furthermore, in this embodiment, the first detection members 72 and the second detection members 74 are electrically connected to each other via the first common line 77A and the second common line 77B, and thus the test can be easily performed.

Furthermore, in this embodiment, a voltage is applied to the first detection members 72 and she second detection members 74, and thus ink ejected from the nozzles #1 to #180 can be easily charged.

Other Configuration Examples of Liquid-ejection Testing Device

<No. 1: Utilization of Frictional Electrification>

Figure 33A:
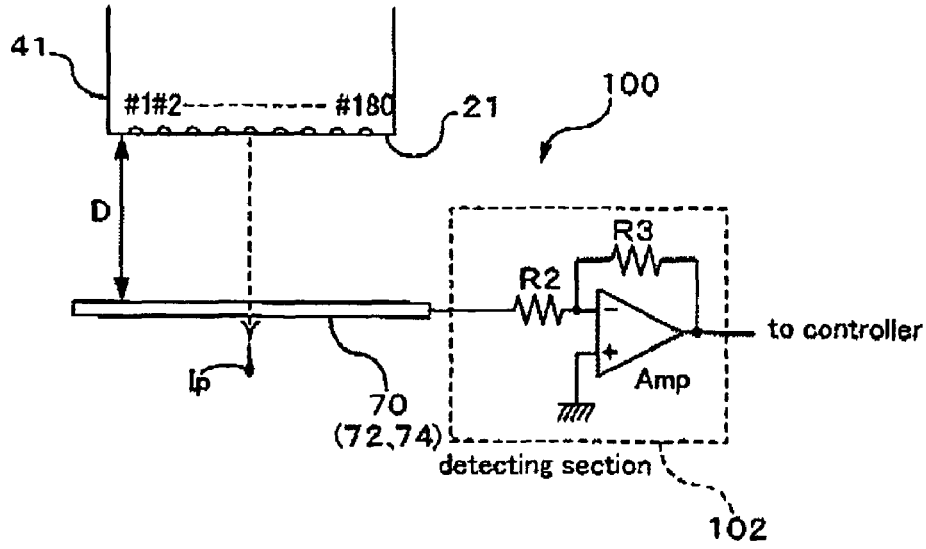
FIG. 33A is a diagram illustrating another embodiment of a liquid-ejection testing device according to the present invention.

FIG. 33A illustrates another configuration example of the liquid-ejection testing device according to the present invention. As shows in FIG. 33A, a liquid-ejection testing device 100 charges the ink droplet Ip by utilizing so-called frictional electrification in which the ink droplet Ip ejected from the nozzles #1 to #180 is naturally charged when parting from the nozzles #1 to #180, instead of charging the ink droplet Ip ejected from the nozzles #1 to #180 by applying a high voltage to the detection members 70 (the first detection members 72 or the second detection members 74) at which an induced current is generated, as in the above-described liquid-ejection testing device (see FIG. 9). Thus, the configuration for applying a high voltage to the detection members 70 in order to charge the ink droplet Ip has been omitted.

When the ink droplet Ip ejected from the nozzles #1 to #180 is charged utilizing frictional electrification in this manner, it is possible to further simplify the configuration of the liquid-ejection testing device 100.

It should be noted that since a high voltage is not applied to the detection members 70 (the first detection members 72 or the second detection members 74) in this embodiment, a detecting section 102 (corresponding to the first detecting section and the second detecting section) that detects an induced current generated at the detection members 70 (the first detection members 72 or the second detection members 74) has a configuration in which the capacitor C is removed from the configuration of the detecting section 80 in the above-described liquid-ejection testing device 62 (see the basic configuration 60 in FIG. 9).

<No. 2: Arrangement of Electrode Section>

Figure 33B:
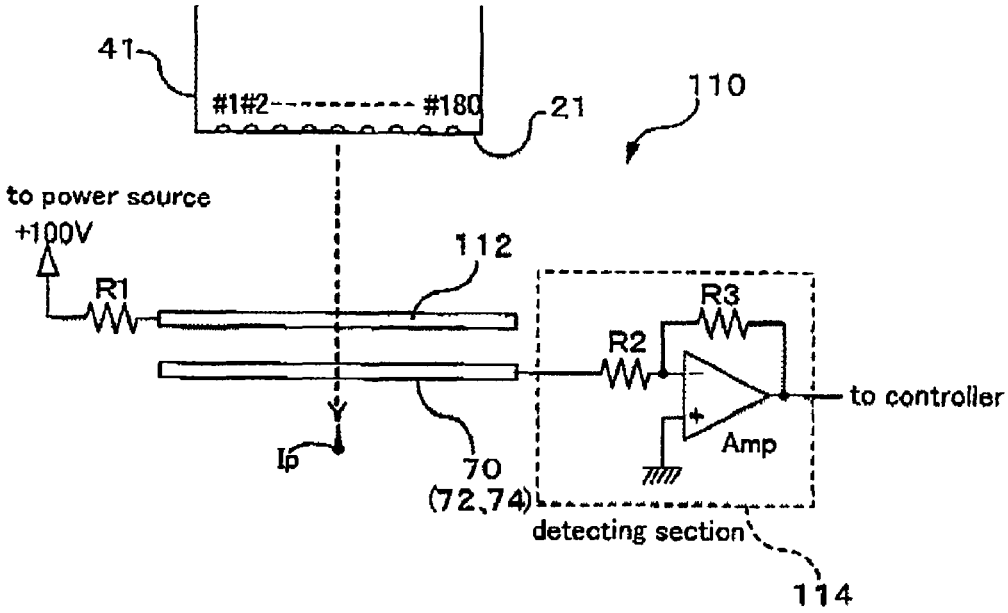
FIG. 33B is a diagram illustrating another embodiment of a liquid-ejection testing device according to the present invention.

FIG. 33B illustrates another configuration example of the liquid-ejection testing device according to the present invention. As shown in FIG. 33B, a liquid-ejection testing device 110 is provided with an electrode section 112 in addition to the detection members 70 (the first detection members 72 or the second detection embers 74), and the ink droplet Ip ejected from the nozzles #1 to #180 is charged by the electrode section 112. As shown in FIG. 33B, the electrode section 112 is made of a conductive wire material such as metal, and is disposed in parallel to the head 21 in such a manner that the electrode section 112 is stretched in tension, as the detection members 70 (the first detection members 72 or the second detection members 74). A power source (not shown) is connected via the protective resistance R1 to the electrode section 112, so that a high voltage such as 100 V (volt) is applied from the power source.

Since this electrode section 112 is provided, an electric field is formed between the head 21 and the electrode section 112, so that the ink droplet Ip can be charged when parting from the nozzles #1 to #180.

It should be noted that since a high voltage is not applied to the detection members 70 (the first detection members 72 or the second detection members 74) also in this case, as in the case of <No. 1> described above, a detecting section 114 (corresponding to the first detecting section and the second detecting section) that detects an induced current generated at the detection members 70 (the first detection members 72 or the second detection members 74) has a configuration in which the capacitor C is removed from the configuration of the detecting section 80 (the first detecting section 82 and the second detecting section 84) in the above-described liquid-ejection testing device 62 (see the basic configuration 60 in FIG. 9).

Furthermore, it is preferable that the electrode section 112 is disposed as close to the head 21 as possible. The closer the electrode section 112 is to the head 21, the stronger the electric field between the electrode section 112 and the head 21 becomes, and thus an induced current is generated even more easily at the detection members 70 (the first detection members 72 or the second detection members 74).

<No. 3: Other Embodiments of Detection Members>

Figure 34A:
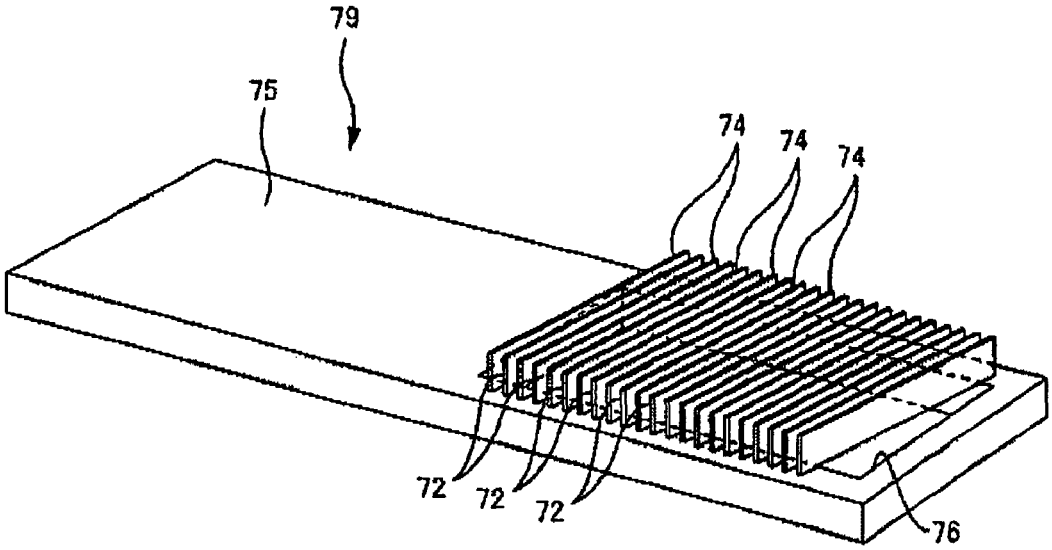
FIG. 34A is a perspective view illustrating another embodiment of detection members.
Figure 34B:
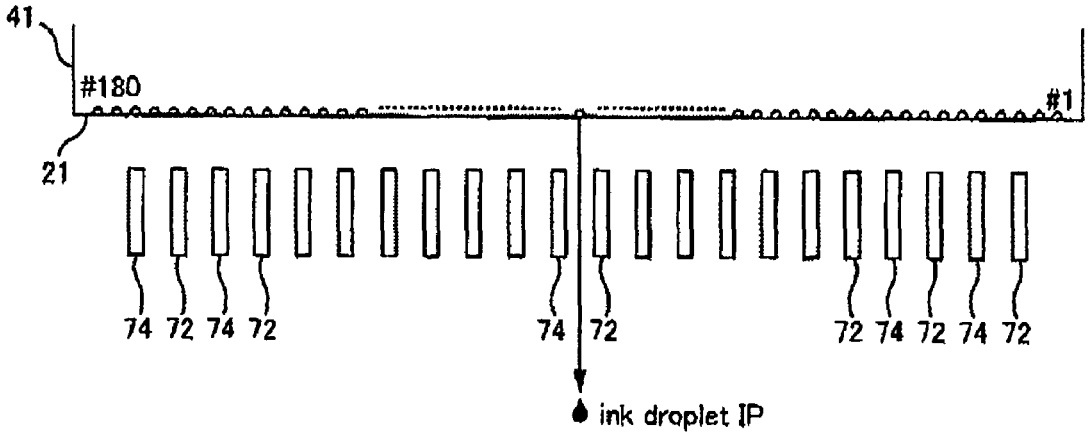
FIG. 34B is a lateral view illustrating another embodiment of detection members.

FIGS. 34A and 34B illustrate another embodiment of the first detection members 72 and the second detection members 74. FIG. 34A shows the ejection testing unit 79 in which the first detection members 72 and the second detection members 74 are arranged. FIG. 34B illustrates how the test is performed with the first detection members 72 and the second detection members 74.

As shown in FIG. 34A, each of the first detection members 72 and the second detection members 74 is made of a plate-shaped mater. The thickness of each of the plate-shaped first detection members 72 and second detection members 74 is set to about 0.2 mm in this embodiment. Furthermore, the height of each of the plate-shaped first detection members 72 and second detection members 74 is set to about 3 mm in this embodiment. The plate-shaped first detection members 72 and second detection members 74 span at an angle over the opening section 76 disposed at the front end portion of the substrate 75 in the ejection testing unit 79 such that the first detection members 72 and the second detection members 74 intersect with the movement direction of the carriage 41. The first detection members 72 and the second detection members 74 are alternately arranged in parallel to each other with a spacing therebetween. Herein, the spacings between the first detection members 72 and the second detection members 74 are equal to each other. Both end portions of each of the first detection members 72 and the second detection members 74 are fixed on the edge portions of the opening section 74. The first detection members 72 and the second detection members 74 are arranged in correspondence with the nozzles #1 to #180.

As shown in FIG. 34B, the ink droplet Ip ejected from each of the nozzles #1 to #180 of the head 21 passes through the gaps between the p first detection members 72 and the second detection members 74 to drop downward. Accordingly, an induced current is generated at the first detection members 72 and the second detection members 74.

Supplemental Remarks

<Ink Recovery Section>

Figure 35A:
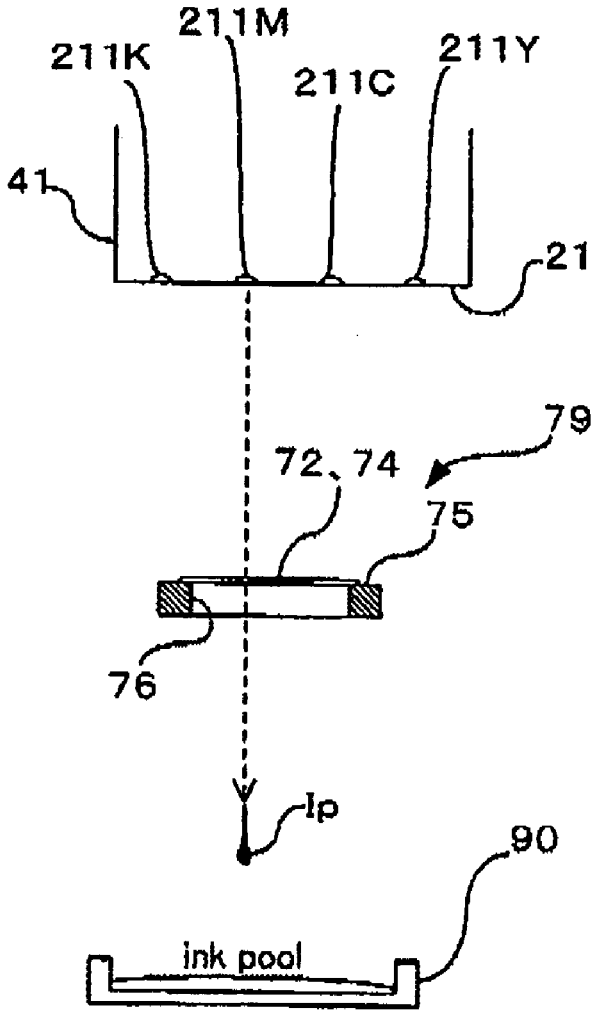
FIG. 35A is a view illustrating an example of an ink recovery section.
Figure 35B:
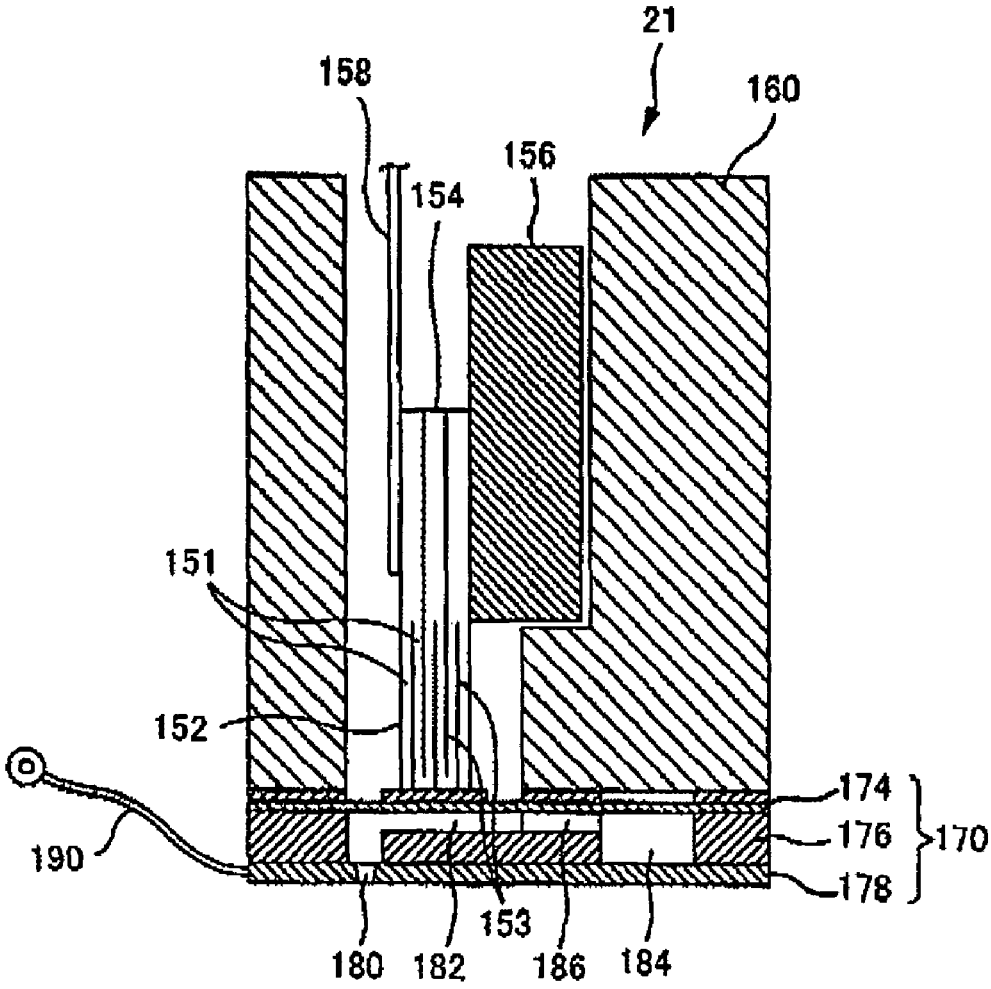
FIG. 35B is a view illustrating an example of a case in which the head is earthed.

The inkjet printer 1 according to this embodiment is provided with an ink recovery section 90 for recovering ink used in the ejection test. FIG. 35A illustrates the ink recovery section 90. As shown in FIG. 35A, the ink recovery section 90 is disposed, for example, below the ejection testing unit 79, and contains and recovers the ink droplet Ip that has been ejected from the nozzles #1 to #180 of the head 21, has passed by the sides of the first detection members 72 and the second detection members 74, and has dropped through the opening section 76 of the substrate 75. It is possible to prevent the internal portion of the inkjet printer 1 from being soiled by ink, by recovering ink used in the ejection test in this manner with the ink recovery section 90.

It should be noted that although the ink recovery section 90 is formed as a concave containing section as shown in FIG. 35A in this embodiment, it is also possible to be provided as, for example, a grooved portion with a concave-shaped cross section on the platen 14, as long as ink used in the ejection test is recovered.

<Water Repellency Processing>

A water repellency processing may be performed on the surface of the first detection members 72 and the second detection members 74. When a water repellency processing is applied to the surface of the first detection members 72 and the second detection members 74 in this manner, it is possible to easily remove ink from the surface of the first detection members 72 and the second detection members 74 even when the ink droplet Ip ejected from the nozzles #1 to #180 is brought into contact with the first detection members 72 and the second detection members 74.

Furthermore, the water repellency processing may be performed also on the surface of the electrode section 112. When a water repellency processing is performed on the surface of the electrode section 112 in this manner, it is possible to easily remove ink from the surface of the electrode section 112 even when the ink droplet Ip ejected from the nozzles #1 to #180 is attached to the electrode section 112.

Example of the method for performing the water repellency processing include a method in which the surface of the first detection members 72, the second detection members 74, or the electrode section 112 is coated with a water repellent layer, and other known methods.

<Earth Structure of Head>

The above-described head 21 may be electrically earthed (grounded). FIG. 35A illustrates an example of the earth structure of the head 21 and shows an example of the internal structure of the head 21. As shown in FIG. 35A, the head 21 shown here is provided with a vibrator unit 150 in which a piezoelectric vibrator group 154 comprising a plurality of piezoelectric vibrators 152, a fixed plate 156, a flexible cable 158 and other components are included as a unit, a case 160 that can accommodate the vibrator unit 150, and a channel unit 170 that is attached on the front end face of the case 160.

The piezoelectric vibrators 152 serve as the above-described piezo elements. The piezoelectric vibrators 152 are constituted by alternate layers of piezoelectric substances 151 and internal electrodes 153, and are formed in the shape of an elongated comb in the longitudinal direction. The piezoelectric vibrators 152 are expanded or constricted in the longitudinal direction, that is, the longitudinal direction, in response to drive signals from the outside. The front end portions (lower end portions) of the piezoelectric vibrators 152 are connected via an insular part 172 to the channel unit 170.

The channel unit 170 comprises an elastic plate 174, a channel forming substrate 176 and a nozzle plate 178. The nozzle plate 178 is a thin plate made of stainless steel, for example, and has a large number of nozzle openings 180 (corresponding to nozzles #1 to #180) formed with a predetermined pitch. The nozzle openings form the nozzles #1 to #180. The channel forming substrate 176 is provided with pressing compartments 182 formed in correspondence with the nozzle openings 180.

When the piezoelectric vibrators 152 are expanded or constricts, the elastic plate 172 is deformed to be curved upward or downward, so that the pressing compartments 182 are expanded or constricted. Thus, ink is supplied from ink supply compartments 184 through ink supply paths 186 to the pressing compartments 182. Ink that has been stored in the pressing compartments 182 is ejected as an ink droplet from the nozzle openings 180.

When the head 21 provided with such an ink ejection mechanism is earthed, the nozzle plate 171 of the channel unit 170 is connected to an earth line 190, and then the earth line 190 is connected to an appropriate metal member. If the guide rail 46 is made of metal, the earth line 190 is connected to the guide rail 46, for example. When the nozzle plate 178 is earthed via the earth line 190 in this manner, it is possible to easily earth the head 21.

Configuration of Liquid Ejection System etc.

Figure 36:
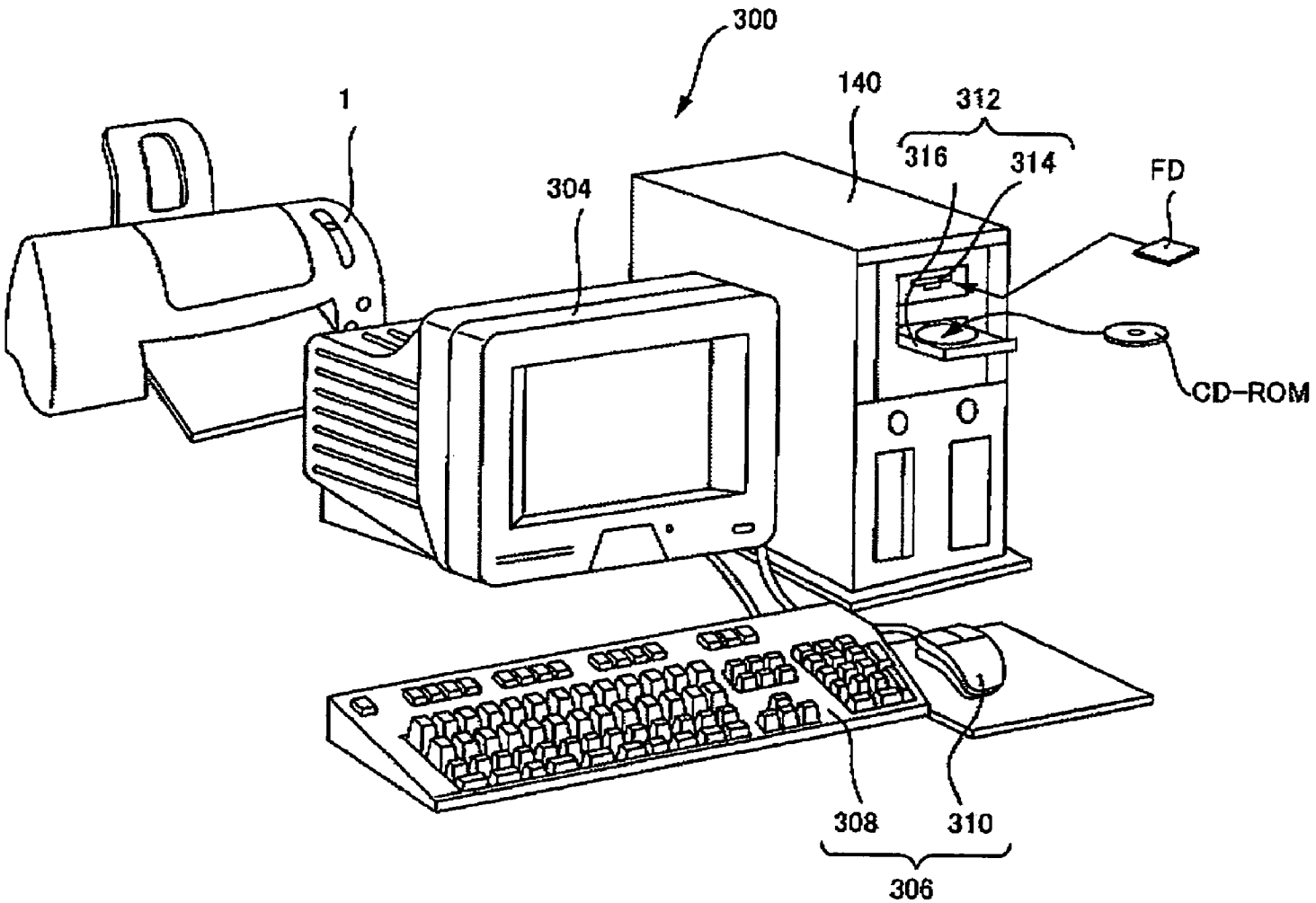
FIG. 36 is a perspective view showing the appearance of an example of a liquid ejection system.

The following is a description concerning an example in which the inkjet printer 1 is provided as a liquid ejecting apparatus, as an embodiment of a liquid ejection system according to the present invention. FIG. 36 shows the appearance configuration of an embodiment of a liquid ejection system according to the present invention. A liquid ejection system 300 is provided with the computer 140, a display device 304, and an input device 306. The computer 140 is constituted by various computers such as a personal computer.

The computer 140 is provided with a reading device 312 such as an FD drive 314 and a CD-RCM drive 316. In addition to the above, the computer 140 may be provided with, for example, an MO (magnet optical) disk drive and a DVD drive. Furthermore, the display device 304 is constituted by various display devices such as a CRT display, a plasma display, a liquid crystal display. The input device 306 is constituted by, for example, a keyboard 308 and a mouse 310.

Figure 37:
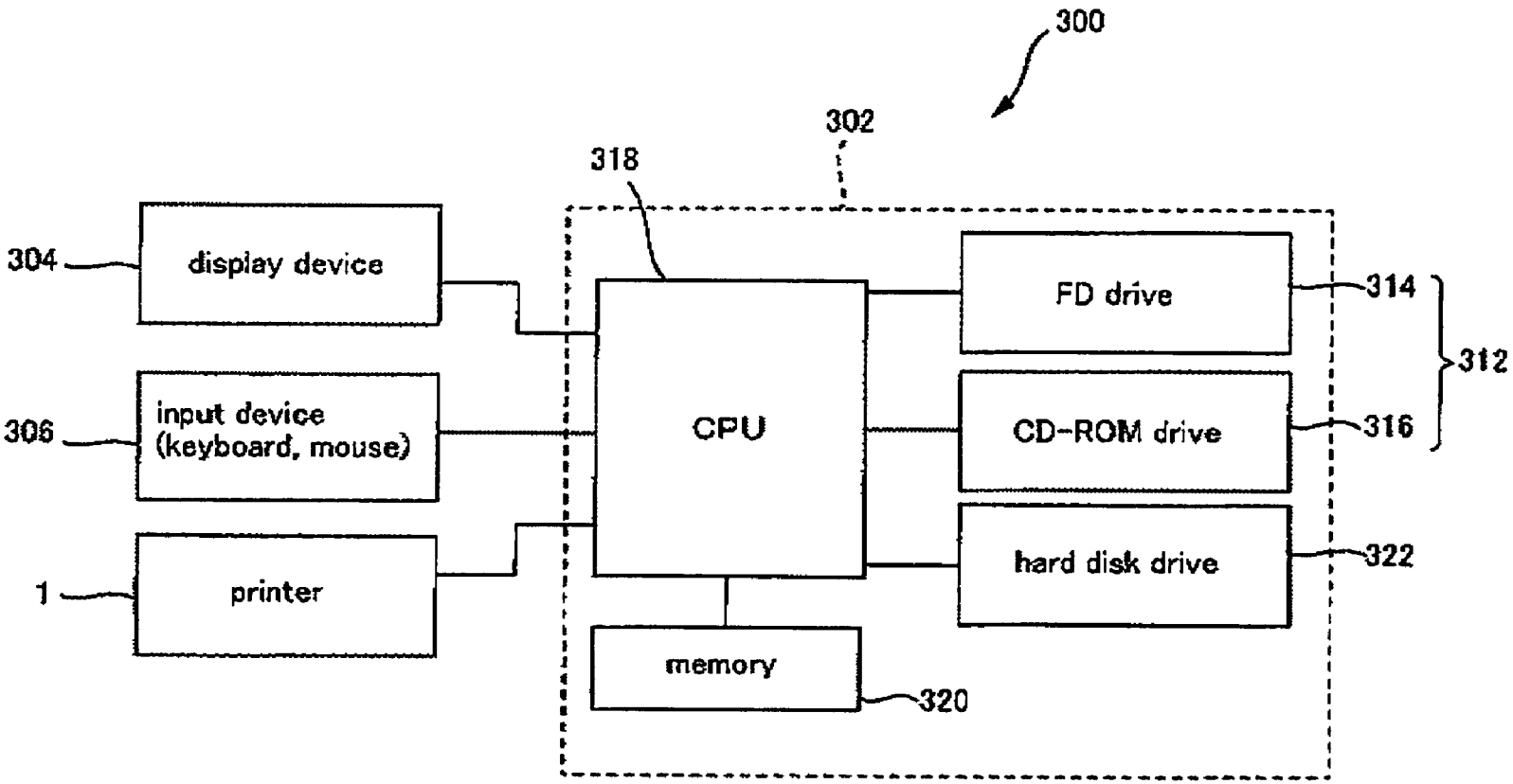
FIG. 37 is a block diagram showing the system configuration of an example of the liquid ejection system.

FIG. 37 is a block diagram showing an example of the system configuration of the liquid ejection system according to this embodiment. The computer 140 is provided with a CPU 318, a memory 320, and a hard disk drive 322 in addition to the reading device 312 such as the FD drive 314 and the CD-RCM drive 316.

The CPU 318 performs overall control of the computer 140. Furthermore, various types of data is stored in the memory 320. A printer driver, for example, as a program for controlling a liquid ejecting apparatus such as the inkjet printer 1 according to this embodiment is installed in the hard disk drive 322. The CPU 318 reads out a program such as the printer driver stored in the hard disk drive 322 and operates according to the program. Furthermore, the CPU 318 is connected to, for example, the display device 304, the input device 306, and the inkjet printer 1 arranged outside the computer 140.

As an overall system, the liquid ejection system 300 that is thus achieved is superior to conventional systems.

Other Embodiments

In the description above, based on an embodiment, a printing apparatus such as a printer according to the present invention was described. However, the foregoing embodiment is for the purpose of elucidating the present invention and is not to be interpreted as limiting the present invention. The invention can of course be altered and improved without departing from the gist thereof and includes functional equivalents. In particular, the embodiments described below are also included in the printing apparatus according to the present invention <Regarding the Liquid>

In the foregoing embodiment, an example was described in which ink is used as a liquid, but the liquid is not limited to ink. Instead of ink, it is also possible to employ various other liquids such as metallic material, organic material (such as macromolecular material), magnetic material, conductive material, wiring material, film-formation material, electric ink, various types of processed liquid, and genetic solutions.

<Regarding the Liquid Ejecting Nozzles>

In the foregoing embodiment, "liquid ejecting nozzles" was described by taking the nozzles #1 to #180 ejecting ink as an example, but the liquid ejecting nozzles are not limited to such nozzles that eject ink. More specifically, it is also possible to employ nozzles that eject, as the liquid, various other liquids than ink such as metallic material, organic material (such as macromolecular material), magnetic material, conductive material, wiring material, film-formation material, electric ink, various types of processed liquid, and genetic solutions, as described above.

Furthermore, in the foregoing embodiment, the liquid ejecting nozzles were described using an example in which the nozzles #1 to #180 that eject ink are arranged in one straight line with a spacing therebetween in the carrying direction of the medium S, but it is not necessarily required that the liquid ejecting nozzles are arranged in this manner. More specifically, the liquid ejecting nozzles may be arranged in a manner different from this, and there is no special requirement for the arrangement of the nozzles.

<Regarding the First Detection Members and the Second Detection Members>

In the foregoing embodiment, the first detection miners 72 and the second detection members 74 were made of wire materials having a diameter of about 0.2 mm, or plate-shaped members having a thickness of about 0.2 mm and a width of about 3 mm, for example, but it is not necessarily required that "first detection members" and "second detection members" are formed by such members. More specifically, the form and the size of the first detection members and the second detection members are not necessarily limited to this. They may be made of materials of other shapes than those of wire materials and plate-shaped members, and may have other sizes.

Furthermore, in the foregoing embodiment, the first detection members 72 and the second detection members 74 spanned over the opening section 76 disposed at the substrate 75, but it is not necessarily required that the first detection members and the second detection members are arranged in this manner. More specifically, the detection members may be arranged in any manner as long as it is possible to detect ink ejected from the liquid ejecting nozzles (nozzles #1 to #180).

Furthermore, in the foregoing embodiment, the number of the first detection members 72 and the second detection members 74 was eight for each, but it is not necessarily required to provide the first detection members and the second detection members of such a number because the number of the first detection members and the second detection members may be one, may be two to seven, or may be nine or more. It goes without saying that it is preferable to set the number of the first detection members and the second detection members to a large number to the extent possible, in accordance with the number of nozzles that are to be tested. Furthermore, it is not necessarily required that the first detection members and the second detection members are alternately arranged, and either or them may be arranged at every two or three of the other detection members, for example.

Furthermore, in the foregoing embodiment, an example was described in which the plurality of first detection members 72 and second detection members 74 are provided and they are arranged in parallel to each other at an equal spacing therebetween, but it is not necessarily required that the first detection members and the second detection members are arranged in this manner. More specifically, it is not necessarily required that the first detection members 72 and the second detection members 74 are arranged in parallel to each other. They may be arranged in directions that are different from each other, may be arranged with a spacing therebetween that is not an equal spacing, or may be arranged so as to intersect with each other.

Furthermore, in the foregoing embodiment, the first detection members 72 arid the second detection members 74 were arranged in the direction that intersects with the arrangement direction of the nozzles #1 to #180, but it is not necessarily required that they are arranged in this manner. More specifically, they may be arranged in parallel to the direction that intersects with the arrangement direction of the nozzles #1 to #180 as long as an induced current can be generated with ink ejected from the nozzles #1 to #180. For example, a configuration can be such that the first detection members 72 and the second detection members 74 are arranged on both side of the nozzles #1 to #180, having the nozzles #1 to #180 between them.

<Regarding the Detecting Section>

In the foregoing embodiment, the detecting sections 80, 82, 64, 102, and 114 were described as "first detecting section" and "second detecting section", but the first detecting section and the second detecting section are not limited to these detecting sections 80, 82, 84, 102, and 114, and a detecting section of any type may be employed as long as it can detect an induced current generated at the first detection members 72 or the second detection members 74 with a charged liquid (ink) ejected from the liquid ejecting nozzles (nozzles #1 to #180 in this embodiment).

<Regarding the Judging Section>

In the foregoing embodiment, the judgment of whether or not ink is properly ejected from the nozzles #1 to #180 was performed by the controller 126 that performs overall control of the inkjet printer 1 (printing apparatus), but it is not necessarily required that the judgment of whether or not ink is properly ejected from the nozzles #1 to #180 is performed by this controller 126. More specifically, "judging section" that judges whether or not ink (liquid) is properly ejected is not limited to this controller 126. It may have a configuration different from that of the controller 126, or a dedicated configuration for judging whether or not ink (liquid) is properly ejected may be provided.

<Regarding the Actual Measurement Value>

In the foregoing embodiment, "actual measurement value" was described by taking the peak values V1max ("V1max1" to "V1max180") and V2max ("V2max1" to "V2max180") of the detection signals from the first detecting section 82 and the second detecting section 84 as an example. However, the actual measurement value is not limited to these peak values Vmax. More specifically, it is also possible to employ other values than the peak values V1max and V2max as long as they are actual measurement values obtained when the first detecting section or the second detecting section detects the magnitude of an induced current generated at the first detection members or the second detection members with ink actually ejected from the nozzles.

Furthermore, in the foregoing embodiment, the reference value is set based on the actual measurement value obtained when the detecting section detects the magnitude of an induced current generated at the detection members by actually ejecting a liquid (ink) from each of the nozzles #1 to #180. However, it is not necessarily required that ink is ejected from all of the nozzles #1 to #180 when acquiring the actual measurement value. More specifically, the reference value may be set for each of the nozzles #1 to #180 based on the actual measurement value obtained when ink is ejected from particular (one, or two or more) nozzles among the plurality of nozzles #1 to #180.

<Regarding the Electrode Section>

In the foregoing embodiment, the electrode section 112 made of a wire material was described as "electrode section", but the electrode section is not limited to this electrode section 112. An electrode section of any form may be employed as long as it forms an electric field with the nozzles #1 to #180 (head 21).

<Regarding the Liquid-ejection Testing Device>

In the foregoing embodiment, a liquid-ejection testing device mounted on a liquid ejecting apparatus such as the ink jet printer 1 was described as a liquid-ejection testing device, but the liquid-ejection testing device is not limited to such a device. It may be a device that is separated from the liquid ejecting apparatus such that it can independently perform only the ejection test of a liquid, or may be a liquid-ejection testing device that is mounted on other devices than the above-described liquid ejecting apparatus.

<Regarding the Liquid Ejecting Apparatus>

In the foregoing embodiment, a liquid-ejection testing device was described by taking the inkjet printer 1 as an example, but it is not limited to this inkjet printer 1. Any apparatus may be employed as long as it is an apparatus that ejects a liquid.

<Regarding the Ink>

The ink that is used may be pigment ink or may be various other types of ink such as dye ink.

As for the color of the ink, it is also possible to use ink of other colors, such as light cyan (LC), light magenta (LM), dark yellow (DY), or red, violet, blue or green, in addition to the above-mentioned yellow (Y), magenta (M), cyan (C) and black (K).

<Regarding the Printing Apparatus>

In the foregoing embodiment, a printing apparatus was described by taking the above-described inkjet printer 1 as an example, but it is not limited to such a printing apparatus, and an inkjet printer for ejecting ink in other modes also may be employed.

<Regarding the Medium>

The medium S may be any of plain paper, matte paper, cut paper, glossy paper, roll paper, print paper, photo paper, and roll-type photo paper or the like. In addition to these, the medium S may be a film material such as OHP film and glossy film, a cloth material, or a metal plate material or the like. In other words, any medium that can be printed on may be employed.

What is claimed is:

1. A liquid-ejection testing method, comprising:

making conductive first detection members and conductive second detection members opposed, in a non-contact state, to a liquid ejecting nozzle that is to be tested;

ejecting a charged liquid from the liquid ejecting nozzle;

acquiring a first peak value from an induced current generated at the first detection members by the liquid that has been ejected from the liquid ejecting nozzle;

acquiring a second peak value from an induced current generated at the second detection members by the liquid that has been ejected from the liquid ejecting nozzle;

checking whether or not a difference between the first peak value and the second peak value is within a predetermined tolerance range;

judging that ejection of the liquid is properly performed for the liquid ejecting nozzle in case that the difference is within a predetermined tolerance range; and judging that ejection of the liquid is not properly performed for the liquid ejecting nozzle in case that the difference is not within the predetermined tolerance range;

wherein the first detection members and the second detection members are disposed in a direction that intersects with a direction in which liquid ejecting nozzles are arranged;

wherein the first detection members constitute a first comb and the second detection members constitute a second comb;

wherein the first comb and the second comb are meshed with each other;

wherein one of the first detection members and one of the second detection members are used to judge whether or not ejection of the liquid is properly performed for a certain liquid ejecting nozzle; and wherein the one of the first detection members and another one of the second detection members are used to judge whether or not ejection of the liquid is properly performed for another liquid ejecting nozzle.

2. A liquid-ejection testing method according to claim 1, wherein at least one of the first detection members and the second detection members is made of a plate-shaped member or a wire material.

3. A liquid-ejection testing method according to claim 1, wherein whether or not the liquid has been ejected from the certain liquid ejecting nozzle is judged based on the magnitude of the detected induced current that has been generated at the one of the first detection members and the magnitude of the detected induced current that has been generated at the one of the second detection members.

4. A liquid-ejection testing method according to claim 1, wherein whether or not an ejection direction of the liquid from the liquid ejecting nozzle is proper is judged based on the magnitude of the detected induced current that has been generated at the one of the first detection members and the magnitude of the detected induced current that has been generated at the one of the second detection members.

5. A liquid-ejection testing method according to claim 1, wherein the one of the first detection members and the one of the second detection members are arranged in parallel, to each other.

6. A liquid-ejection testing method according to claim 5, wherein the first detection members or second detection members are electrically connected to each other via a common line.

7. A liquid-ejection testing method according to claim 6, wherein the common line is connected to a detecting section for detecting the magnitude of the induced current generated at the first detection members or second detection members.

8. A liquid-ejection testing method according to claim 6, wherein the common line is connected to one end portion of each of the first detection members or second detection members.

9. A liquid-ejection testing method according to claim 1, wherein a plurality of liquid ejecting nozzles is to be tested.

10. A liquid-ejection testing method according to claim 1, wherein the plurality of first detection members or second detection members are arranged at even intervals.

11. A liquid-ejection testing method according to claim 1, wherein at least one of the first detection members and the second detection members is arranged spanning over an opening section provided in a substrate.

12. A liquid-ejection testing method according to claim 1, wherein a voltage is applied to at least one of the first detection members and the second detection members in order to charge the liquid to be ejected from the liquid ejecting nozzle.

13. A liquid-ejection testing method according to claim 1, wherein the liquid to be ejected from the certain liquid ejecting nozzle is charged by an electrode section to which a voltage is applied.

14. A liquid-ejection testing method according to claim 1, further comprising:

changing a relative position between the certain liquid ejecting nozzle, and the one of the first detection members and the one of the second detection members.

15. A liquid-ejection testing device, comprising:

conductive first detection members arranged in a state of non-contact with respect to a liquid ejecting nozzle that is to be tested;

conductive second detection members arranged in a state of non-contact with respect to the liquid ejecting nozzle that is to be tested;

a first detecting section which acquires a first peak value from an induced current generated at the first detection members by a charged liquid ejected from the liquid ejecting nozzle;

a second detecting section which acquires a second peak value from an induced current generated at the second detection members by the charged liquid ejected from the liquid ejecting nozzle;

a checking section which checks whether or not a difference between the first peak value and the second peak value is within a predetermined tolerance range;

a first judging section which judges that ejection of the liquids is properly performed for the liquid ejecting nozzle in case that the difference is within a predetermined tolerance range; and a second judging section which judges that ejection of the liquid is not properly performed for the liquid ejecting nozzle in case that the difference is not within the predetermined tolerance range;

wherein the first detection members and the second detection members are disposed in a direction that intersects with a direction in which liquid ejecting nozzles are arranged;

wherein the first detection members constitute a first comb and the second detection members constitute a second comb;

wherein the first comb and the second comb are meshed with each other;

wherein one of the first detection members and one of the second detection members are used to judge whether or not ejection of the liquid is properly performed for a certain liquid ejecting nozzle; and wherein the one of the first detection members and another one of the second detection members are used to judge whether or not ejection of the liquid is properly performed for another liquid ejecting nozzle.

16. A computer-readable medium for causing a liquid-ejection testing device to operate, comprising:

a code for ejecting a charged liquid from a liquid ejecting nozzle that is to be tested;

a code for acquiring a first peak value from an induced current generated by the liquid that has been ejected from the liquid ejecting nozzle at conductive first detection members arranged in a state of non-contact with respect to the liquid ejecting nozzle;

a code for acquiring a second peak value from an induced current generated by the liquid that has been ejected from the liquid ejecting nozzle at conductive second detection members arranged in a state of non-contact with respect to the liquid ejecting nozzle;

a code for checking whether or not a difference between the first peak value and the second peak value is within a predetermined tolerance range;

a code for judging that ejection of the liquid is properly performed for the liquid ejecting nozzle in case that the difference is within a predetermined tolerance range; and a code for judging that ejection of the liquid is not properly performed for the liquid ejecting nozzle in case that the difference is not within the predetermined tolerance range;

wherein the first detection members and the second detection members are disposed in a direction that intersects with a direction in which liquid ejecting nozzles are arranged;

wherein the first detection members constitute a first comb and the second detection members constitute a second comb;

wherein the first comb and the second comb are meshed with each other;

wherein one of the first detection members and one of the second detection members are used to judge whether or not ejection of the liquid is properly performed for a certain liquid ejecting nozzle; and wherein the one of the first detection members and another one of the second detection members are used to judge whether or not ejection of the liquid is properly performed for another liquid ejecting nozzle.

* * * * *